US010633235B2

(12) United States Patent
Randall

(10) Patent No.: US 10,633,235 B2
(45) Date of Patent: Apr. 28, 2020

(54) LIFTING SYSTEM INCLUDING ROTATING ATTACHMENT LINK

(71) Applicant: Red Rescue, LLC, Renton, WA (US)

(72) Inventor: Steven Randall, Renton, WA (US)

(73) Assignee: Red Rescue, LLC, Renton, WA (US)

( * ) Notice: Subject to any disclaimer, the term of this patent is extended or adjusted under 35 U.S.C. 154(b) by 0 days.

(21) Appl. No.: 16/275,532

(22) Filed: Feb. 14, 2019

(65) Prior Publication Data

US 2019/0233271 A1 Aug. 1, 2019

Related U.S. Application Data

(63) Continuation-in-part of application No. 16/242,894, filed on Jan. 8, 2019, which is a continuation of application No. 15/908,751, filed on Feb. 28, 2018, now Pat. No. 10,196,250, which is a continuation-in-part of application No. 15/627,316, filed on Jun. 19, 2017, now Pat. No. 9,938,125.

(60) Provisional application No. 62/352,092, filed on Jun. 20, 2016.

(51) Int. Cl.

| | |
|---|---|
| ***B66F 13/00*** | (2006.01) |
| ***A62B 99/00*** | (2009.01) |
| *A62B 3/00* | (2006.01) |

(52) U.S. Cl.

CPC ..... *B66F 13/00* (2013.01); *A62B 99/00* (2013.01); *A62B 3/00* (2013.01)

(58) Field of Classification Search

CPC ..... B66F 1/00; B66F 3/00; B66F 5/00; B66F 7/00; B66F 3/18; B66F 13/00

See application file for complete search history.

(56) References Cited

U.S. PATENT DOCUMENTS

| | | | | |
|---|---|---|---|---|
| 3,286,985 | A * | 11/1966 | Edera | B66F 3/42 254/2 B |
| 3,618,894 | A | 11/1971 | Meyer | |
| 3,843,147 | A | 10/1974 | Fredricson | |
| 4,388,037 | A | 6/1983 | Suarez | |
| 4,497,501 | A | 2/1985 | Kedem | |
| 4,589,669 | A | 5/1986 | Kedem | |
| 4,594,048 | A | 6/1986 | Sipla | |
| 5,810,333 | A * | 9/1998 | Hickerson | A62B 3/005 254/133 R |
| 5,876,011 | A | 3/1999 | Blasing | |
| 6,109,593 | A | 8/2000 | Craychee | |
| 6,241,227 | B1 | 6/2001 | Berdan et al. | |
| 8,251,349 | B2 | 8/2012 | Drake | |
| 8,672,298 | B2 | 3/2014 | Hsieh | |
| 8,814,142 | B2 | 8/2014 | Pasto et al. | |
| 9,938,125 | B2 * | 4/2018 | Randall | B66F 1/04 |

(Continued)

*Primary Examiner* — Lee D Wilson

(74) *Attorney, Agent, or Firm* — Cozen O'Connor

(57) ABSTRACT

Embodiments in the present description are provided for a lever adapter device for use in lifting a vehicle or other heavy objects. Additional embodiments in the present description are provided for a Bi-pod rescue strut system for use in stabilizing a vehicle or other object. The lever adapter device includes stabilizing feet and one or more support legs. The lever adapter device further includes a hinge disposed at an end of each support leg. The lever adapter device further includes a rotatable attachment link that enables options for the orientation of a lifting device to assist in lifting the vehicle or the other heavy objects.

20 Claims, 29 Drawing Sheets

(56) References Cited

U.S. PATENT DOCUMENTS

| | | | | |
|---|---|---|---|---|
| 10,196,250 | B2 * | 2/2019 | Randall | A62B 99/00 |
| 2005/0263670 | A1 | 12/2005 | Pasto | |
| 2006/0125196 | A1 | 6/2006 | Hartmann et al. | |
| 2006/0181039 | A1 * | 8/2006 | Fridlington, Jr. | B62B 3/0618 280/43.12 |
| 2013/0087749 | A1 | 4/2013 | Hsieh | |
| 2017/0253470 | A1 | 9/2017 | Jones | |
| 2017/0362069 | A1 * | 12/2017 | Randall | B66F 1/04 |
| 2018/0186615 | A1 * | 7/2018 | Randall | A62B 99/00 |
| 2019/0218084 | A1 * | 7/2019 | Randall | A62B 99/00 |
| 2019/0233271 | A1 * | 8/2019 | Randall | A62B 99/00 |

* cited by examiner

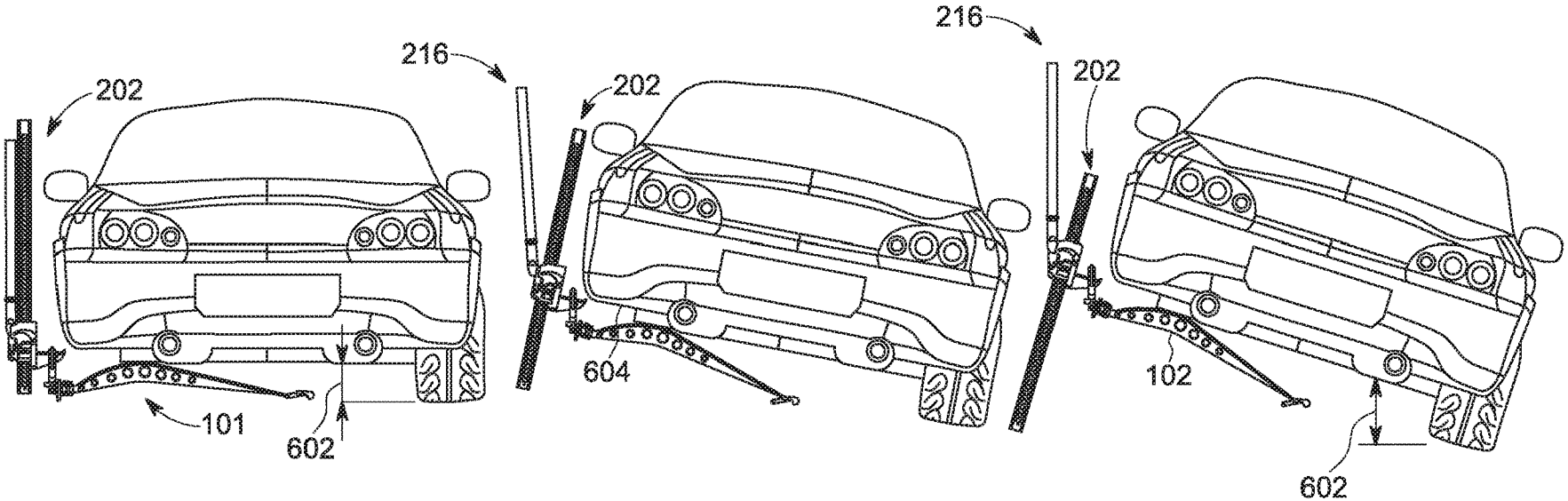
FIG. 6A
FIG. 6B
FIG. 6C
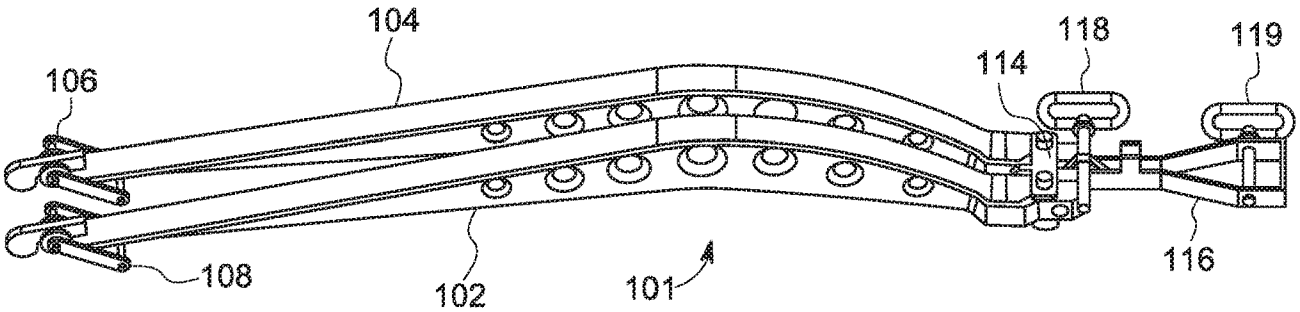
FIG. 7

LIFTING SYSTEM INCLUDING ROTATING ATTACHMENT LINK

CROSS REFERENCE TO RELATED APPLICATIONS

This application is a continuation-in-part of U.S. patent application Ser. No. 16/242,894, filed Jan. 8, 2019, which is a continuation of U.S. patent application Ser. No. 15/908,751, filed Feb. 28, 2018, (now U.S. Pat. No. 10,196,250) which is a continuation-in-part of U.S. patent application Ser. No. 15/627,316, filed Jun. 19, 2017, (now U.S. Pat. No. 9,938,125), which claims the benefit of U.S. Provisional Application No. 62/352,092, filed Jun. 20, 2016, the contents of which are incorporated herein by reference.

FIELD OF THE DISCLOSURE

The field of invention generally relates to a portable and universal lever adapter device and a portable bracing and support system. More specifically, the present description includes embodiments for a tool that may be used to assist in lifting vehicles when coupled to a variety of jacks or other lifting and rescue devices. The present description is further directed to an adjustable, telescopic Bi-pod rescue strut system, suitable for use in stabilizing and lifting a vehicle or other object at the scene of an accident or emergency setting.

BACKGROUND

Jacks and other lifting type devices are commonly used to facilitate access to the underside of vehicles or such objects for repairs, maintenance, and emergencies. When an automobile, truck or other motor vehicle is involved in an accident, there are occasions when the vehicle comes to rest on its side or its roof, for example, on a person, or against an object, such as a tree, utility pole or another vehicle. Emergency responders, including firefighters and first responders, understand the plethora of difficulties involved in rescuing individuals trapped under vehicles and other heavy objects, such as fallen trees, walls, and poles. In such situations, the vehicles or other heavy object must be stabilized and lifted to allow rescue personnel to remove the driver and passengers, and any victim trapped beneath the vehicle. Moreover, in order to prevent further injury to the occupants of the vehicle or rescue personnel, or further damage to the vehicle itself, the vehicle usually must be stabilized and lifted in the position at which it has come to rest.

Jacks and other such lifting devices, while simple, inexpensive, and relatively portable, place the emergency rescuer, firefighter, police and law enforcement personnel, or any other type of individual in a crowded, inconvenient, and frequently dangerous position. Existing jacks and other such lifting devices, have a variety of downfalls. For example, many jacks only have a single contact and load point structure. Depending on a variety of factors, the single contact point structure and the single load point structure may put the vehicle in an unstable and unsafe position when lifted. There may be inadvertent slippage of the vehicle or the jack. Further, the undercarriage of many vehicles is close to the ground, and consequently, even with crawlers, jacks, and ramps, access is inconvenient and somewhat difficult, forcing one to creep beneath the car in a supine position or to aid someone with injuries. Another problem includes the inconvenience of needing to install or attach lifting devices.

The airbag method is an alternative to using the existing car jacks and lifts. The airbag method is often used by the rescue community when lifting a vehicle that has come to rest on top of a pedestrian, vehicle passenger, or bicycle rider. The airbag method involves a number of steps that require multiple people and pieces of equipment that must be prepared beneath a vehicle or other object before the air bags are able to effectively raise the vehicle or other object high enough off of the ground to allow clearance to rescue any individuals trapped beneath the vehicle or other object. The air bag lift method requires using multiple specialty air bags, whereby a first air bag is inflated individually with air and then another airbag may be placed over the first and inflated.

A disadvantage of the air bag method is that multiple components and time is needed for implementation. For example, it is estimated that the airbag method requires three highly trained firefighters and first responders at least three to five rescue man minutes (which translates to nine to fourteen minutes for an ordinary, untrained individual) for transporting of equipment, setup, and connections of the many components. This may then translate to ten to twelve rescuer minutes for an emergency responder to successfully assist and extract a trapped individual. In an emergency rescue operation, time is of the essence and anything that may be done to increase the speed as well as maintain the safety of those involved in an emergency rescue is needed. A further disadvantage of the airbag methods is that two (2) airbags are the limit unless an additional lifting platform and support scribbing are utilized. Further, multiple man minutes are needed to lift an object over 12 inches using the airbags.

Various attempts have been made to provide alternatives to existing methods and techniques of lifting vehicles or other heavy objects. Previously filed patents exist that describe such methods and techniques for lifting vehicles or other heavy objects, however, they do not provide an adequate solution for a quick and convenient response when a vehicle or other object must be lifted as quickly as possible, such as during emergency rescue operations. For example, U.S. Pat. No. 4,594,048 describes a method of lifting a vehicle that uses two J-shaped members that are tied together and used to flip rotate a car through more than 90 degrees. However, it is noted that the J-Shaped members described in U.S. Pat. No. 4,594,048 are large and bulky and must be attached to front and rear wheels. Further, U.S. Pat. No. 4,594,048 teaches that the vehicle must first be jacked-up using a body jack. U.S. Pat. No. 4,594,048 is primarily used for maintenance of a vehicle to allow access to both an underside and a top of a vehicle and would not be useful or realistic if used during emergency rescue operations where timely and easy techniques must be used to access an individual in distress beneath a vehicle or other heavy object.

U.S. Pat. No. 3,618,894 describes using a manually operated, wheeled hydraulic lift that is coupled to a beam at one end by a chain. Centered on the beam is a raised assembly that makes contact with a vehicle during lifting, when the manually operated hydraulic lift is activated. U.S. Pat. No. 3,618,894 fails to describe however a mechanism for lifting a vehicle that would be readily available for rescue operations that require quick lifts and portable components that could be easily transported on a fire truck or other vehicle.

Despite the various designs and types of jacks, lifts, or supports that are presently available, there still exist numerous drawbacks and problems that have not been addressed by the presently available options. Therefore, a portable and universal safety lever adapter device would be very useful to a wide spectrum of users, primarily anyone that aids those in emergency situations in various locations.

Following an accident, a vehicle may come to rest on its side, its roof, or against another object such as a tree. It may become necessary to not only stabilize the vehicle in its resting position to prevent further damage to the occupants in the vehicle or to the vehicle itself but also to create a work area that is safe for First Responders operating inside or around the vehicle or object while providing emergency rescue or providing support in an emergency setting. In the past it was easier to stabilize vehicles because the vehicles' surfaces were mostly flat and made of steel, only requiring a few wedges to stabilize the vehicle. Newer vehicles however have more rounded bodies and are made of thin layers of steel or have plastic panels, which can cause the vehicle to act unpredictably when the vehicle rolls over or is knocked off its wheels.

With instability in newer cars it becomes necessary to provide a stabilization system that is adjustable to accommodate for various positions, heights, angles and types of cars. It is also important for First Responders to utilize a Bi-pod rescue strut system that is portable so that it may be transported easily to any emergency scene and occupy less space while being transported in their vehicle. This would give First Responders ample space for other tools important to an emergency setting. The Bi-pod rescue strut system should also have multiple configurations and applications so that multiple tools are not needed, further maximizing space for the First Responder's vehicle. Having multiple applications also leads to decreasing the need for extensive training to learn how to operate multiple devices. The Bi-pod rescue strut system should also be able to be quickly assembled because any extra time used in constructing a stabilization system could be used to help the victims. Currently most popular methods of stabilizing a vehicle are to use wooden beams and rescue struts.

First Responders use wooden beams such as four by four beams where the First Responders wedge the wooden beams between the ground or other stable surface and a part of the vehicle that needs to be supported. This method can prove quite burdensome because the wooden beams usually are discarded after one use, thus requiring a new set of beams. The wooden beams also cannot be dissembled or collapsed, decreasing the portability aspect of the system. The wooden beams also occupy an excessive amount of space in a First Responder's vehicle, taking up space for other important tools that are crucial to an emergency setting.

Struts are also typically used by First Responders. Struts are columns that are tipped over with their top surface anchored against the vehicle. A strap or other device connected to the strut is used to pull the base of the strut towards the car, helping to apply a uniform force to the vehicle in a vertical and horizontal direction. Struts may also function as tripods for confined space applications whereby a tripod head receives the top surfaces of three struts and is then used over a confined space hole. A winch connected to the tripod is then used to raise or lower a person or equipment.

Some problems commonly found in struts such as these are that the systems are heavy, expensive, cumbersome and difficult to transport as well as to initially erect. Also a single strut provides only one column or support leg to support the vehicle, extending from the base of the strut to the upper extension tube member. The narrower the base sitting on the ground the easier it is to tip the strut over. Further it is harder for struts to be used as an anchorage connector for confined space and rescue applications in a tripod configuration due to obstructions or minimal space on either of the confined space entry point.

SUMMARY

Embodiments for a lever adapter device for use in lifting vehicles or other heavy objects are provided in the present description. In one embodiment, the lever adapter device includes one or more stabilizing feet, whereby each of the one or more stabilizing feet has a frame that defines an opening. The lever adapter device may further include one or more support legs. Each of the one or more stabilizing feet may be attached to the distal end of each support leg. The lever adapter device may further include one or more hinges disposed at the terminal end of each support leg, whereby each support leg is connected to the one or more hinges at the terminal end of each support leg. Further, each support leg may be extendable and retractable towards or away from the other one or more support legs. The lever adapter device may further include a jack attachment piece, whereby the jack attachment piece has a frame that defines a central opening.

The frame of the jack attachment piece, in one embodiment, may include a number of slots configured to receive position locking pins that extend through the frame and through the central opening of the jack attachment piece. When the jack attachment piece is in a deployed position, the jack attachment piece is configured to be removably connected to a jack or to other lifting devices in order to assist in lifting the vehicle or the other heavy objects. In some embodiments, the one or more support legs are curved and include an upwardly angling portion and a downwardly angling portion. In alternative configurations, the one or more support legs are straight and flat. The one or more support legs may be used to lift a vehicle when in an extended or a retracted position.

In another aspect, the lever adapter device is configured to be coupled to a jack, such as a HI-LIFT jack. The jack attachment piece may be coupled to a runner of the HI-LIFT jack, by using a position locking pin. Further, the lever adapter device may be coupled to a base plate and a strap, whereby the strap is connected to each one of the stabilizing feet. The strap may also be coupled to a frame of the base plate. Further, the base plate may be positioned beneath a bottom surface of a HI-LIFT jack, such that the one or more support legs are prevented from moving from a desired position when the strap is coupled to the base plate beneath the HI-LIFT jack.

In another aspect, a method of using a lever adapter device with a HI-LIFT jack when lifting a vehicle or a heavy object is provided in the present description. The method may include adjusting a position of a first support leg with respect to a second support leg disposed on the lever adapter device in a desired arrangement. The first support leg and the second support leg on the lever adapter device are elongated members. The lever adapter device may further include a first stabilizing foot connected to a distal end of the first support leg and a second stabilizing foot connected to a distal end of the second support leg. The lever adapter device may further include one or more hinges that connect to the first support leg and the second support leg, and further include a jack attachment piece that is also connected to the one or more hinges.

The first support leg and the second support leg on the lever adapter device are moveable towards and away from each other, because the first support leg and the second support leg are connectably joined together by the one or more hinges, in accordance with one or more embodiments. Next, the process may include securing the lever adapter device to the HI-LIFT jack. Further, the process may also include positioning the first support leg and the second support leg of the lever adapter device beneath the vehicle or the heavy object such that the first support leg and the second support leg are perpendicular to an underside of the vehicle or heavy object, and a bottom surface of the first support leg and a bottom surface of the second support leg makes contact with the ground.

Upon positioning the first support leg and the second support leg beneath the underside of the vehicle or the heavy object, the process may continue, in one or more embodiments, by engaging a handle of the HI-LIFT jack to raise the vehicle or the heavy object to a desired height while the HI-LIFT jack is also securely coupled to the lever adapter device. The HI-LIFT jack is also located proximate to the vehicle or the heavy object and to the first and second support leg of the lever adapter device as the handle of the HI-LIFT jack is engaged to raising the vehicle or other heavy object. Responsive to raising the vehicle or the heavy object to the desired height, a top surface of the first support leg and a top surface of the second support leg support the underside of the vehicle or the heavy object, whereby the top surfaces of the first support leg and the second support leg make physical contact with a portion of the underside of the vehicle. Upon reaching the desired height of the vehicle, the process may continue whereby lift supports may be placed under a lifted side of the vehicle or the heavy object. Subsequently, the vehicle or other heavy object may then be lowered onto the lift supports by engaging the handle of the HI-LIFT jack to lower the vehicle or the heavy object.

According to one embodiment, a rescue strut device for use in stabilizing a vehicle or other objects, including: one or more stabilizing feet, one or more support legs, wherein one of each of the stabilizing feet is attached to a first end of each support leg; a yoke disposed at the second end of each support leg, wherein each support leg is connected to the yoke at the second end of each support leg, such that each support leg is extendable and retractable towards or away from the other support legs, whereby each of the support legs has an engagement hole at an angle through a lateral end of each support leg, whereby when the support legs are rotated at an angle in relation to the yoke, the engagement holes in each of the support legs align with an engagement hole in the yoke, permitting a pin to be placed through the engagement holes in each of the support legs and through the engagement hole the yoke, securing the support legs at the in relation to the yoke, and a telescoping strut extension, wherein the telescoping strut extension has a lower member the lower member connected to the yoke, the lower member in slidable engagement with one or more upper extendable members.

According to one embodiment, a stand for confined space and remote rescues including a first and second rescue strut; the first and second rescue strut and stabilization device comprising; one or more stabilizing feet; one or more support legs, wherein one of each of the stabilizing feet is attached to a first end of each support leg; a yoke disposed at the second end of each support leg, wherein each support leg is connected to the yoke at the second end of each support leg, such that each support leg is extendable and retractable towards or away from the other support legs, and a telescoping strut extension, wherein the telescoping strut extension has a lower member the lower member connected to the yoke, the lower member in slidable engagement with one or more upper extendable members, the upper extendable members having a second end; and a body coupled for receiving the second end of the upper extendable members of the first and second rescue strut.

According to one embodiment, a method of using a Bi-pod rescue strut system for use in lifting a vehicle or other object, the method comprising: producing a Bi-pod rescue strut system, the Bi-pod rescue strut system comprising: one or more stabilizing feet; one or more support legs having a first end and second end, wherein one of each of the one or more stabilizing feet is attached to a first end of the support legs; a yoke disposed at the second end of each support leg, wherein each support leg is connected to the yoke at the second end of each support leg, such that each support leg is extendable and retractable towards or away from the other support legs; wherein each of the support legs has an engagement hole at an angle through the support legs, wherein when each of the support legs are rotated at an angle in relation to the yoke, the engagement holes in each of the support legs align with an engagement hole in the yoke, permitting a pin to be placed through the engagement holes in each of the support legs and through the hole in the yoke, securing each of the support legs in relation to the yoke; connecting a link the yoke, the link in a first position; connecting a lever to the link, the lever connected to and balancing on a fulcrum; positioning the support legs beneath the vehicle or other object; applying a force to an end of the lever, causing the support legs on the lifting device to make contact with an underside of the vehicle or other object and lift the vehicle or other object to a first height, wherein the vehicle or other object is stabilized by a step chock or apparatus.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

The present invention will be described by way of exemplary embodiments, but not limitations, illustrated in the accompanying drawings in which like references denote similar elements, and in which:

FIG. 6A illustrates a deployed lever adapter device at an initial point in lifting a vehicle.

FIG. 6B illustrates a deployed lever adapter device at a middle point in lifting a vehicle.

FIG. 6C illustrates a deployed lever adapter device at an end point in lifting a vehicle.

FIG. 7 illustrates an embodiment of a lever adapter device in the stowed position.

DETAILED DESCRIPTION

Figure 1A:
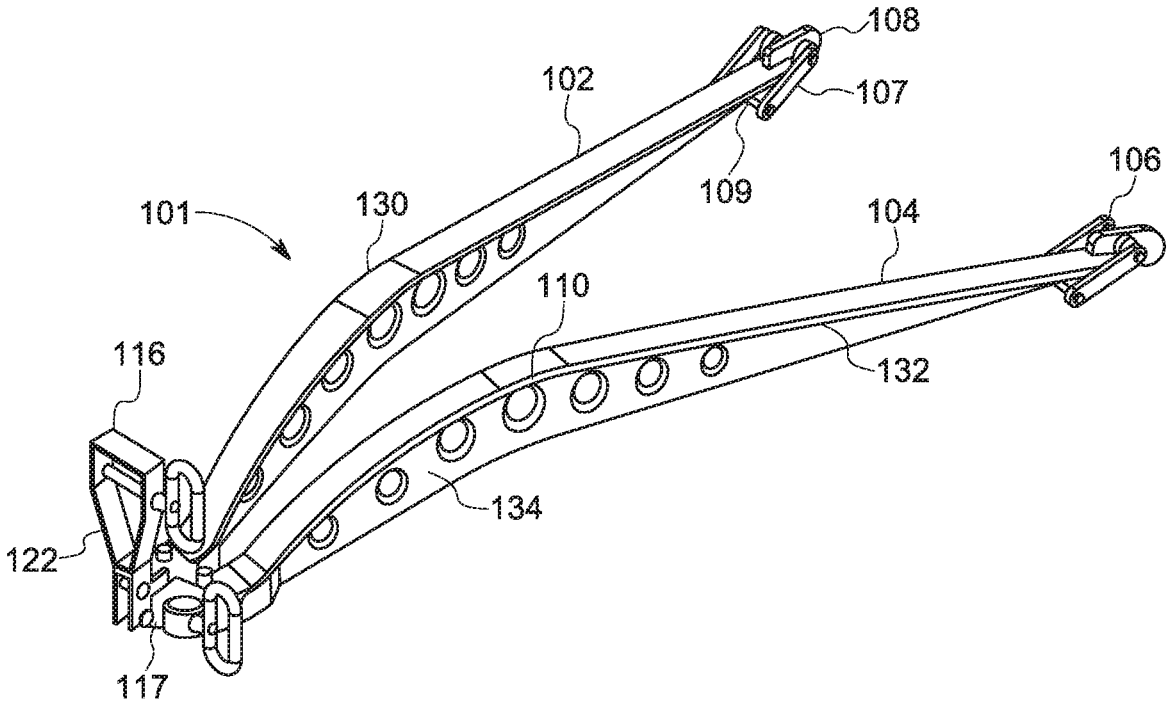
FIG. 1A illustrates a perspective view of an embodiment of a lever adapter device.

In the Summary above, in this Detailed Description, the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

References in the singular tense include the plural, and vice versa, unless otherwise noted. Further, as used herein, the term "coupled" or "coupling" may indicate a connection. The connection may be a direct or an indirection connection between one or more items. Further, the term "set" as used herein may denote one or more of any item, so a "set of items," may indicate the presence of only one item, or may indicate more items. Thus, the term "set" may be equivalent to "one or more" as used herein. Throughout the drawings, like reference characters are used to designate like elements. Further, the drawings are not to scale and depicted components or structures may have dimensions other than those depicted or perceived in the drawings.

"Exemplary" is used herein to mean "serving as an example, instance, or illustration." Any aspect described in this document as "exemplary" is not necessarily to be construed as preferred or advantageous over other aspects.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure recognizes the unsolved need for an apparatus and method that may be used to quickly and conveniently access the underside of a vehicle or other heavy object, particularly during emergency rescue operations. Each year, firefighters, first responders, and other individuals, risk their lives to rescue trapped individuals, such as bicyclists, motorists, or pedestrians that may be pinned beneath a vehicle, wall, fallen tree, pole, or other heavy objects. During such emergency rescue operations, time is critical and it is essential that the firefighters and other first responders be able to lift or raise a vehicle in a matter of minutes to save someone located inside or beneath the vehicle. Existing methods and techniques usually require anywhere from five to ten rescuer minutes to implement and to effectively raise a vehicle to a height that allows firefighters or other emergency rescue personnel to access the underside of the vehicle, however there are many documented instances where it has taken much longer to access the underside of the vehicle.

To extract a trapped person from beneath a vehicle or other object, a firefighter or other first responder has to know how to quickly access the underside of the vehicle. Many vehicles, including sedans and mini-vans may only have a clearance of 5-7 inches. Any jack or mechanism used to try and lift the automobile has to be able to fit within this space located beneath the vehicle. There are many problems associated with existing jacks in that even after jacking up a vehicle, the vehicle is not lifted sufficiently high enough to provide adequate room to reach under and extract a person pinned or trapped beneath vehicle or another object. Further, the jacks often fail or fall over, because these jacks are unable to support the weight of the vehicle on their own.

Alternatively, the vehicle may be not be able to be lifted using existing jacks on their own, because the shape of the vehicle does not provide enough structural metal enough for a jack to confidently lift the vehicle on its own. This may be due to the fact that many vehicles have too much bow in their sidewall structure or may have plastic in the rocker panel (the space where the sidewall fits the undercarriage), which does not provide enough structural metal for a jack to fit under. Another major drawback of utilizing existing jacks on their own, including HI-LIFT jacks, is that these jacks have a small footprint and the higher that the jacks are required to lift, the less stable they become.

Thus, the present description includes embodiments for a lever adapter device that provides a number of benefits and advantages not found in conventional methods for lifting a vehicle or other heavy object. The present description includes embodiments generally drawn to a portable universal lever adapter device that may be particularly useful to aid in the lifting of a vehicle quickly, safely, and with a variety of existing jacks. Using the lever adapter device, as described herein, may significantly reduce the load carried by a jack, and effectively distribute the weight of a lifted vehicle or other object between the jack and the support legs of the lever adapter device, thus minimizing the load on the jack alone. Further, the lever adapter device, in accordance with one or more embodiments in the present description, provides much more stability when lifting a vehicle with a jack in combination with the lever adapter device, because of the "tripod" lift effect, whereby the legs of the lever adapter device support the underside of the vehicle at one or more contact points, and the jack also supports the underside of the vehicle at another contact point, often times forming a more stable triangular base when lifting the vehicle.

In one or more embodiments, a lever adapter device as described herein may be conveniently and easily transported from one place to another due to its compact size and optional attachment parts. Further, embodiments of the lever adapter device, as described herein, are particularly suited to accommodate different brands and types of jacks and other rescue related equipment. Advantageously, one or more embodiments herein describe a lever adapter device that is particularly suited for accommodating a HI-LIFT jack.

The different illustrative embodiments provided in the present description include a lever adapter device that has curved elongated support legs that act as a strong structural support for the underside of a raised load or object. The support legs are adapted to either move jointly or independently of each other, and may be positioned in a variety of ways. For instance, the curved elongated support legs may be connected to one another via one or more hinges, such that the support legs may be moveable towards and away from each other so as to be spread apart. Further, the support legs may be brought close together so as to be in straight alignment with each other. Alternatively, or additionally, the curved elongated support legs may be configured so that each support leg moves independently of the other such that each support leg may be disposed at a desired angle.

In addition to the above, embodiments of a lever adapter device may include stabilizing feet located at an end of each support leg that help prevent slippage of the lever adapter device. Other detachable components that may be used with a lever adapter device as described herein include a strap and a base plate. A strap may be used to provide additional contact with a HI-LIFT jack or other type of tool and to stabilize the curved support legs to keep the support legs from possible unwanted movement. A base plate may be used to connect the strap to the lever adapter device and/or another tool.

The different illustrative embodiments herein recognize that there is a need for an apparatus, such as the lever adapter device, that may be portable and easily transportable in a vehicle, such as a fire truck or another emergency vehicle. It is known that fire trucks and other emergency vehicles have very limited available space. The real estate on a fire truck is already claimed by the numerous firefighters and rescue personal, pieces of equipment, hoses, and rescue tools that must be accounted for on a fire truck, so there usually is not a great deal of space left over for another large and bulky tool or device. Accordingly, a lever adapter device, as described herein, beneficially, has a relatively compact size that can be easily stored without taking a great deal of space on a fire truck or other location. Further, a lever adapter device, in accordance with one or more embodiments in the present description, is relatively light weight such that one person can carry and use the lever adapter device by himself or herself.

The different illustrative embodiments also recognize the need for a tool that may speed up the process of lifting a heavy object or vehicle. Further, the different illustrative embodiments recognize the need for a tool that may be combined with a variety of types of jacks and lifting devices. It has been discovered, based on actual use of embodiments of a lever adapter device as described herein, that when combined with a HI-LIFT jack, it is possible for a single person to raise a vehicle (e.g. 3,200-4,500 pound vehicles) in approximately one minute. Thus, the lever adapter device, in accordance with one or more embodiments, may provide a much faster alternative than conventional lifting mechanisms or alternative methods, including the air bag method that emergency rescue teams currently use and which was previously discussed above.

Further, it is noted that while the lever adapter device is particularly useful and beneficial for firefighters and other first responders during emergency rescue operations, the lever adapter device may be used by any individual in a variety of scenarios, and is not limited to use for emergency rescue operations. It is foreseeable that the lever adapter device may be used anytime to raise or lift any type of heavy object, including, but not limited to, vehicles, trees, poles, walls, equipment, furniture, etc. Additional details regarding one or more embodiments of a lever adapter device as discovered and described in the present description are provided below.

Figure 1B:
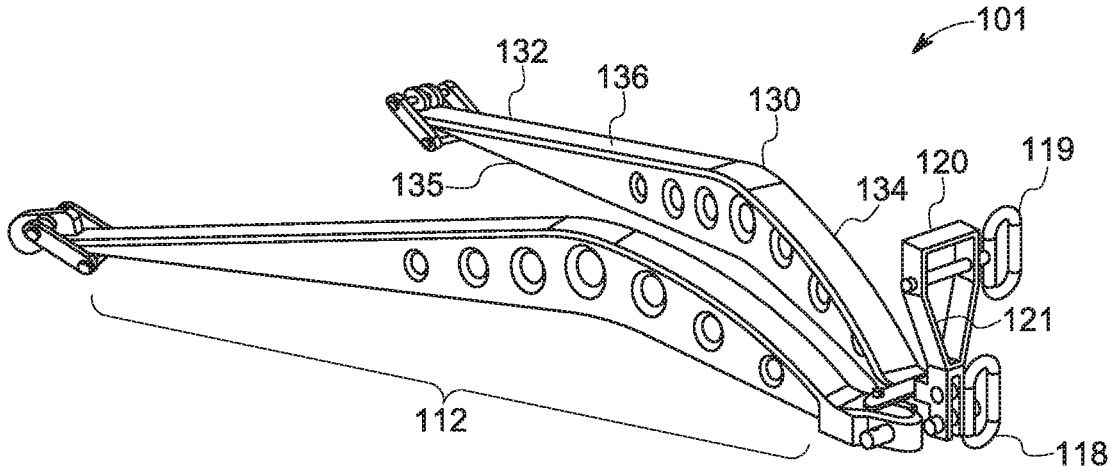
FIG. 1B illustrates perspective view from another side of the embodiment of the lever adapter device shown in FIG. 1A.

Referring to FIG. 1A, FIG. 1A provides a perspective view of an embodiment of a lever adapter device. FIG. 1B shows another side of the lever adapter device shown in FIG. 1A. Lever adapter device 101 may be used as a support tool (or in some cases the primary tool) to raise a vehicle or other heavy object to a desired height (e.g. as shown in FIGS. 6A-6C). The term "vehicle" as used herein may refer to any type of vehicle, including automobiles, trucks, buses, or any type of wheel-based vehicles, special track vehicles, or other driven vehicles. This further includes, without limitation, motorcycles and/or other two or three wheeled vehicles.

Lever adapter device 101, as shown in FIGS. 1A and 1B, may include, in one or more embodiments, support legs 102 and 104. Support leg 102 and support leg 104 may be curved or curvilinear, elongated members. Support legs 102 and 104 may be made of any suitable material known in the art, including, but not limited to, metal, plastics, or a combination thereof. Preferably, support legs 102 and 104 are made of a durable material able to withstand heavy loads, including the weight of a vehicle. Accordingly, in one or more embodiments, support legs 102 and 104 are made from a durable metal, such as steel, although alternative materials and/or elements may also be used. Further, it is noted that any suitable manufacturing process may be used for forming support legs 102 and 104.

Further, the individual components of lever adapter device 101 (including jack attachment piece 116, position locking pins 118 and 119, stabilizing feet 106 and 108, and support legs 102 and 104) may also be made of a durable metal, such as steel. Those of ordinary skill in the art know that alternative materials may be used or used in combination with a metal without limitation thereto. Despite being made of durable, sturdy materials, lever adapter device 101 may also be lightweight and not overly heavy, such that a single individual may easily carry and lift lever adapter device 101 from place to place. Embodiments of lever adapter device 101 may range anywhere from ten (10) to twenty-five (25) pounds in weight, without limitation to this range, as lever adapter device 101 may weigh more or less than the weights provided in this weigh range in alternative combinations and configurations. In some embodiments, lever adapter device 101 may be comprised of aluminum and/or steel, but in alternative embodiments, lever adapter device 101 may be made primarily from carbon fiber, which would make lever adapter device 101 a light weight tool and device. Notably, the lever adapter device 101 is not an extremely heavy object and is well-suited to be an easily transportable tool.

As shown in FIG. 1B, support legs 102 and 104 have a top surface, such as top surface 136 and a bottom surface, such as bottom surface 135. In one or more embodiments, bottom surface 135 may be straight and flat. Alternatively, or additionally, bottom surface 135 of each one of support legs 102 and 104 may also be angled or curved.

Support legs 102 and 104 may each have an upwardly tapering portion, such as upwardly tapering portion 132. Further, support legs 102 and 104 may each have a downwardly tapering portion, such as downwardly tapering portion 134. In one or more embodiments, a body of support leg 102 is designed to be substantially the same or identical as the body of support leg 104. Thus, both support legs 102 and 104 may have a curved shape as shown in FIGS. 1A and 1B (although in alternative embodiments, support legs 102 and 104 may be designed to be straight and flat as further described later in the present description).

Figure 3:
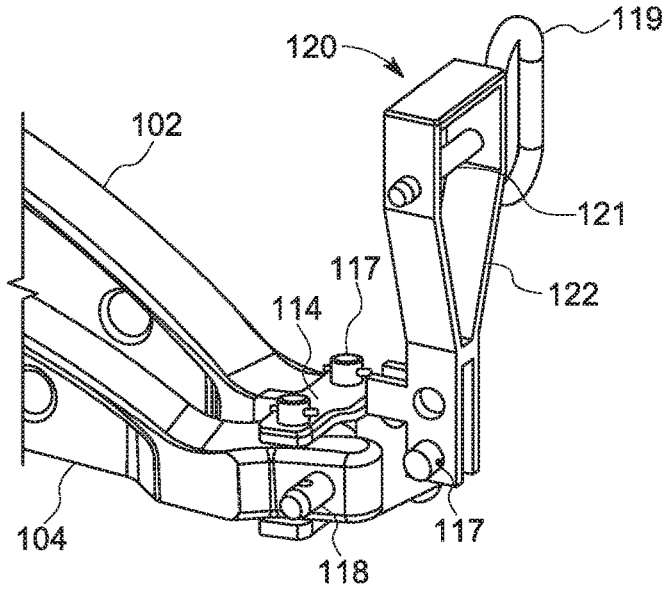
FIG. 3 illustrates an embodiment of a jack attachment piece and hinged support legs of a lever adapter device.

As shown in FIGS. 1A and 1B, support legs 102 and 104 may have the same general appearance. However, it is noted that support legs 102 and 104 may be any size or shape as desired. In one or more implementations, support legs 102 and 104 may taper upwardly to a flat support surface, such as a flat support surface 130. At a terminal end of the flat support surface 130, the downwardly tapering portions 134 of support legs 102 and 104 may begin. The flat support surface 130 may have a uniform height or may increase or decrease in other configurations. Notably, support legs 102 and 104 are designed to curve upwardly and then to curve downwardly. At an end of support legs 102 and 104, proximate to where hinge 114 as shown in FIG. 3 is coupled to each support leg 102 and 104, there may be one or more holes that extend through an end of support legs 102 and 104, such that a position locking pin, such as position locking pin 118, may be extended through the one or more holes, which is further elaborated on below.

As further described below, (and as shown in FIG. 5 and FIGS. 6A-6C), lever adapter device 101 may be particularly well-suited for lifting vehicles. It is therefore necessary that support legs 102 and 104 are configured to be fit underneath a vehicle, such as by being slid underneath a vehicle. In one or more embodiments, support legs 102 and 104 may slide underneath an underside of a vehicle and have adequate clearance to do so without being obstructed by a surface of the vehicle.

As used herein, the term "clearance" may be used to indicate a distance from the ground surface to a bottom surface of a vehicle or other object being lifted by lever adapter device 101. For many small to medium sized vehicles, there may be at least 5 inches to 7 inches worth of clearance or distance from a bottom surface of the vehicle to ground level. Accordingly, in one embodiment, support legs 102 and 104 may be designed so as to have a maximum height (ex. maximum height 110 shown in FIG. 1A) suitable to fit a clearance of most small to medium sized vehicles. In other embodiments, support legs 102 and 104 may be designed to have a height that can accommodate vehicles or other objects with higher clearances, such as clearances over 6 inches. Notably, a profile and maximum height 110 of lever adapter device 101 is well suited for being easily slide beneath most vehicles or other objects that need to be raised or lifted. In one exemplary embodiment, a maximum height of support legs 102 and 104 is less than 5 and ½ inches.

FIG. 1A shows length 112 of support leg 102. In one or more embodiments, length 112 may range from 2 feet to 6 inches long. Those of ordinary skill in the art will appreciate lever adapter device 101, including support legs 102 and 104 may be designed to be as long as desired, and no limitation is provided herein with respect to length or any other dimensions.

As shown in FIGS. 1A and 1B, lever adapter device 101 is implemented to be used in a concave down position, such that the bottom surfaces 135 of support legs 102 and 104 make physical contact with a ground level or ground surface.

Figure 8:
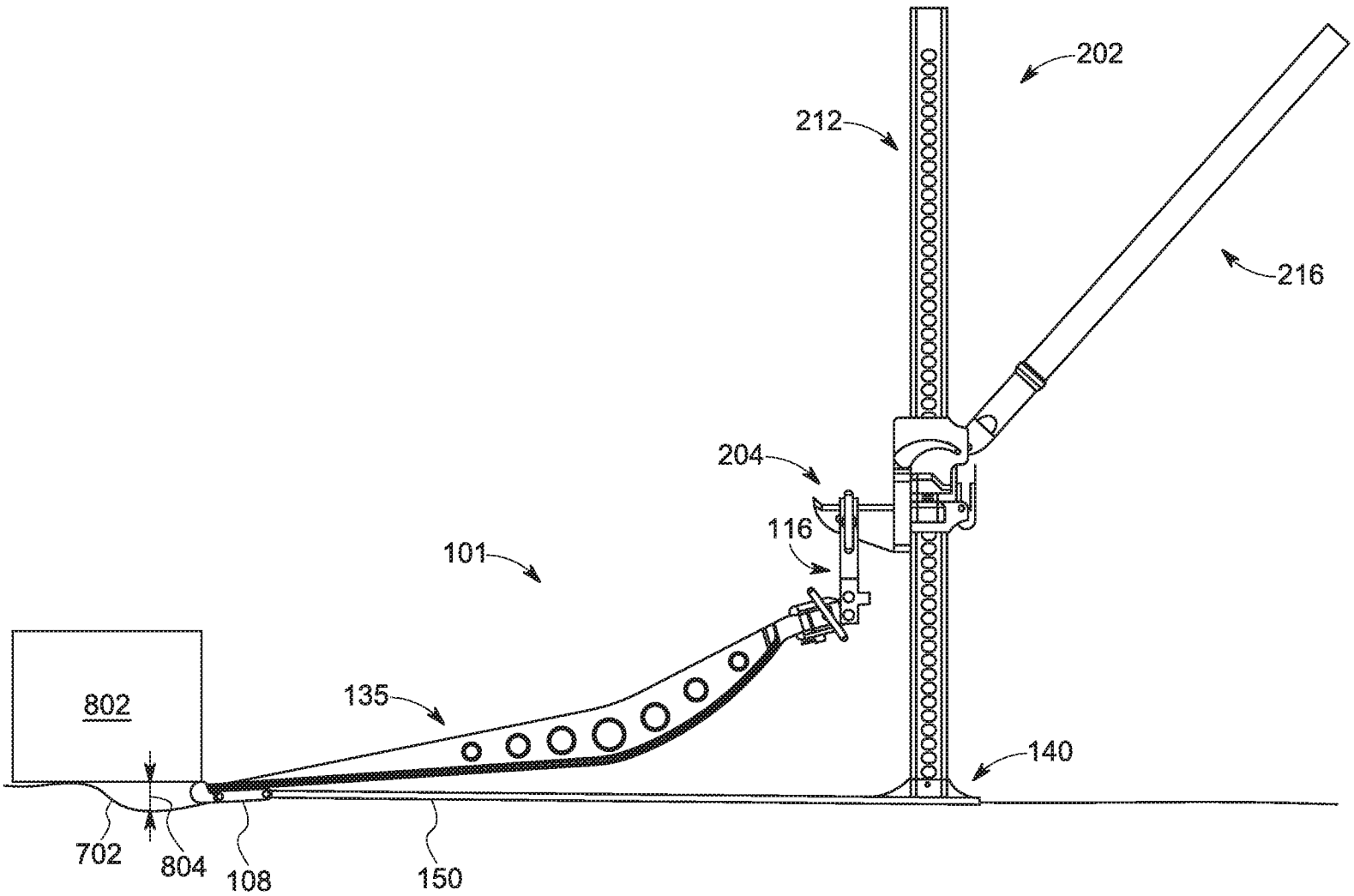
FIG. 8 illustrates an embodiment of a lever adapter device in an inverted position according to another method of using a lever adapter device.

Notwithstanding the above, FIG. 8 shows how lever adapter device 101 may also be used in an inverted position. Additional details for using lever adapter device 101 in an inverted position as shown in FIG. 8 are provided below.

In one or more embodiments, support legs 102 and 104 are essentially formed as a single solid beam structure. In some embodiments, support legs 102 and 104 may be integrally formed as a single whole piece. Alternatively, in other embodiments, support legs 102 and 104 may be formed as an assembly of separate structural pieces. In one or more embodiments, support legs 102 and 104 may be formed as a modified I-beam structure. In alternative embodiments, a body of support legs 102 and 104 may include double beams, triple beams, or any number of beams as needed. Accordingly, in one or more embodiments, support legs 102 and 104 may each include an upper beam coupled to a lower beam that makes up the body of each one of support legs 102 and 104. Having the upper beam coupled to the lower beam for each one of support legs 102 and 104, according to alternative embodiments (not shown in FIGS. 1A and 1B), may add strength and additional structural stability to lever adapter device 101.

Further, it is noted, that the holes shown in FIGS. 1A and 1B that extend through a thickness of support legs 1A and 1B may be omitted in alternative designs or vary in number and size and spacing. In one or more embodiments, the holes shown in FIGS. 1A and 1B disposed throughout a body of lever adapter device 101 may function to reduce the weight of lever adapter device 101 as well as to assist in maintaining the strength of the lever adapter device 101.

In one or more embodiments, lever adapter device 101 may further include stabilizing feet disposed at a distal end of each support leg. As shown in FIGS. 1A and 1B, stabilizing foot 108 is attached to an end of support leg 102 and stabilizing foot 106 is attached to an end of support leg 104. Stabilizing feet 108 and 106 assist by preventing slippage of support legs 102 and 104, respectively, and provide additional grip for the lever adapter device 101 of a ground surface. It is foreseeable that lever adapter device 101 may be used on a variety of terrains, including on terrains that may contribute to easy slippage of the lever adapter device 101 during actual use. Accordingly, lever adapter device 101 may accommodate a variety of ground surfaces and terrains, including, but not limited to, muddy surfaces, rocky surfaces, snow, sand, pavement and/or dirt roads.

Stabilizing feet 106 and 108 are shown as each having a rectangular shaped frame, such as frame 107, although alternative shapes and configurations may certainly be used. A frame 107 for each foot 106 and 108 may include small tubular bars 109 disposed on opposite ends of foot frame 107. Notably, stabilizing feet 106 and 108 are securely fastened to a distal end of support legs 104 and 102, respectively. Stabilizing feet 106 and 108 may be coupled to a distal end of support legs 102 and 104 using any affixation methods known in the art, including using any type of fasteners, adhesives or via welding or soldering, without limitation to these methods.

Stabilizing feet 106 and 108 provide additional other advantages in addition to providing grip to a ground surface and stabilization. For example, a strap, such as strap 150 shown in FIG. 1C, may be used in one or more applications to further stabilize lever adapter device 101 and may be attachable to each foot 106 and 108, as further described below with respect to FIG. 1C.

Lever adapter device 101 may further include a jack attachment piece, such as jack attachment piece 116, one or more hinges, such as hinge 114, which is shown in FIG. 3, and position locking pins, such as position locking pins 118 and 119. FIG. 3 shows a close-up view of jack attachment piece 116, hinge 114, and position locking pins 118 and 119 for lever adapter device 101. As shown in FIG. 3, hinge 114 may be coupled to a proximate end of each support leg 102 and 104 using one or more fasteners, such as fasteners 117. Fasteners 117 may be any type of fasteners known in the art, including, but not limited to, any type of screw and/or nut and bolt combination. While a single hinge 114 is shown in FIGS. 1A and 1B, those skilled in the art may appreciate that additional hinges may also be used in alternative embodiments. Further, it is noted that any suitable hinge may be used to couple support legs 102 and 104. In one embodiment, hinge 114 may be a simple post type hinge for each axis pivot (i.e. a pivot point for each support leg 102 and 104 to hinge 114). In other embodiments, lever adapter device 101 may include a complex multiple axis complex hinge. As shown in FIGS. 1A and 1B, hinge 114 may provide the ability for support legs 102 and 104 to be spread towards or away from each other over a single axis, but in alternative configurations, support legs 102 and 104 may be moveable over multiple axes, and thus configured to pivot using a hinge, such as hinge 114, that functions to pivot support legs 102 and 104 over multiple axes.

Figure 4:
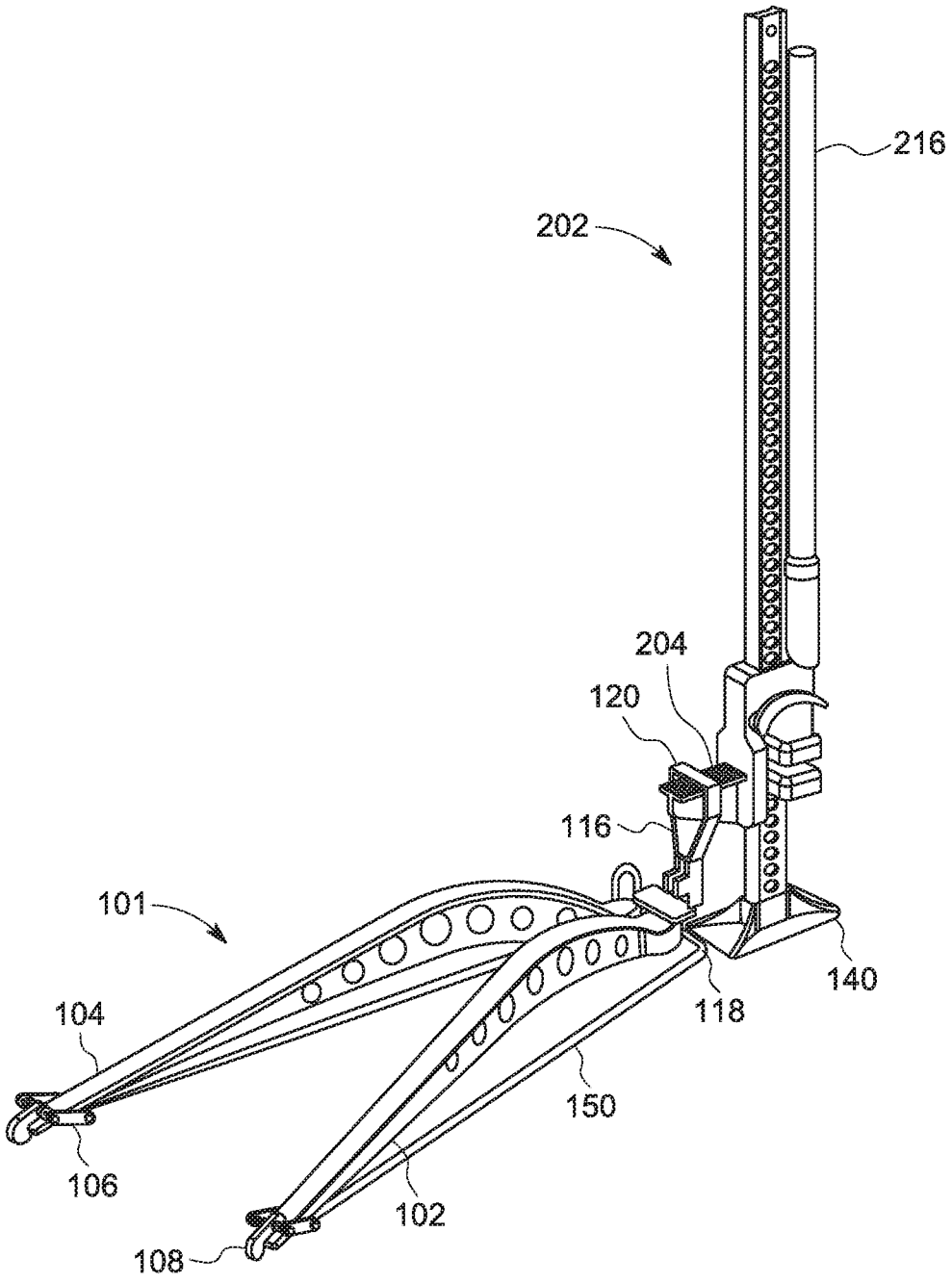
FIG. 4 illustrates an embodiment of a lever adapter device connected to a HI-LIFT jack.

With respect to jack attachment piece 116, jack attachment piece 116 is a part of lever adapter device 101 that has a number of functions. In one example, jack attachment piece 116 is used for connecting lever adapter device 101 to HI-LIFT jack 202 (as shown in FIG. 4). Jack attachment piece 116 may have a frame, such as jack attachment piece frame 122, as shown in FIG. 3. Further, jack attachment piece 116 may include an opening or aperture, such as opening 121 that is defined by its frame 122, which includes top bar 120. Top bar 120 may also function as a handle that the operator of lever adapter device 101 may grasp to carry lever adapter device 101 and also to couple lever adapter device 101 to a jack or other device (e.g. HI-LIFT jack 202 shown in FIG. 2). Even though jack attachment piece 116 is shown in FIGS. 1A, 1B, and 3 as being triangular shaped, any suitable shape may be used. For example, in alternative embodiments, jack attachment piece 116 may be rectangularly shaped.

It is a feature of jack attachment piece 116 that it may be rotatable from a horizontal to an upright vertical position. Further, jack attachment piece 116 may be rotatable to any angle other than an upright vertical position. FIGS. 1A and 1B show jack attachment piece 116 as being positioned in an upright vertical position. FIG. 7 shows jack attachment piece 116 as being positioned in a horizontal flat position. Thus, jack attachment piece 116 is rotatable in orientation as determined by its operator and dependent on its use.

In one or more embodiments, jack attachment piece 116 may be rotated to an upright vertical position when a user of lever adapter device 101 is coupling jack attachment piece 116 to a HI-LIFT jack, such as HI-LIFT jack 202. Jack attachment piece 116 may also be rotated to an upright vertical position of a user wants to couple the jack attachment piece 116 to another type of jack or equipment. Conversely, when a user wants to stow away lever adapter device 101, jack attachment piece 116 may be rotatable to a horizontal flat position, as shown in FIG. 7, for easy storage.

Jack attachment piece 116 may include a number of position locking pins, such as position locking pins 118 and 119. It is noted that a greater or lesser number of position locking pins other than those illustrated in the Figures may be used as needed. Position locking pins 118 and 119 may each have a number of uses. In one embodiment, position locking pin 118 is insertable through a slot (not shown) that extends through a lower portion of jack attachment piece frame 122 and through each support leg 102 and 104. A user may selectively remove and insert position locking pin 118, as desired. By inserting position locking pin 118, in one embodiment, jack attachment piece 116 may be locked in an upright position, and each support leg 102 and 104 may also be locked in place. Position locking pins 118 and 119 are removable and may be selectively inserted or removed from their designated slots.

To lock jack attachment piece 116 in place, as well as each support leg 102 and 104, in one non-limiting embodiment, a user may remove position locking pin 118 from its designated slot. Next, a user may spread support legs 102 and 104 to the desired position, thus extending each leg 102 and 104 apart or retracting support legs 102 and 104 closer together as desired. Subsequently, a user may grasp top bar 120 (i.e. the handle) of frame 122 of jack attachment piece 116 and rotate jack attachment piece 116 from a horizontal, flat position to a vertical, upright position. Next, a user may re-insert position locking pin 118 through its designated slots or openings in jack attachment piece 116 and support legs 102 and 104. Upon insertion of position locking pin 118 through the designated slot in jack attachment piece 116 as well as support legs 102 and 104, these elements may be locked in place. With respect to position locking pin 119, position locking pin 119, as further described below, may be useable when coupling frame 122 of jack attachment piece 116 to a HI-LIFT jack, such as HI-LIFT jack 202 shown in FIG. 2, or another type of jack or device.

As noted above, support legs 102 and 104 may be moveable, and may be moved within a particular range of movement so as to be spread apart from one another (e.g. as shown in FIGS. 1A and 1B). The distance between support legs 102 and 104 may be determined by an operator of lever adapter device 102. Because support legs 102 and 104 are connectively joined (e.g. via hinge 114), support legs 102 and 104 are able to move to an open or closed position.

It is noted that support legs 102 and 104 may be opened as wide as desired by an operator of lever adapter device 101. Alternatively, support legs 102 and 104 may be closed so as to be brought in alignment with each other (e.g. as shown in FIG. 7). Alternatively, or additionally, each support leg 102 and 104 may be independently moveable with respect to the other. In one embodiment, a position locking pin, such as position locking pins 118 and 119, may be used to pin a particular support leg in place once that support leg was positioned at a desired angle. Thus, it is possible to arrange each support leg separately from the other and at an angle that is different from the other, even while both support legs are connectively joined using one or more hinges (e.g. hinge 114).

Figure 9:
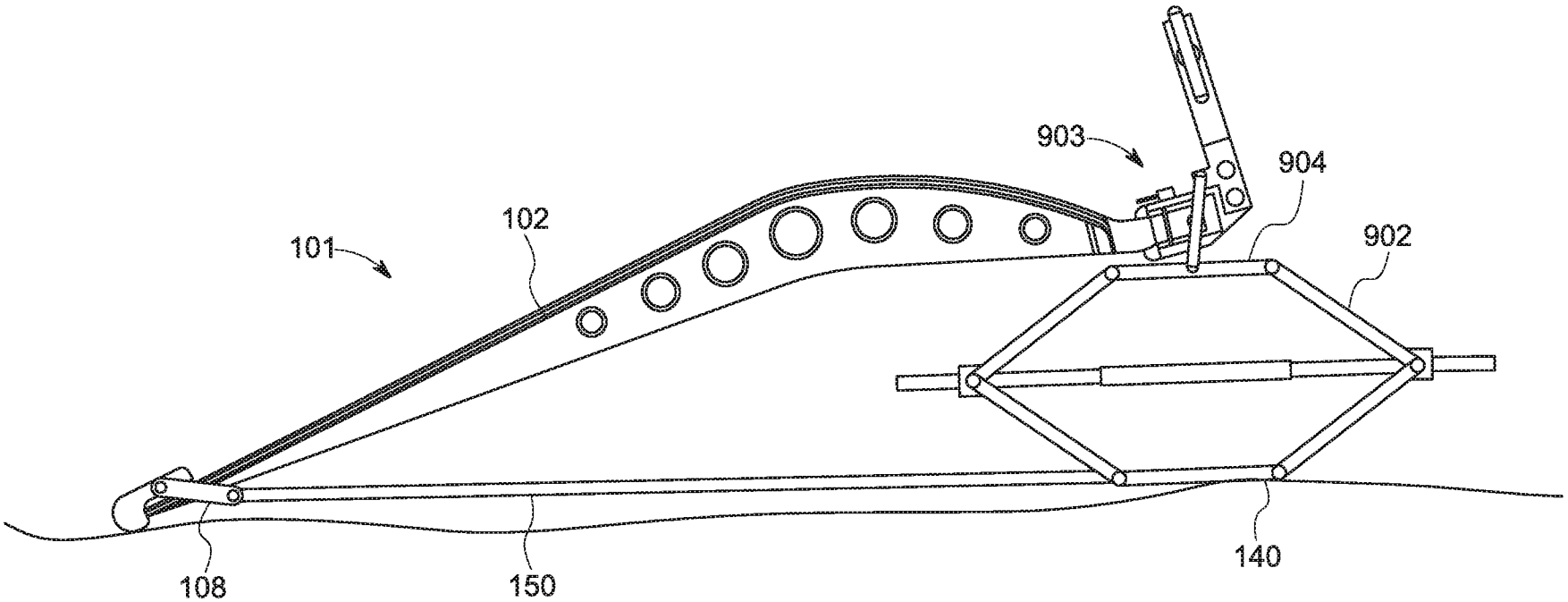
FIG. 9 illustrates an embodiment of a lever adapter device connected to a scissor jack lift.

It is noted that jack detachment piece 116 may be detachably coupled to support legs 102 and 104 via hinge 114. To remove or detach jack attachment piece 116, an operator may unfasten one or more fasteners 117 (e.g. by unscrewing or removing the nuts and/or bolts holding jack attachment piece 116 in place). In this way, it may be advantageously easy and convenient for an operator to detach jack attachment piece 116 as needed. There may be different reasons why an operator may choose to detach jack attachment piece 116. For example, FIG. 9 shows a lever adapter device 101 attached to a scissor jack lift, such as scissor jack lift 902. In one or more embodiments, the jack attachment piece 116 is removed before connecting the remainder of the lever adapter device 101 to a scissor jack lift, such as scissor jack lift 902, although there may also be embodiments where jack attachment piece 116 remains in place when lever adapter device 101 is coupled to a scissor jack lift, such as scissor jack lift 902.

Figure 1C:
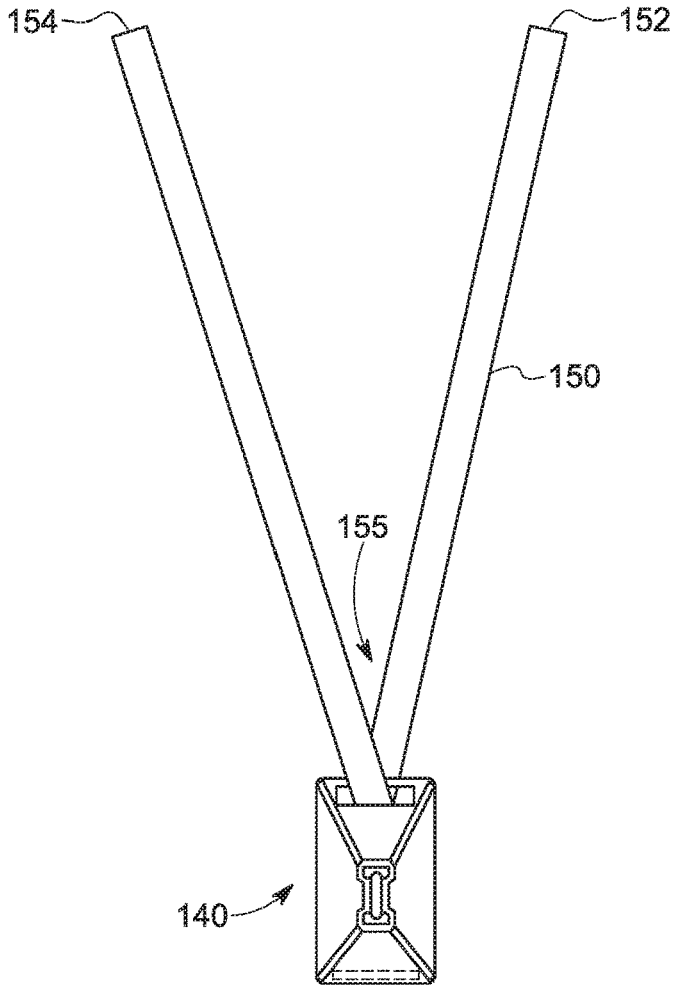
FIG. 1C illustrates a strap and base plate that may be used with an embodiment of a lever adapter device.
Figure 1D:
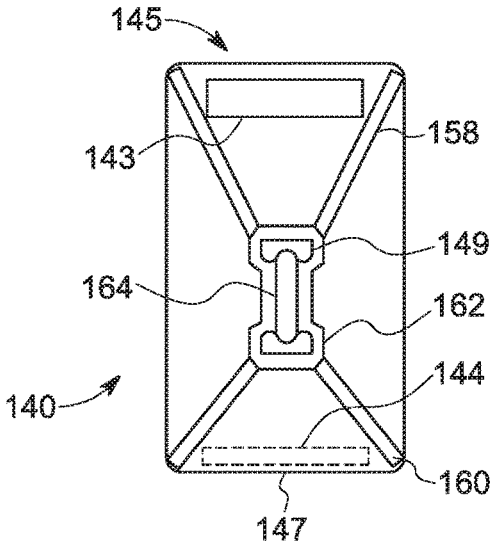
FIG. 1D illustrates the base plate shown in FIG. 1C.

Turning to FIG. 1C, FIG. 1C illustrates additional components or accessories that may be beneficial in providing additional stability when used in conjunction with lever adapter device 101. FIG. 1C illustrates strap 150 and base plate 140, which are each their own separate pieces. FIG. 1D also illustrates base plate 140 as shown in FIG. 1C.

Figure 2:
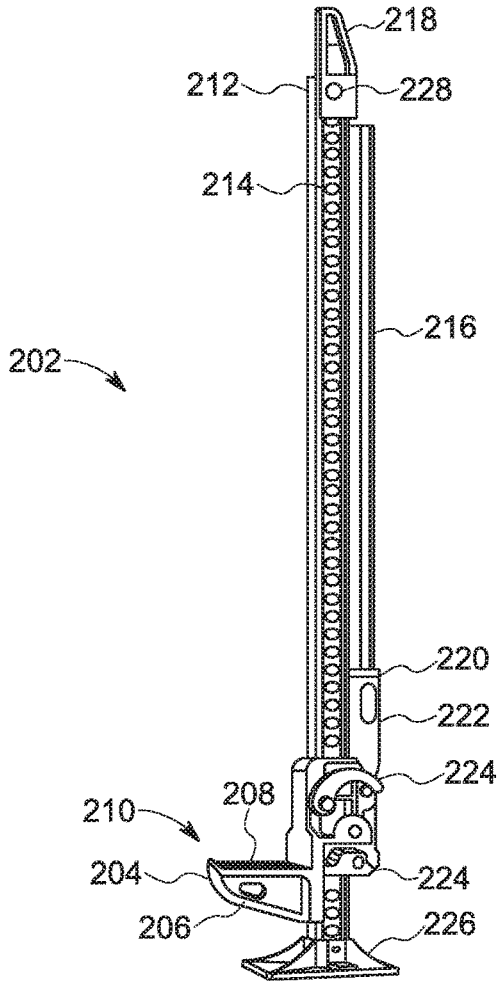
FIG. 2 illustrates a side view of a HI-LIFT jack known in the art.

In one embodiment, base plate 140 is a structural base plate having a frame, such as base plate frame 162. Base plate 140 (as shown in FIGS. 1C and 1D) has a rectangular shaped design, but may be designed to have any shape known in the art in alternative embodiments. Base plate 140 may include a first opening 143 and a second opening 144 defined by the base plate frame 162. Further, base plate 140 may include a center portion 149, which in turn includes its own smaller central opening, shown as opening 164. Central opening 164 may be sized to fit a beam or bar, such as the bar 212 of a HI-LIFT jack (as shown in FIG. 2). Base plate 140 may further include a top bar 145 and a bottom bar 147 located on opposite sides of the base plate frame 162. However, it is noted that base plate 140 may be oriented during use with either its top bar 145 or its bottom bar 147 facing lever adapter device 101.

As shown in FIG. 1C, strap 150 may be any type of strap known in the art. Strap 150 may essentially be an elongated ribbon that is made of durable material. Strap 150 includes a first end 152 and a second end 154. Strap 150 may be made of any suitable material and/or fabric, including, but not limited to nylon. In alternative configurations strap 150 may comprise a strong rope, chain, or other type of tying member may be used.

Strap 150 may be used to provide additional stabilization for support legs 102 and 104 of lever adapter device 101, and help prevent support legs 102 and 104 from moving during use. To use strap 150, in one or more embodiments, strap 150 may be coupled to both stabilizing feet (e.g. feet 106 and 108) of support legs 102 and 104 at one end, and then looped (e.g. as shown at 155 in FIG. 1C) over a frame of a base plate, such as base plate 140. Thus, a first end 152 of strap 150 may be coupled to a frame of a foot of lever adapter device 101 (e.g. foot frame 107) by tying end 152 of strap 150 around or over foot frame 107 of foot 106. Once the first end 152 of strap 150 is tied or otherwise securely coupled to foot 106 of support leg 104, strap 150 may be stretched towards a base plate, such as base plate 140, and looped over a top bar, such as top bar 145. Thus, strap 150 is coupled to base plate 140 by looping substantially a middle portion of strap 150 over a portion of base plate 140. Afterwards, the second end 154 of strap 150 may be tied or otherwise coupled to foot 108 of support leg 102. Strap 150 may be of a length suitable to reach the ends of both feet of lever adapter device 101 and also to wrap around a bar, such as bar 145 of base plate 140. In one or more embodiments, strap 150 may be at least six (6) feet in length or greater, but is not limited thereto.

Strap 150 may thus be looped over top bar 145 (or alternatively bottom bar 147) of base plate 140 and pass through the first opening 143 (or second opening 144). When attached, strap 150 takes on a general "V" shape. Specifically, upon coupling strap 150 to stabilizing feet 108 and 106 and to base plate 140 (in accordance with the steps described above), strap 150 will take on the appearance of a "V" or triangle shape (as shown in FIG. 4). Having strap 150 coupled to both feet 108 and 106, as well as base plate 140 assists in keeping support legs 102 and 104 in the particular positions as desired by the operator of lever adapter device 101. Further, providing strap 150 coupled to base plate 140 and to stabilizing feet 106 and 108 prevents support legs 102 and 104 from "kicking" out from under the vehicle, for example, when coupled to a HI-LIFT jack, such as HI-LIFT jack 202 shown in FIG. 2.

Turning to FIG. 2, FIG. 2 shows a well-known embodiment of a HI-LIFT jack. The HI-LIFT company owns a trademark (trademark registration number 804,605, serial no. 72192151) for a series of jacks known in the industry as HI-LIFT jacks. Accordingly, a HI-LIFT jack is a special type of jack that is known for its ruggedness and versatility of use. Furthermore, HI-LIFT jacks may be particularly useful for firefighters and other first responders in emergency rescue operations, because HI-LIFT jacks are particularly useful in emergency rescue situations that call for extrication, vehicle recovery, forcible entry, stabilization, and shoring.

As shown in FIG. 2, HI-LIFT jack 202 may include a bar, shown as bar 212 having a number of holes 214 disposed along the length of bar 212. HI-LIFT jack 202 may further include a handle, such as handle 216, which may be engaged by a user of HI-LIFT jack 202 to selectively raise or lower a large runner, such as runner 204 also located on HI-LIFT jack 202.

HI-LIFT jack 202 may further include base plate 226, which may be provided by the manufacturer of HI-LIFT 202. It is noted, that HI-LIFT jacks, such as HI-LIFT jack 202, are often utilized without the manufacturer base plate 226. Accordingly, the present description includes embodiments whereby an operator of lever adapter device 101 may couple base plate 140 (as shown in FIG. 1C) to a bottom of bar 212 to provide further stabilization and to provide a base plate that prevents a HI-LIFT jack from falling over. Accordingly, central opening 164 of center portion 149 of base plate 140 (as shown in FIG. 1C) may be configured to accommodate standard sized bars of HI-LIFT jacks, such as bar 212 of HI-LIFT jack 202.

As shown in FIG. 2, HI-LIFT jack 202 may further include a handle clip 220 for clipping handle 216 against bar 212 of HI-LIFT jack 202. An operator may engage handle 216 of HI-LIFT jack 202 by grasping and pulling back on handle 216 directly or grasping handle socket 222. HI-LIFT jack 202 further includes running gear 224 which is an assembly of components included on a lower half of HI-LIFT jack 202 that enable the runner 204 to be raised or lowered as needed.

Runner 204, as shown in FIG. 2, is in its lowest possible position. In such a low position, runner 204 may be placed beneath a particular surface of a vehicle or other object in order to lift the vehicle or other object. Runner 204 has a top surface 208 and a protruding end 210 disposed at an edge of top surface 208. Typically, when a HI-LIFT jack, such as HI-LIFT jack 202, is used to raise a vehicle off of the ground, an operator will position HI-LIFT jack 202 so that runner 204 is located beneath a stable portion of the underside of a vehicle (e.g. a side panel or beneath the rocker panel of a vehicle). Thus, the top surface 208 of runner 204 makes contact with a solid portion of the underside of the vehicle. By grasping the handle 216 of HI-LIFT jack 202 and engaging the handle 216 to raise runner 204, a vehicle may eventually be raised off of the ground. Runner 204 also includes a slot 206 that extends through a thickness of the body of runner 204. As further described below, slot 206 is used during one or more steps for coupling lever adapter device 101 to HI-LIFT jack 202.

While HI-LIFT jacks, such as HI-LIFT jack 202 are known for their versatility and ruggedness, especially in emergency rescue operations, there have been numerous occasions under critical conditions where HI-LIFT jacks, such as jack 202, have fallen over and dropped a vehicle or other heavy object while being lifted. Further, when emergency rescue operators are attempting to lift vehicle using HI-LIFT jacks such as HI-LIFT jack 202, the emergency rescue operators are only able to raise the vehicle about 13-15 inches. Advantageously, when lever adapter device 101 is coupled to a HI-LIFT jack, such as HI-LIFT jack 202, it may be possible to raise a vehicle to approximately 24 inches. This additional height makes a significant difference for firefighters and first responders seeking additional room in a cramped area beneath a vehicle (whether overturned or not) to rescue anyone who may be trapped.

Referring to FIG. 4, FIG. 4 shows an illustration of an embodiment of lever adapter device 101 coupled to a HI-LIFT jack, such as HI-LIFT jack 202. To couple lever adapter device 101 to HI-LIFT jack 202, an operator may bring lever adapter device 101 close to HI-LIFT jack 202. Next, an operator may move each support leg 102 and 104 to a desired position. For example, in one embodiment, an operator may spread support legs 102 and 104 apart, and then insert position locking pin 118 in place so as to keep the support legs 102 and 104 spread apart. The operator may selectively insert position locking pin 118 in a designated slot that may run through frame 122 of jack attachment piece 116 and also through an end of each support leg 102 and 104. By selectively inserting position locking pin 118 in its designated slot, an operator may lock support legs 102 and 104 in place in a particular position. Alternatively, or additionally, while not shown in the present description, additional position locking pins may be used that fit into additional slots located on each support leg 102 and 104. Therefore, a pin may be used to pin each support leg 102 and 104 in place, separate from the other. Using such a technique may allow for the support legs 102 and 104 to be spread at variable angles so as to best suit the needs of the operator.

Upon positioning the support legs 102 and 104 as desired, the operator may rotate the jack attachment piece 116 to an upright vertical position (as shown in FIGS. 1A and 1B). Position locking pin 119, as shown in the upper portion of the frame 122 of jack attachment piece 116 may be used to couple jack attachment piece 116 to the runner 204 of HI-LIFT jack 202. Specifically, in one or more embodiments, position locking pin 119 may be inserted through slot 206 of runner 204 and also through a designated slot that extends through the upper portion of frame 122 of jack attachment piece 116 (as shown in FIG. 4). Once position locking pin 119 is in place, the jack attachment piece 116 of lever adapter device 101 is securely attached to HI-LIFT jack 202. Further, lever adapter device 101 may be moved whenever HI-LIFT jack 202 is carried or moved to a site.

In this manner, an operator may simply and easily maneuver lever adapter device 101 and HI-LIFT jack 202 while they are coupled together. The operator can easily lift HI-LIFT jack 202 by holding onto a top surface 218 of HI-LIFT jack 202 (or any other portion of HI-LIFT jack 202), and in doing so, carry both HI-LIFT jack 202 and lever adapter device 101 towards a vehicle or other object that needs to be raised. In some embodiments, top surface 218 of HI-LIFT jack 202 may be detachably coupled to bar 214, because top surface 218 is fastened to bar 214 using one or more fasteners, such as fastener 228. As previously described, lever adapter device 101 does not add a significant amount of weight, such that a single operator is able to easily carry and lift lever adapter device 101. Further, most HI-LIFT jacks, such as HI-LIFT jack 202, weigh under three to five pounds, and are thus not overly heavy to carry. The combination of a HI-LIFT jack 202 when coupled to lever adapter device 101 may be easily carried and lifted by one individual (although other people may assist as required).

FIG. 4 further illustrates base plate 140 and strap 150 in use with both lever adapter device 101 and HI-LIFT jack 202. As shown in FIG. 4, strap 150 has been looped over a bar (e.g. bar 145 or 147) of a frame 162 of base plate 140 and then each end (e.g. ends 152 and 154) of strap 150 is securely tied or otherwise coupled to a frame of stabilizing feet 106 and 108. Further, base plate 140 may be securely coupled to a bottom surface of steel bar 212 of HI-LIFT jack 202. It is an objective of this embodiment that base plate 140 provides a stable base plate for HI-LIFT jack 202 to rest upon. FIG. 4 further illustrates the "V" shape or triangular shape that occurs when strap 150 is coupled to stabilizing feet 106 and 108 at each end of strap 150, and also to base plate 140. In view of the above, there are a number of beneficial features included with lever adapter device 101. For example, lever adapter device 101 provides a larger footprint for HI-LIFT jack 202, and also provides a significant amount of stability when using a jack, such as HI-LIFT jack 202 to lift a vehicle or other object.

Figure 5:
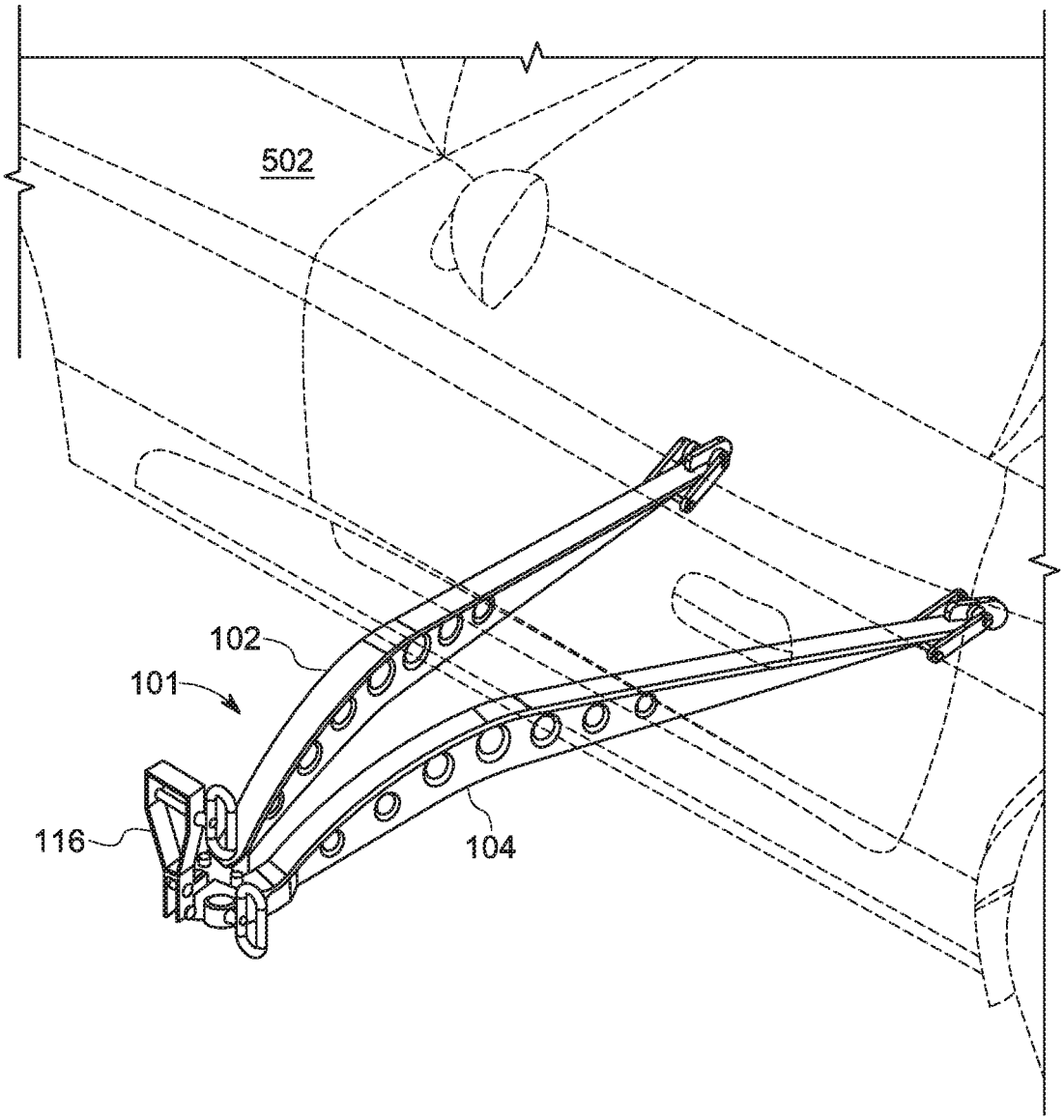
FIG. 5 illustrates an example of a deployed position of a lever adapter device under a vehicle.

Turning to FIG. 5, FIG. 5 shows an illustration of lever adapter device 101 in a position ready for use and for coupling with HI-LIFT jack 202 as located beneath vehicle 502. Vehicle 502 is shown in FIG. 5 as an exemplary vehicle. As previously discussed, vehicle may have a clearance of at least five to seven inches, without limitation thereto. Accordingly, lever adapter device 101 may have a profile and maximum height (e.g. maximum height 110) that does not exceed the specific clearance of vehicle 502. While not shown in FIG. 5, a user may choose to first securely couple HI-LIFT jack 202 to lever adapter device 101 and then slide support legs 102 and 104 beneath vehicle 502.

Support legs 102 and 104, as shown in FIG. 5, may have been spread apart and locked in place in their deployed positions at the selected angle desired by the user prior to lever adapter device 101 beneath vehicle 502. Stabilizing feet 106 and 108 are also positioned so as to provide further grip on a ground surface on which vehicle 502 is located upon. FIG. 5 further illustrates that jack attachment piece 116 is raised in an upright, vertical position and is visible to an operator of lever adapter device 101. When positioned for use, jack attachment piece 116 and a portion of support legs 102 and 104 is not located beneath vehicle 502. Accordingly, in one or more embodiments, about five to seven inches, without limitation thereto, of support legs 102 and 104 may be showing between the jack attachment piece 116 and a rocker panel or side panel of vehicle 502.

Referring to FIGS. 6A-6C, FIGS. 6A-6C illustrate one or more stages of deployment of lever adapter device 101 when coupled to HI-LIFT jack 202. FIG. 6A illustrates a deployed lever adapter device at an initial point in lifting a vehicle, such as vehicle 502. FIG. 6B illustrates a deployed lever adapter device at a middle point in lifting a vehicle. FIG. 6C illustrates a deployed lever adapter device at an end point in lifting a vehicle.

In FIG. 6A, an operator may initially position lever adapter device 101 beneath vehicle 502. Clearance 602 as depicted in FIG. 6A highlights how much space may be available beneath vehicle 502. A firefighter or other first responder thus has an understandable need to raise vehicle 502 in order to rescue a trapped individual located beneath vehicle 502. As noted above, there may be other scenarios or circumstances whereby lever adapter device 101 may be used other than in emergency rescue operations. However, it is of particular importance and a special characteristic of lever adapter device 101 that it may be particularly beneficial for firefighters and other first responders.

In FIG. 6A, vehicle 502 is at its lowest level (i.e. not in a lifted state) and flush with a ground surface. FIG. 6A shows that the bottom surfaces of support legs 102 and 104 (e.g. bottom surface 125) may be level with the ground. A top surface of support legs 102 and 104 (e.g. top surface 136) may be mostly clear of and not making physical contact with an underside portion of vehicle 502. However, it is also possible and probable that a highest level of a top surface of support legs 102 and 104 (e.g. flat support plane 130) may be operable engaged and in physical contact with a surface on the underside of vehicle 502.

As shown in FIG. 6A, HI-LIFT jack 202 has already been coupled to jack attachment piece 116 of lever adapter device 101 (e.g. in accordance with one or more steps as previously described using position locking pin 119 inserted through slot 206 of runner 204). FIG. 6A shows that handle 216 is still pressed against bar 212 of HI-LIFT jack 202 and has not yet been engaged to raise vehicle 502.

When positioning HI-LIFT jack 202 against an underside of vehicle 502, an operator may carefully select a portion of vehicle 502 where runner 205 may be braced under. Thus, a top surface 208 of runner 204 of HI-LIFT jack 202 makes physical contact with a portion of vehicle 502 prior to beginning the lifting process. Depending on the specific scenario, lever adapter device 101 and HI-LIFT jack 202 may be located at a variety of angles or positions with respect to vehicle 502. An operator may selectively determine the location placement of lever adapter device 101. It may be preferred, in one or more embodiments, that lever adapter device 101 may be optimally positioned perpendicular to a balance point of a vehicle's long axis, such as somewhere beneath a vehicle's front seats. However, it is noted that lever adapter device 101 may be positioned (either parallel to, perpendicular, or in another manner) anywhere under vehicle 502 as needed per the situation, including, but not limited to, beneath the underside of the hood, trunk, doors or side panels of a vehicle.

FIG. 6B shows that handle 216 has been grasped and pulled back to prepare for engaging the HI-LIFT jack 202 to raise vehicle 502. An operator may thus engage handle 216 of HI-LIFT jack 202 to raise vehicle 502 in accordance with the methods known to those skilled in the art for operating a HI-LIFT jack 202. It is a benefit of lever adapter device 101 that lever adapter device 101 may be used with HI-LIFT jack 202 without altering the existing techniques for using HI-LIFT jack 202, which many firefighters, first responders, or other individuals may be highly trained and already familiar with using.

FIG. 6B shows that operator is in the middle of a process of raising vehicle 502. Accordingly, in FIG. 6B, the bottom surfaces of support legs 102 and 104 (e.g. bottom surface 135) are not level with the grounds surface as was the case in FIG. 6A. Instead, support legs 102 and 104 have been raised and lifted along with vehicle 502. Further, the top surface of support legs 102 and 104, once the lifting process has commenced, are also in contact with one or more surfaces on an underside of vehicle 502. The physical contact of support legs 102 and 104 with the underside of vehicle 502 provides additional stability and a larger footprint that would not be present if an operator were to simply use HI-LIFT jack 202 to raise vehicle 502 off of the ground.

As shown in FIG. 6B, stabilizing feet 106 and 108 remain flat against a ground surface and act as slip-resistant, gripping members that firmly make contact with a ground surface and provide additional stability during the lifting process. While not shown in FIG. 6B, it is noted that an operator may also use base plate 140 and strap 150, in accordance with one or more methods previously described herein, to further ensure that support legs 102 and 104 remain firmly fixed in place, and that HI-LIFT jack 202 does not fall over or fail.

FIG. 6C shows a final position of HI-LIFT jack 202 and lever adapter device 101 in a fully deployed position. In FIG. 6C, vehicle 502 has been raised to a desired height by the operator. At this desired height, in one or more scenarios, there is sufficient clearance 602 for the operator to access an underside of vehicle 502. Thus, support legs 102 and 104, and lever adapter device 101 have been fully raised off of ground at an angle, but stabilizing feet 106 and 108 remain in firm contact with a ground surface.

At this point, an operator may engage in a number of actions. An operator may selectively position a number of additional supports (not shown) at various points underneath the lifted vehicle 502. Such supports may include, without limitation thereto, vehicle jack stands or other support structures that may be formed of any type of material, including wood, concrete, or metal. Further, such supports and/or stands may come in a variety of shapes, heights, and overall dimensions. Firefighters and other first responders have a readily available supply of struts, blocks, and supports that they use to position against the wheels or underneath various portions of vehicles. As known to those skilled in the art, there are many types of supports that may be transported to a site for positioning beneath vehicle, and the operator may select the optimal type of supports and/or stands that he or she desires to use for the particular circumstance where vehicle 502 (or other heavy object) is being lifted.

Upon positioning any number of supports beneath the raised vehicle 502, an operator may begin lowering vehicle 502, by engaging the handle 216 of HI-LIFT jack 202 to lower vehicle 502. Lever adapter device 101 will remain coupled to HI-LIFT jack 202 during the lowering (or lifting) process. Upon lowering the vehicle 502 to a desired level, including lowering the vehicle 502 onto any of the used supports and/or stands, an operator may stop engaging handle 216 of HI-LIFT jack 202. At this step, both the support legs 102 and 104 of lever adapter device 101 function as structural supports able to carry the load of the vehicle 502 (in combination possibly with other added supports located beneath vehicle 502).

Once an operator has determined that vehicle 502 is securely lowered onto supports and is stable, the operator may determine to either withdraw HI-LIFT jack 202 and attached lever adapter device 101 or may determine to disengage HI-LIFT jack 202 from lever adapter device, and leave the lever adapter device 101 underneath the vehicle 502 to act as a support on its own.

In the first scenario, an operator may withdraw HI-LIFT jack 202 and attached lever adapter device 101 by pulling backwards on HI-LIFT jack 202 while walking away from vehicle 502. Operator may thus effectively pull both HI-LIFT jack 202 and the lever adapter jack 101 out from under vehicle 502, due to the fact that HI-LIFT jack 202 is still securely coupled to lever adapter device 101 by virtue of the jack attachment piece 116 being coupled to the runner 204 of HI-LIFT jack 202. In this manner, operator may easily maneuver both HI-LIFT jack 202 and lever adapter device 101 away from the vehicle 502.

For the latter scenario (whereby the operator determines to disengage HI-LIFT jack 202 from lever adapter device 102 and to leave the lever adapter device 101 underneath vehicle 502 to act as a support on its own), an operator may engage in the following steps. It may be assumed that this procedure may require that base plate 140 (or base plate 226 of HI-LIFT jack 202) be utilized (and optionally strap 150) to stabilize lever adapter device 101 beneath the raised vehicle 502 without being connected to HI-LIFT jack 202. As an initial step, the operator of lever adapter device 101 disengages HI-LIFT jack 202 from base plate 140 or base plate 226. In one embodiment, an operator may simply lift HI-LIFT jack 202 up and away from base plate 140 or base plate 226 positioned beneath a lower surface of HI-LIFT jack 202. Alternatively, to disengage HI-LIFT jack 202 from base plate 140 or base plate 226, the operator may have to unfasten one or more fasteners that couple HI-LIFT jack 202 to base plate 140 or 226. Either way, in one or more embodiments, HI-LIFT jack 202 may be detachably coupled to base plate 140 or base plate 226, and an operator may engage in any technique needed to detach HI-LIFT jack 202 from these base plates. To further disengage HI-LIFT jack 202, the operator may de-couple HI-LIFT jack 202 from lever adapter device 101 by removing position locking pin 119, and thus pulling position locking pin 119 away from the designated slot that extends through a frame 122 of jack attachment piece 116 and through the appropriate slot 206 located on runner 204.

Once HI-LIFT jack 202 has been disengaged, the operator may utilize a separate rod or strut (not shown) and dispose the separate rod or strut into the center slot 164 of base plate 140 (or base plate 226). Such rod or strut may include a number of slots at its upper surface and may be coupled to jack attachment piece 116 by inserting position locking pin 119 in these slots. Further, strap 150 may also be kept in place if strap 150 had been initially coupled to the stabilizing feet 106 and 108 located on a distal end of support legs 102 and 104. Accordingly, lever adapter device 101 may remain located beneath an underside of vehicle 502 and act as a support on its own while in the raised position (as shown in FIG. 6C), even if lever adapter device 101 is not coupled to HI-LIFT jack 202. HI-LIFT jack 202 may then be removed and attached to another lever adapter device to lift another vehicle or heavy object.

As shown by the steps described above, it is an advantage of the embodiments of lever adapter device 101 as described in the present description that the operator has a number of options when using lever adapter device 101 with HI-LIFT jack 202 to suit the operator's particular needs and current operating scenario.

In addition to the above, once the operator has had sufficient time to access the underside of vehicle 502 when in its lifted or raised position, the operator may choose to lower vehicle 502 all the way to the ground. To do so, the operator may remove any additional supports disposed beneath vehicle by crawling or reaching underneath the vehicle and removing the supports. Next, the operator may lower the vehicle all the way to the ground by engaging the HI-LIFT jack 202 handle 216 until the vehicle touches the ground level. Afterwards, the operator may easily withdraw the HI-LIFT jack 202 and attached lever adapter device 101.

Turning to FIG. 7, FIG. 7 shows lever adapter device 101 with support legs 102 and 104 in alignment (i.e. closed position) with each other. Further, FIG. 7 illustrates jack attachment piece 116 rotated to a horizontal flat position (as opposed to an upright vertical position as shown in FIGS. 1A and 1B). Lever adapter device 101 may be used in the arrangement shown in FIG. 7 when an operator needs to stow and store lever adapter device 101 when not in use. Thus, FIG. 7 shows one of the many benefits of lever adapter device 101, which is that lever adapter device 101 is a tool that may be stowed and stored so as to take up a minimal amount of room.

It is noted that, in some circumstances, an operator of lever adapter device 101 may desire to use lever adapter device 101 to lift a vehicle, such as vehicle 502, while support legs 102 and 104 are in the closed position as shown in FIG. 7. Accordingly, lever adapter device 101 may be successfully used to raise a vehicle while support legs 102 and 104 are in straight alignment with each other (as opposed to being spread apart in an angled arrangement as shown, for example, in FIGS. 1A and 1B).

Referring to FIG. 8, FIG. 8 shows an alternative method of using lever adapter device 101. As shown in FIG. 8, lever adapter device 101 is inverted in a concave up position. In certain scenarios, a vehicle or other heavy object (e.g. object 802) may have a smaller clearance, such as clearance 804. Thus, an operator of lever adapter device 101 may need to invert lever adapter device 101 such that lever adapter device 101 has a thinner profile and can accommodate the smaller clearance 804. As shown in FIG. 8, portions of the top surfaces of support legs 102 and 104 (e.g. top surfaces 136) may make contact with the ground surface 702.

FIG. 8 shows that lever adapter device 101 is coupled to HI-LIFT jack 202. In the scenario depicted in FIG. 8, lever adapter device 101 may be coupled to HI-LIFT jack 202 in accordance with one or more steps previously described. For example, position locking pin 119 (or another fastener) may be used to couple jack attachment piece 116 to runner 204 of HI-LIFT jack 202. Afterwards, an operator may slide HI-LIFT jack 202 and the attached inverted lever adapter device 101 (as shown in FIG. 8) beneath an underside of object 802. Alternatively, an operator may initially invert lever adapter device 101 such that support legs 102 and 104 are flipped over whereby their top surfaces 126 are touching the ground level 702, and slide lever adapter device 101 beneath object 802. Then, the operator may couple HI-LIFT jack 202 to the inverted lever adapter device 101 using one or more techniques described above. As shown in FIG. 8, an operator may also operably engage base plate 140 beneath HI-LIFT jack 202, and operably couple strap 150 to base plate 140 using one or more techniques described above, to provide additional sturdiness and stability when using lever adapter device 101.

FIG. 8 may be useful in some unique scenarios whereby lever adapter device 101 may be used for lifting a load (e.g. object 802) onto an elevated location or lowering down the load from an elevated location, such as a loading dock or stairs. To do so, in one or more embodiments, the stabilizing feet (e.g. 106 and 108) of lever adapter device 101 may be placed on the elevated location and the load may be placed on the legs (e.g. support legs 102 and 104) in the same flipped position as shown in FIG. 8. When the jack (e.g. HI-LIFT jack 202) has lifted or lowered the load, the load may simply be pushed off of support legs 102 and 104 to its desired location.

It is an intended objective of the present description to show that lever adapter device 101, in accordance with one or more embodiments, is extremely versatile and may have a variety of applications. Referring to FIG. 9, lever adapter device 101 is shown coupled with scissor jack lift 902. In one or more embodiments, the jack attachment piece 116 may be detached from the hinged support legs 102 and 104, such that lever adapter device 101 has an upper surface 903 without a jack attachment piece 116. Then, a top surface 904 of scissor jack lift 902 may be coupled to the upper surface 903 of lever adapter device 101 as shown in FIG. 9. In alternative embodiments, an operator does not need to detach jack attachment piece 116 from lever adapter device 101 to couple lever adapter device 101 to a scissor jack lift, such as scissor jack lift 902. Further, a base plate, such as base plate 140 shown in FIG. 1C and FIG. 1D may be coupled to a bottom surface of scissor jack lift 902. In addition, scissor jack lift 902 may push from the bottom using a positive locking device (not shown).

Figure 10:
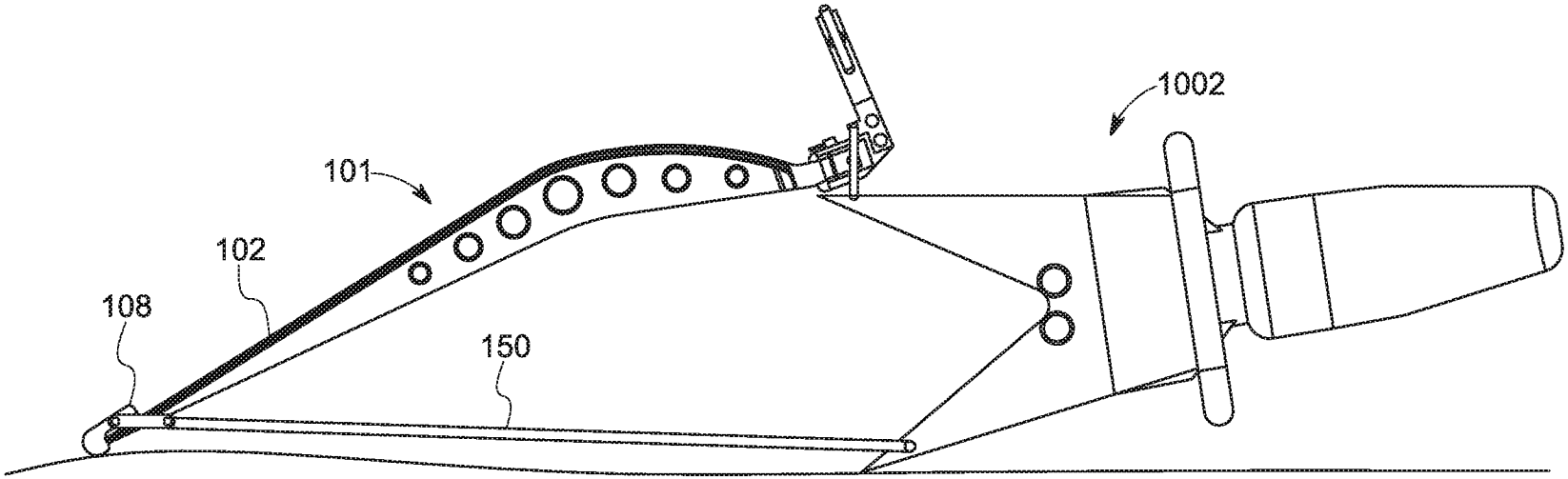
FIG. 10 illustrates an embodiment of a lever adapter device connected to a Jaws of Life device.

Referring to FIG. 10, FIG. 10 depicts an embodiment whereby lever adapter device 101 may be coupled to a Jaws of Life tool (i.e. Jaws of Life tool 1002). As described herein, a Jaws of Life tool may be a type of rescue tool, known to those skilled in the art, including emergency rescue personnel. Jaws of Life tools may be hydraulic rescue tools used to assist vehicle extrication of crash victims, as well as other rescues from small spaces. These tools may include cutters, spreaders, and rams, and may also be powered by a hydraulic pump (not shown), which can be hand, foot, or engine powered. In one or more embodiments, lever adapter device 101 may be used when implementing a Jaws of Life tool, such as Jaws of Life tool 1002 to extract crash victims from one or more vehicles or other scenarios. In one embodiment, a pivot cup or stirrup (not shown) may be used where the pivot cup or stirrup positive locks to the top bar 120 of jack attachment piece 116. Further, a base plate, such as base plate 140, may be coupled to a bottom surface of Jaws of Life tool 1002. Additional embodiments may be envisioned by those of ordinary skill in the art.

Figure 11:
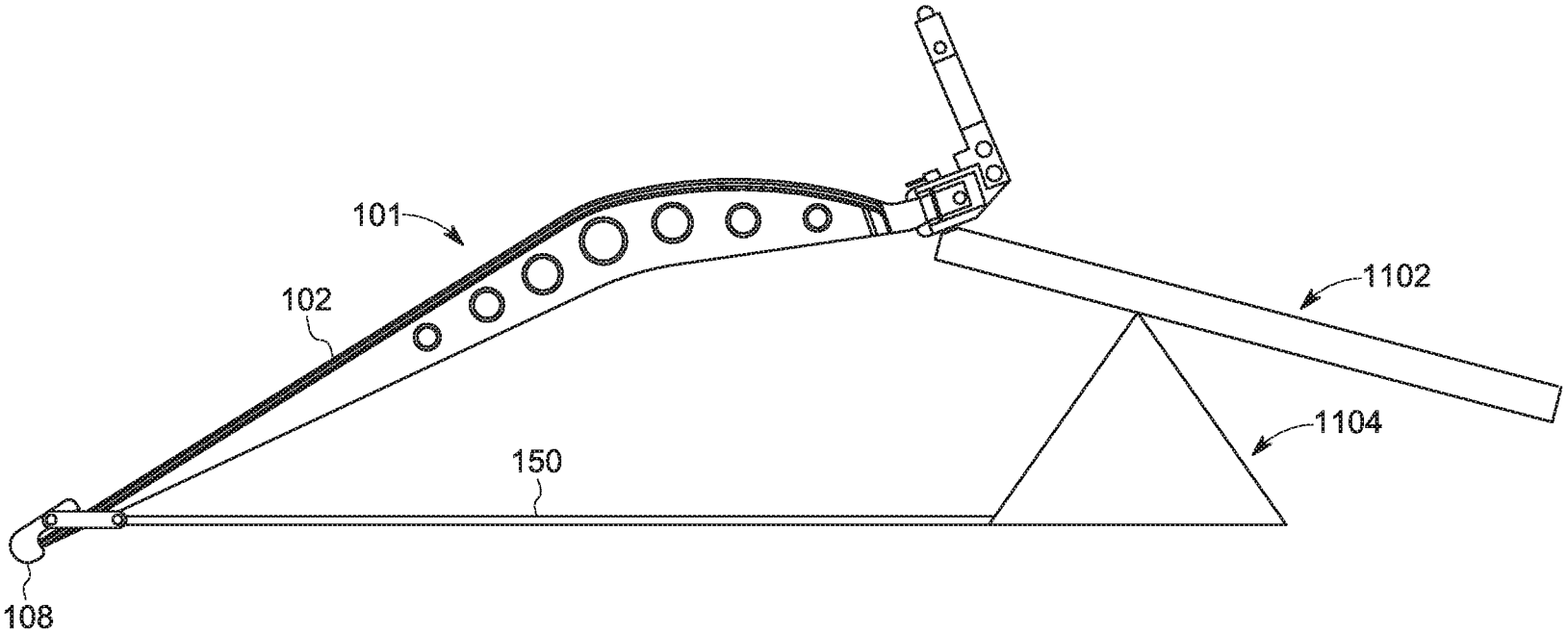
FIG. 11 illustrates an embodiment of a lever adapter device connected to a lever.

Turning to FIG. 11, FIG. 11 depicts another method and use for implementing lever adapter device 101. In FIG. 11, lever adapter device 101 may be coupled (e.g. via position locking pins) to a lever, such as lever 1102. Lever 1102 is shown in FIG. 11 may be coupled to and balancing on fulcrum 1104.

There are times where an operator of lever adapter device 101 may not be in possession or have easy access to the various specialized jacks useful in lifting vehicles or other heavy objects, such as HI-LIFT jack 202 and scissor jack 902 as described above. In such a situation, a lever (or bar) such as lever 1102, disposed over fulcrum may suffice to quickly and safely lift a vehicle or other object. Accordingly, an operator may couple lever adapter device 101 to lever 1102 by coupling jack attachment piece 116 to a body of lever 1102. In one embodiment, lever 1102 may include a designated slot (not shown) for inserting a position locking pin, such as position locking pin 119 into the slot of lever 1102 and also through the designated slot located in the frame 122 of jack attachment piece 116.

Afterwards, the operator (with or without the assistance of other individuals) may determine a suitable location beneath a vehicle or other object for sliding the lever adapter device 101 beneath the vehicle or other object. Then, the operator may apply force to the free end of lever 1102 to cause lever adapter device 101 to raise the vehicle or other object such that the support legs 102 and 104 make contact with an underside of the vehicle or other object. If one applies sufficient force to the end of lever 1102, he or she should be able to at least nominally and minimally raise the vehicle or other object to provide some space for the operators of lever adapter device 101 to access the underside of the raised vehicle or other object. Thus, the embodiment shown in FIG. 11 is shown to illustrate that there may be scenarios where lever adapter device 101 may still be useful (particularly in emergency rescue operations where it is critical to access trapped individuals as quickly and as safely as possible) even if a HI-LIFT jack 202 or other type of jack is not presently available.

Figure 12:
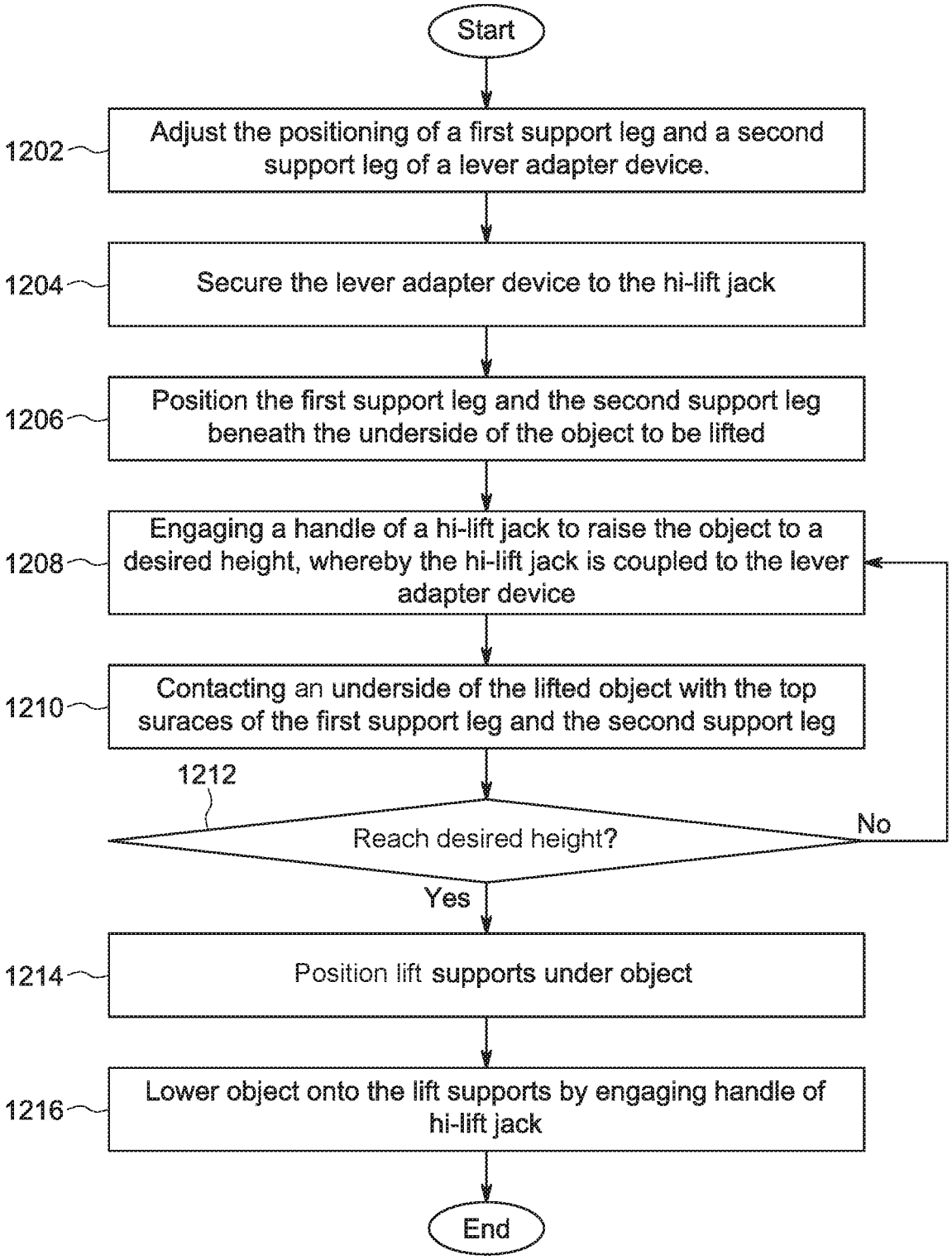
FIG. 12 illustrates a flowchart of a process for implementing a lever adapter device in accordance with an embodiment.

Referring to FIG. 12, FIG. 12 provides a flowchart of a process in accordance with one or more embodiments for using a lever adapter device 101. Specifically, FIG. 12 provides a flowchart for using a lever adapter device, such as lever adapter device 101, in conjunction with a HI-LIFT jack such as HI-LIFT jack 202 shown in FIG. 2. It is noted that one or more steps described in FIG. 12 may be performed out of the order described in FIG. 12. Further, lever adapter device 101 may be implemented in a variety of ways not described in FIG. 12.

As an initial step, the positioning of a first support leg and a second support leg (e.g. support legs 102 and 104) of a lever adapter device may be adjusted to the desired position (step 1202). As previously described, position locking pins may be used to lock support legs 102 and 104 in position. Thus, support legs 102 and 104 may be positioned in a spread apart position (in any desired angle or arrangement) or may be positioned so as to be in straight alignment with each other (e.g. as illustrated in FIG. 7).

Next, an operator may securely couple a lever adapter device (in accordance with one or more embodiments as described herein) to a HI-LIFT jack, such as HI-LIFT jack 202 (step 1204). This step may include coupling the frame 122 of jack attachment piece 116 to a runner 204 of HI-LIFT jack 202. In one or more embodiments, the operator may, subsequent to securing the lever adapter device 101 to HI-LIFT jack 202, position the first support leg and second support leg beneath an underside of an object to be lifted by sliding the first support leg and second support leg of the lever adapter device beneath the object (step 1206). Alternatively, the operator may position the support legs of a lever adapter device beneath the object, and then once that has been successfully completed, securely couple the HI-LIFT jack to the exposed jack attachment piece of the lever adapter device.

A process of using lever adapter device 101 may continue whereby an operator engages a handle of a HI-LIFT jack to raise the object to be lifted to a desired height (step 1208). At step 1208, the HI-LIFT jack is securely coupled to the lever adapter device. As the operator continues to lift the object, the top surfaces of the first and second support legs of a lever adapter device make contact with the underside of the lifted object, and thus act as stabilizing supports (step 1210).

An operator may continue to raise the lifted object by engaging the handle of the HI-LIFT jack. If the desired height is not reached, the operator continues to engage the handle of the HI-LIFT jack. However, upon reaching the desired height (step 1212), the operator may then proceed to put one or more lift supports (e.g. vehicle lift stands) in a variety of optimal locations beneath the lifted object (step 1214).

Next, the operator may proceed to lower the object onto the lift supports by engaging the handle of the HI-LIFT jack to lower the object (step 1216). In one scenario, the process illustrated in FIG. 12 may end with the object being lowered onto the lift supports. However, as previously described, an operator may perform additional steps subsequent to step 1216. For example, an operator may choose to withdraw the HI-LIFT jack that is attached to the lever adapter device, simply by pulling backwards on a body of the HI-LIFT jack, which effectively pulls the HI-LIFT jack and the lever adapter device out from under the vehicle. The operator may alternatively, keep the lever adapter device located beneath the lowered object to act as an additional support on its own. If so, the operator may choose to detach the HI-LIFT jack from the lever adapter device. This technique has previously been described above.

Additional combinations and various uses may be provided by lever adapter device 101. In some embodiments, an optional attachment (not shown) may be used on a top surface (e.g. top surface 136) of support legs 101 and 102 that would slide backwards as the load or object to be lifted is raised. Such an optional attachment may, without limitation thereto, comprise spikes or a positive lock fastened to the load attached and sliding on the support legs 102 and 104 of lever adapter device 101.

In some embodiments, support legs 102 and 104 may be configured to have longer lengths and to have a different curve configured to accommodate higher ground clearance vehicles, such as four-by-fours and trucks. Further, an accessory plate (not shown) may be welded or bolted to a frame of a vehicle, which may optionally be used with the longer length legs to accommodate for the typical distance (8 to 12 inches) of the frame from the rocker panel in truck type vehicles. The accessory plate would stick out towards the side of the vehicle and the lever adapter device would fit within it to provide the leg with a closer contact point.

In some embodiments, support legs 102 and 104 of lever adapter device 101 may not be curved, but may instead be formed as straight and flat legs. In such embodiments, the flat, straight legs (e.g. alternative configurations of support legs 102 and 104) may be used to lift and move loads (e.g. vehicles or other heavy objects) laterally. In some examples, this embodiment of the flat, straight support legs may be used to lift ecology blocks, such as those used to separate traffic or cordon off areas and build upon each other to make a wall. Such an embodiment of straight support legs may also be used for low-level maneuvering or adjustment of such blocks that are usually moved by forklift or a specific type of machinery. Further, such straight legs on a lever adapter device, such as lever adapter device 101, may be helpful in vehicle accidents sites that involve blocks and the like often placed along the road.

As previously described, stabilizing feet 106 and 108 may be attached at the end of support legs 102 and 104 to contact the ground to minimize slippage. In some examples, optional attachments for different feet for 106 and 108 may accommodate different types of ground surface, such as dirt, mud, sand, and pavement. In some examples, stabilizing feet 106 and 108 may be configured to rest on two by fours (2×4's) or four by fours (4×4's) to accommodate use on vehicles with higher ground clearance. Strap 150 may also be located by the feet and may be configured to allow the user to strap HI-LIFT jack 202 to lever adapter device 101 to prevent the base from kicking out.

Lever adapter device 101 may have a number of other uses, such as to lift a load tethered from below. For example, lever adapter device 101 may lift a car engine a couple of inches by placing lever adapter device 101 on the top of the engine compartment of the vehicle. Lever adapter device 101 may be used for auto wrecking yards in place of a fork lift to raise vehicles up and place on old wheel rims under the vehicle for access. In addition to the above, lever adapter device 101 may be used to span an opening, such as a trench or a high directional (a point above the load to connect a hauling system), for rope rescue. Furthermore, lever adapter device 101 may be used as a stabilizer to shore up collapsed entrances, walls, and objects in precarious positions.

Additionally, lever adapter device 101 may be used as a class 1 lever by flipping the device (to concave curve facing up) and placing the load on the toes. The base secured jack in the lowering function may raise the load. Furthermore, support legs 102 and 104 that are flipped with the concave curve facing up may also be used to lower the center of gravity and used for reduced clearance issues (as shown and as described for FIG. 8).

In some embodiments, the jack attachment and legs may be configured to meet at a hinge. The hinge may be configured with positioning pins to lock in place the positioning of the legs and the jack attachment. In some embodiments, a pin may be configured to release the positioning of the legs by pulling on the pin. When the pin is inserted, the positioning of the legs may be locked in place. Additionally, the same or another pin may be configured to release the positioning of the angle of the jack attachment relative to the hinge and legs. In some embodiments, a pin may be configured to release the positioning of the jack attachment by pulling on the pin. Using the pins, a user may manipulate the positioning of the legs and jack attachment so that the lever adapter device may lie horizontally or vertically flat in the storage position for easy storage and transportation. In addition, the pins allow the user to easily manipulate the legs and jack attachment from storage position to deploy position ready for lifting a vehicle. In some embodiments, the deploy position includes spreading the legs, placing the legs horizontally along the ground, and the jack attachment angled vertically to allow insertion of a high lift jack. The legs may be spread at variable angles.

Beneficially, embodiments of a lever adapter device as described herein may assist an operator in raising or lifting a vehicle or heavy object faster, higher, and in a safer manner than the methods and mechanisms presently available. The lever adapter device, in accordance with one or more embodiments described herein, is a portable and universal device that may be utilized by anyone to lift a vehicle quickly and safely. Further, the lever adapter device, in accordance with embodiments described herein, reduces the load on a jack that is used when lifting a vehicle or other heavy object. The lever adapter device may be particularly helpful for rescue personnel in situations where the driver and passengers of a vehicle need to be extracted from a variety of different types of vehicles in emergency situations. The lever adapter device may also be used for vehicles on their side or top.

Further, a lever adapter device, as described above, adds a significant amount of support and stability that does not exist with presently available mechanisms. Another notable feature of lever adapter device is that lever adapter device allows individuals (especially firefighters and other emergency rescue responders) to confidently and safely lift vehicles or other loads without needing bulky and complication additional pieces of equipment or the assistance of multiple people. Further, a lever adapter device, as designed and described herein, may be used in an original or inverted position as needed. There are numerous uses and applications for a lever adapter device in accordance with the numerous embodiments as described above.

The above-described Figures illustrate the architecture, functionality, and operation of possible implementations of the invention described in the present description according to various embodiments. The detailed description of the illustrative embodiments above is described in sufficient detail to enable those skilled in the art to practice the invention. To avoid unnecessary detail, the description may have omitted certain information known to those skilled in the art.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

The present disclosure recognizes the unsolved need for a Bi-pod rescue strut system that may be used quickly and conveniently to rapidly and safely stabilize a vehicle or other object at the scene of an accident or other emergency setting, particularly during emergency rescue operations where rescue workers need to secure the vehicle or other object with the use of a telescopic Bi-pod rescue strut system to stabilize the vehicle or other object as well as safely remove occupants from within or under the vehicle or other object. The Bi-pod rescue strut system may also be used as a lifting device for lifting a vehicle or other object.

Existing systems and methods for rescue devices are not as secure, usually only providing a narrow base that can easily be tipped over and also require an extensive amount of time to install. They also are expensive, occupy too much space, are dangerous for the First Responder to operate and monitor. The present invention provides a multi-legged, portable, adjustable, extendable Bi-pod rescue strut system utilized for emergency and rescue operations, providing multiple features and configurations including operating as a "quad-pod" for loads applied above and below the Bi-pod rescue strut system, a support column, a lifting device for lifting a vehicle or other object, and many other useful features and utilities.

These multiple uses allow the Bi-pod rescue strut system to be stored in a small package, allowing more space for more tools such as airbags or multiple struts. The Bi-pod rescue strut system also prevents extensive training because of its ease and familiarity. The Bi-pod rescue strut system also provides a better position for First Responders to tighten the Bi-pod rescue strut system where they may stand instead of kneel, and provides for a better position to monitor and run away if the vehicle or object starts to fall or topple over. The mechanical advantage and load sharing of the Bi-pod rescue strut system create an easier stronger system that is easier to secure and lift if needed.

Figure 13:
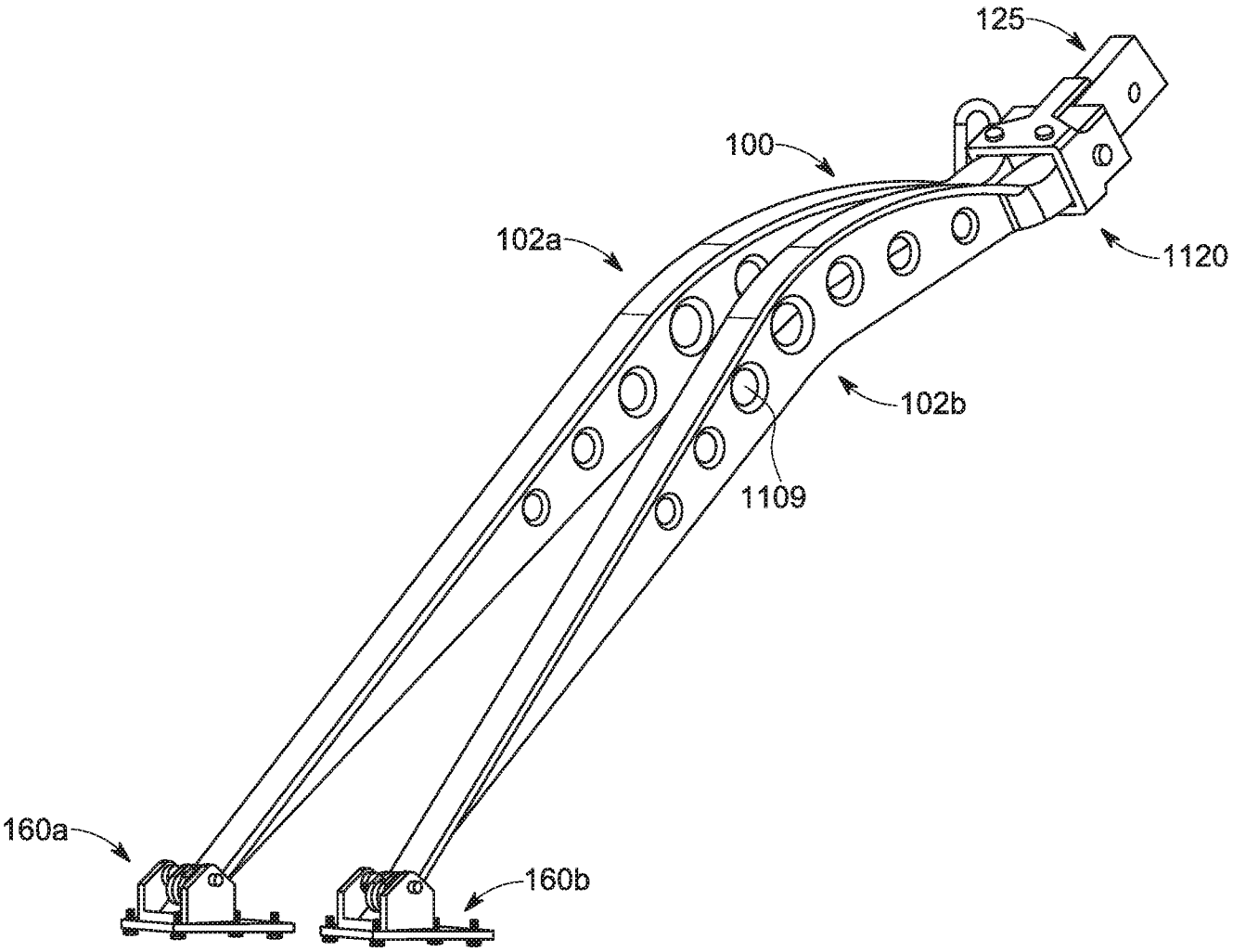
FIG. 13 illustrates a perspective view of an embodiment of a Bi-pod Rescue Strut System.

The Bi-pod rescue strut system, as depicted in FIG. 13, may include, in one or more embodiments, a left support leg and right support leg such as left support leg 102*a* and right support leg 102*b*. Support legs 102*a* 102*b* may be curved or curvilinear, elongated members. The curved elongated shape acts as a strong structural support for the stabilization of a load or object.

Support legs 102*a* 102*b* have a top surface and a bottom surface as well as a proximal end and distal end. In one or more embodiments, bottom surface may be straight and flat. Alternatively, or additionally, bottom surface of each one of support legs 102*a* 102*b* may also be angled or curved.

Support legs 102*a* 102*b* may each have an upwardly tapering portion. Further, support legs 102*a* 102*b* may each have a downwardly tapering portion. In one or more embodiments, a body of the left support leg 102*a* is designed to be substantially the same or identical as the body of right support leg 102*b*. Thus, both support legs 102*a* 102*b* may have a curved shape. However in one or more non-limiting embodiments, support legs may be designed to be straight and flat.

Support legs 102*a* 102*b* may have the same general appearance. However, it is noted that support legs may be any size or shape as desired. In one or more implementations, support legs may taper upwardly to a flat support surface. At the distal end of flat support surface, the downwardly tapering portions of support legs may begin. Flat support surface may have a uniform height or may increase or decrease in other configurations. Notably, support legs are designed to curve upwardly and then to curve downwardly.

In one or more embodiments, holes or cavities such as holes 1109 are disposed throughout support legs 102*a* 102*b* may function to reduce the weight of Bi-pod rescue strut system 100 as well as to assist in maintaining the strength of the Bi-pod rescue strut system 100. Further, it is noted, that the holes or cavities that extend through a thickness of support legs may be omitted in alternative designs or vary in number and size and spacing.

Figure 14:
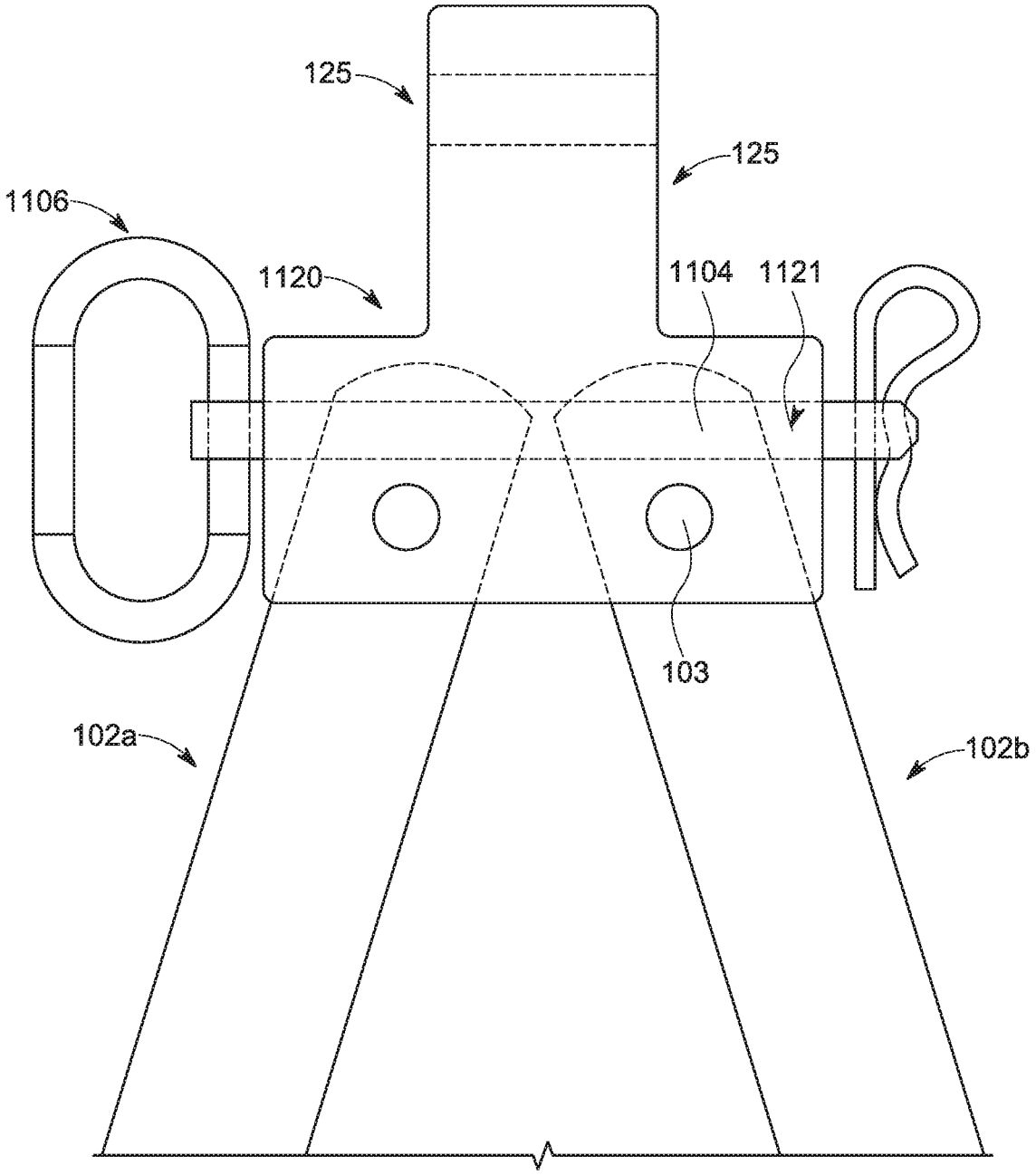
FIG. 14 illustrates a front view of the yoke and support legs of the Bi-pod Rescue Strut System in the open position.

Support legs 102*a* 102*b* are adapted to either move jointly or independently of each other, and may be positioned in a variety of ways. For instance, support legs 102*a* 102*b* when connected to a yoke such as yoke 1120, as depicted in FIG. 14, may be moveable towards and away from each other so as to be spread apart. Further, support legs 102*a* 102*b* may be brought close together so as to be in a straight parallel alignment with each other. Alternatively, or additionally, support legs 102*a* 102*b* may be configured so that each support leg moves independently of the other such that each support leg may be disposed at a desired angle.

Figure 15:
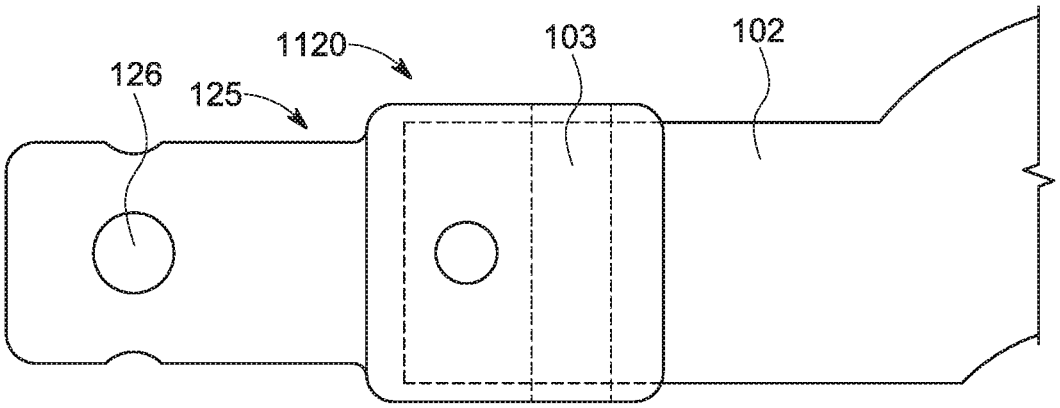
FIG. 15 illustrates a side view of the yoke and support legs of the Bi-pod Rescue Strut System.

Near the proximal ends of support legs 102*a* 102*b*, adjacent to where yoke 1120 may be coupled to each support leg 102*a* 102*b*, there may be one or more pivot holes such as pivot hole 103, as depicted in FIG. 15, that extends through support legs 102*a* 102*b* and yoke 1120 whereby one or more fasteners may secure support legs 102*a* 102*b* to yoke 1120, creating a pivot point for support legs 102*a* 102*b* relative to yoke 1120.

Near the proximal ends of support legs 102*a* 102*b*, there may also be one or more locking holes such as locking holes 1104 that extend through support legs 102*a* 102*b* at an angle through the sides on the surface perpendicular to surface of support legs 102*a* 102*b* that pivot holes 103 pass through, such that a position-locking pin such as position-locking pin 1106, may be extended through locking holes 1104 in support legs 102*a* 102*b*, locking support legs at an angle relative to yoke 1120. Locking hole's 1104 angle is preferably a 45 degrees angle but may vary based on the specific needs of the emergency rescue situation.

In one or more embodiments, support legs are essentially formed as a single solid beam structure. In some embodiments, support legs may be integrally formed as a single whole piece. Alternatively, in other embodiments, support legs may be formed as an assembly of separate structural pieces. In one or more embodiments, support legs may be formed as a modified I-beam structure. In alternative embodiments, a body of support legs may include double beams, triple beams, or any number of beams as needed. Accordingly, in one or more embodiments, support legs may each include an upper beam coupled to a lower beam that makes up the body of each one of support legs. Having the upper beam coupled to the lower beam for each one of support legs may add strength and additional structural stability to the rescue strut device.

Figure 16:
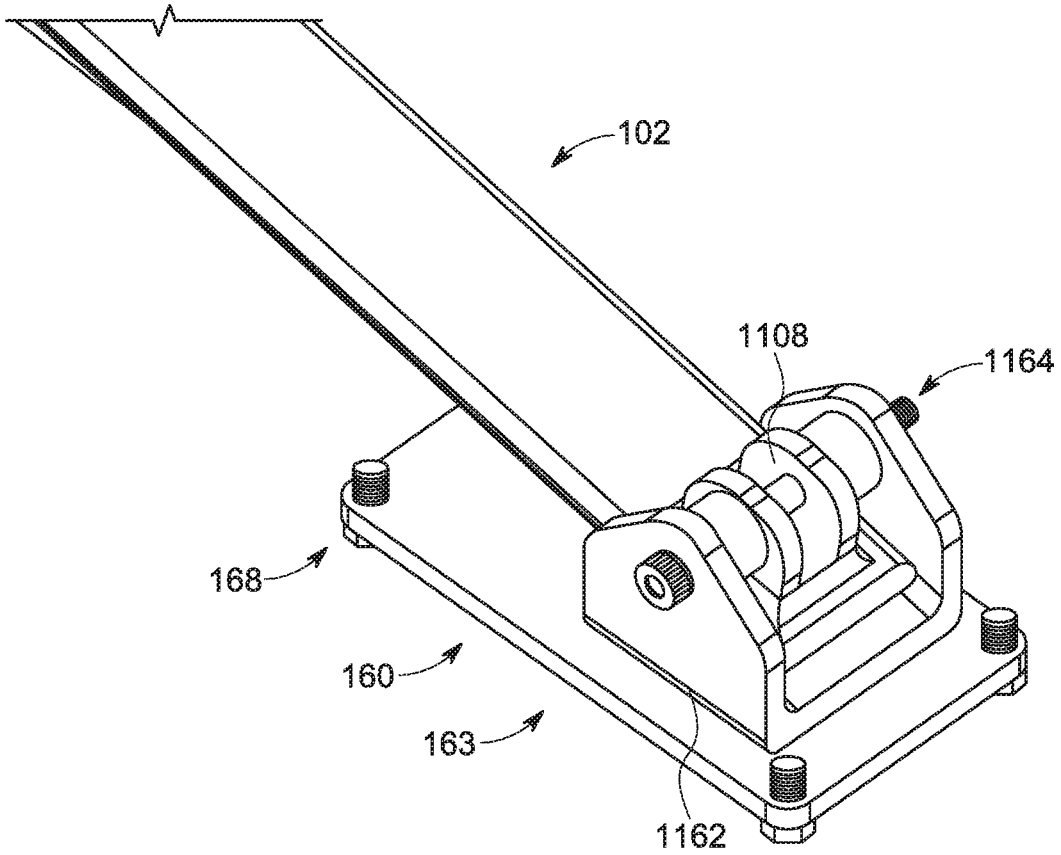
FIG. 16 illustrates a perspective view of the stabilizing feet of the Bi-pod Rescue Strut System rotated in one direction.

In one or more embodiments, Bi-pod rescue strut system 100 may further include a left stabilizing foot and right stabilizing foot such as left stabilizing foot 160*a* and right stabilizing foot 160*b* disposed at a distal end of the left support leg 102*a* and right support leg 102*b* respectively, as depicted in FIG. 16. Left stabilizing foot 160*a* and right stabilizing foot 160*b* each having a "U" shaped mounting bracket such as "U" shaped mounting bracket 1162 having a forked head appearance with a base and a first member and second member that extend substantially parallel to the axis of rotation of the base. The first member and second member are equally spaced around a centerline axis of the base, providing an "ear" shaped design to the base plate. "U" shaped mounting bracket 1162 may be connected to a base plate such as base plate 163 that has a rectangular shaped frame, although alternative shapes and configurations may certainly be used. In some embodiments, the "U" shaped mounting bracket and base plate may be one component.

The first member and second member of "U" shaped mounting bracket 1162 of each stabilizing foot 160*a* 160*b* may include a hole extending through the lateral surface of the first and second members whereby the holes may be axially aligned with a hole through a barrel member such as barrel member 1108 attached to support legs 102*a* 102*b* near or on the distal end of support legs 102*a* 102*b* whereby a fastener such as fastener 1164 which may be a pivot screw, pulling pin, or other fastener may be placed through the hole of the first member and second member of "U" shaped mounting bracket 1162 and the hole in barrel member 1108 so that stabilizing feet 160*a* 160*b* are pivotally connected to barrel member 1108 and thus support legs 102*a* 102*b*. In some embodiments, support legs may have a hole near or on the distal end of support legs whereby the hole is axially aligned with the hole in the first member and second member so that a fastener such as a pivot screw, pulling pin, or other fastener may pivotally connect the stabilizing feet to support legs.

Figure 17:
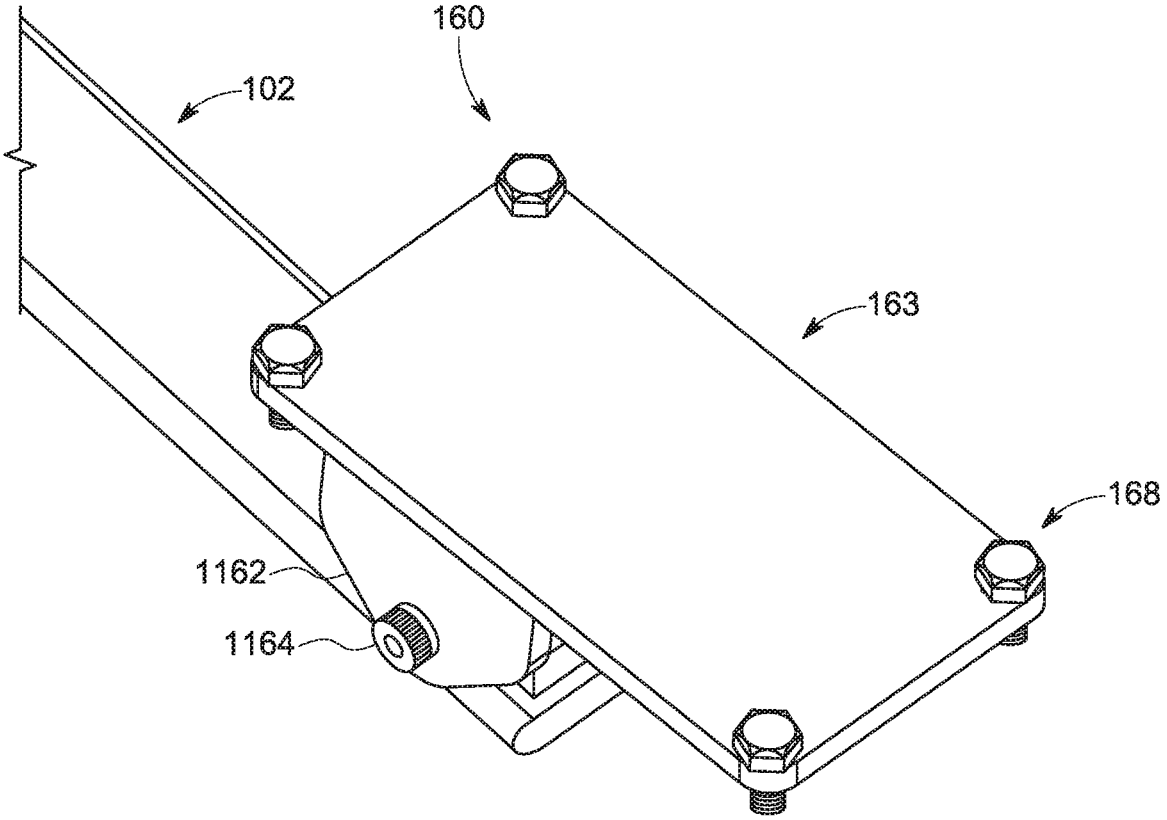
FIG. 17 illustrates a perspective view of the stabilizing feet of the Bi-pod Rescue Strut System rotated in the opposite direction from FIG. 4.

When fastened in a pivoting connection, stabilizing feet 160*a* 160*b* are rotatable around an axis transverse with respect to the axis of support legs 102*a* 102*b* so that "U" shaped mounting bracket 1162 and base plate 163 may be swung to a first position on the side of the top surface of support legs 102*a* 102*b* to a second position 180 degrees from the first position on the side of the bottom surface of support legs 102*a* 102*b*, as depicted in FIG. 17. Support legs 102*a* 102*b* appear upside down or inverted when base plate 163 is positioned on the ground in the second position relative to when base plate 163 is positioned on the ground in the first position. "U" shaped mounting bracket 1162 may also be orientated at any angle or position located between the first position and second position such as at a 90-degree angle relative to the first position where support legs 102*a* 102*b* is a vertical orientation perpendicular to base plate 163 whereby support legs 102*a* 102*b* are pointing directly upwards.

In some embodiments, the left stabilizing foot and right stabilizing foot may be locked at a specific angle relative to the left support leg and right support leg by a position-locking pin or other locking mechanisms known by those of ordinary skilled in the art whereby the left stabilizing foot and right stabilizing foot are maintained at a chosen angle relative to the left support leg and right support leg. In further non-limiting embodiments, the left stabilizing foot and right stabilizing foot may be locked at different angles for dissimilar terrain and conditions. The pivoting action of stabilizing feet 160*a* 160*b* with respect to the support legs 102*a* 102*b* increases the versatility of Bi-pod rescue strut system 100 by supporting loads at various angles including directly above Bi-pod rescue strut system 100. In other non-limiting embodiments, stabilizing feet may be coupled to a distal end of support legs using any affixation methods known in the art, including using any type of fasteners, adhesives or via welding or soldering, without limitation to these methods. In further embodiments, the left and right stabilizing feet may have one or more holes whereby a picket or other type rod may be driven into the ground through the holes in the left and right stabilizing feet to further prevent the Bi-pod rescue strut system from sliding.

Left stabilizing foot 160*a* and right stabilizing foot 160*b* may have the same general appearance. However, it is noted that left stabilizing foot 160*a* and right stabilizing foot 160*b* may be any size or shape as desired. Stabilizing feet 160*a* 160*b* may assist in stabilizing a load by preventing slippage of support legs 102*a* 102*b*, respectively, and provide additional grip for Bi-pod rescue strut system 100 to a ground surface. It is foreseeable that Bi-pod rescue strut system 100 may be used on a variety of terrains, including on terrains that may contribute to easy slippage of the Bi-pod rescue strut system 100 during actual use. The bottom side of the base plate of the stabilizing feet may comprise an additional gripping surface material or any adhesive wherein the material prevents slippage between the top platform and the base of the person's mandible.

The coverage area of the material may be an externally applied adhesive coating or the material may be impregnated within the top platform itself. The base plate itself may optionally have a rough or textured surface so as to increase friction and adherence to the body or surfaces without the need for additional layers or adhesives. Accordingly, Bi-pod rescue strut system may accommodate a variety of ground surfaces and terrains, including, but not limited to, muddy surfaces, rocky surfaces, snow, sand, pavement and/or dirt roads.

As previously described, stabilizing feet and may be attached at the end of support legs to contact the ground to minimize slippage. In some examples, optional attachments for different feet may accommodate different types of ground surface, such as dirt, mud, sand, and pavement. In some examples, stabilizing feet may be configured to rest on two by fours (2×4's) or four by fours (4×4's) to accommodate use on vehicles or other objects with higher ground clearance.

In further non-limiting embodiments, stabilizing feet 160*a* 160*b* may have holes or cavities for accepting coned ended studs such as studs 168 used to further grip the surface Bi-pod rescue strut system 100 is placed upon. Studs 168 may be maintained by lock nuts that may be tightened or removed so studs 168 may be replaced with newer studs after the previous become worn down. Studs may be of any shape and size including being in the shape of a cube, pyramid, prism, cylinder, or sphere.

Support legs 102*a* 102*b* provide additional other advantages in addition to providing grip to a ground surface and stabilization. For example, a strap, may be used in one or more applications to further stabilize Bi-pod rescue strut system 100 and may be attachable to each support leg 102*a* 102*b*, which will be discussed later. In some embodiments, support legs in the Bi-pod rescue strut system may not be curved, but may instead be formed as straight and flat support legs.

A yoke 1120 may be coupled to the proximal ends of support legs 102*a* 102*b*. Yoke 1120 includes an upper component 125 for receiving an attachment or other apparatus such as a telescopic strut member, and a lower component for housing and securing the proximal ends of support legs 102*a* 102*b*. Yoke 1120 may be configured to have apertures therethrough whereby holes in yoke 1120 may be aligned and coupled with one or more fasteners to pivot holes 103 at the proximal ends of support legs 102*a* 102*b* to secure support legs 102*a* 102*b* to yoke 1120, creating a pivot point for support legs 102*a* 102*b* relative to yoke 1120. Fasteners may be any type of fasteners known in the art, including, but not limited to, any type of screw and/or nut and bolt combination. The fasteners may be removed to detach support legs 102*a* 102*b* from yoke 1120 so that a First Responder may carry and store the rescue strut and stabilization quicker and easier.

As noted above, support legs 102*a* 102*b* may be moveable, and may be moved within a particular range of movement so as to be spread apart from one another. The distance between support legs 102*a* 102*b* may be determined by a First Responder or other operator of Bi-pod rescue strut system 100. Because support legs 102*a* 102*b* are connectively joined, support legs 102*a* 102*b* are able to move to an open or closed position. It is noted that support legs 102*a* 102*b* may be opened as wide as desired by First Responder. Alternatively, support legs 102*a* 102*b* may be closed so as to be brought in alignment with each other. Alternatively, or additionally, each support leg 102*a* 102*b* may be independently moveable with respect to the other.

While support legs 102*a* 102*b* are secured to yoke 1120, a First Responder may manipulate the positioning of support legs 102*a* 102*b* so that support legs 102*a* 102*b* may be closed and lie parallel to one another such that support legs 102*a* 102*b* are horizontally or vertically flat in the storage position for the facilitation of storage and transportation. Support legs 102*a* 102*b* may also be positioned at variable angles whereby support legs 102*a* 102*b* are spread in a rotary motion from each other at an angle around the axis of yoke 1120 and may be placed on the ground for deployment and use. Bi-pod Rescue Strut System 100 may have a lateral fastener such as the position-locking pin 1106 that secures through the passageway 1121 of yoke 1120 and passageway 1104 through support legs 102*a* 102*b* to achieve a locked position at the desired angle. In further embodiments, the Bi-pod Rescue Strut System may have multiple vertical passageways in the yoke that correspond with the vertical leg passageway that will accommodate varied angles and combinations for angles to be locked in place relative to yoke to provide further stability to Bi-pod rescue strut system.

Figure 18:
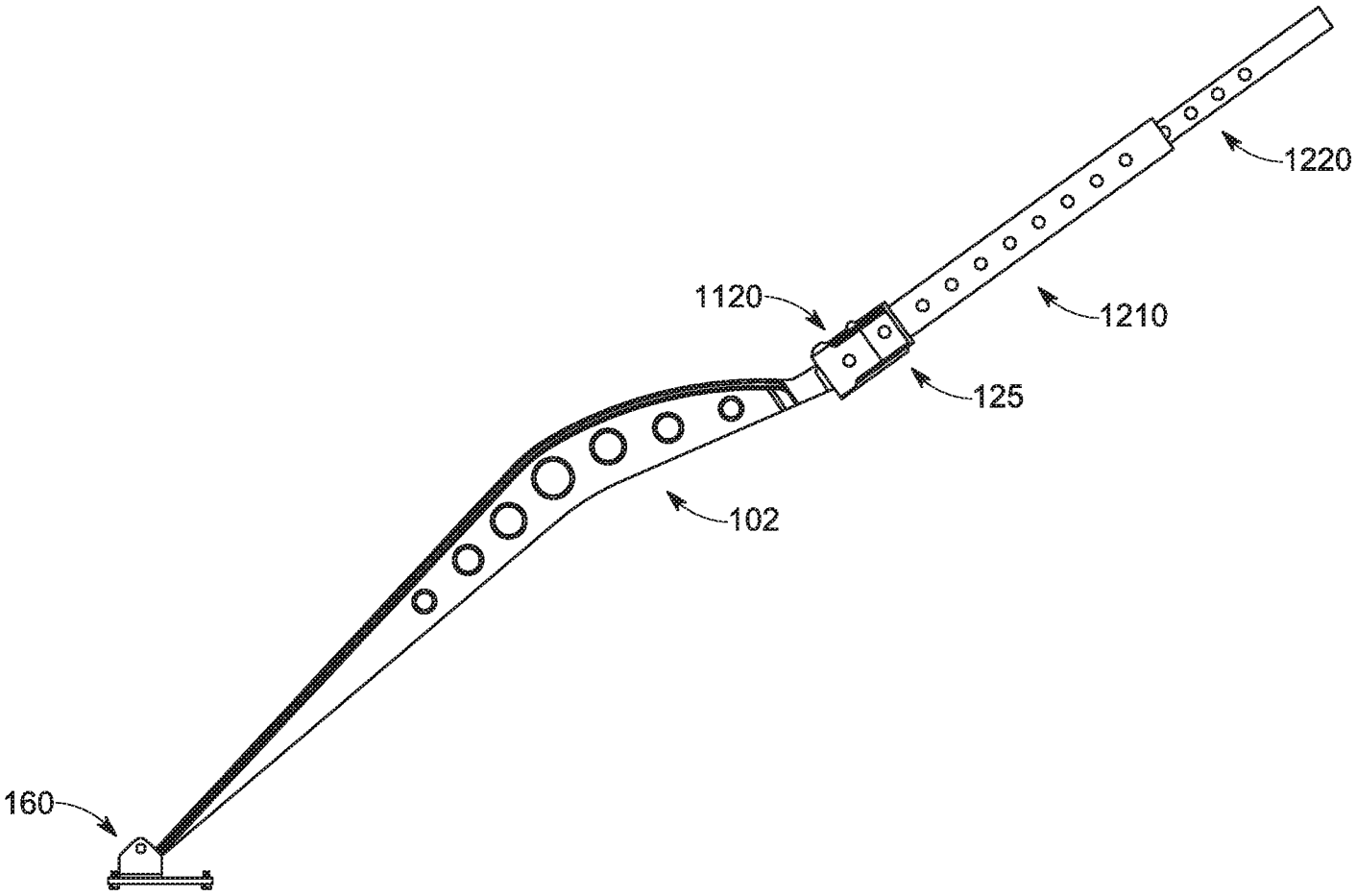
FIG. 18 illustrates a side view of the, telescopic strut extension yoke and support legs of the Bi-pod Rescue Strut System.
Figure 19:
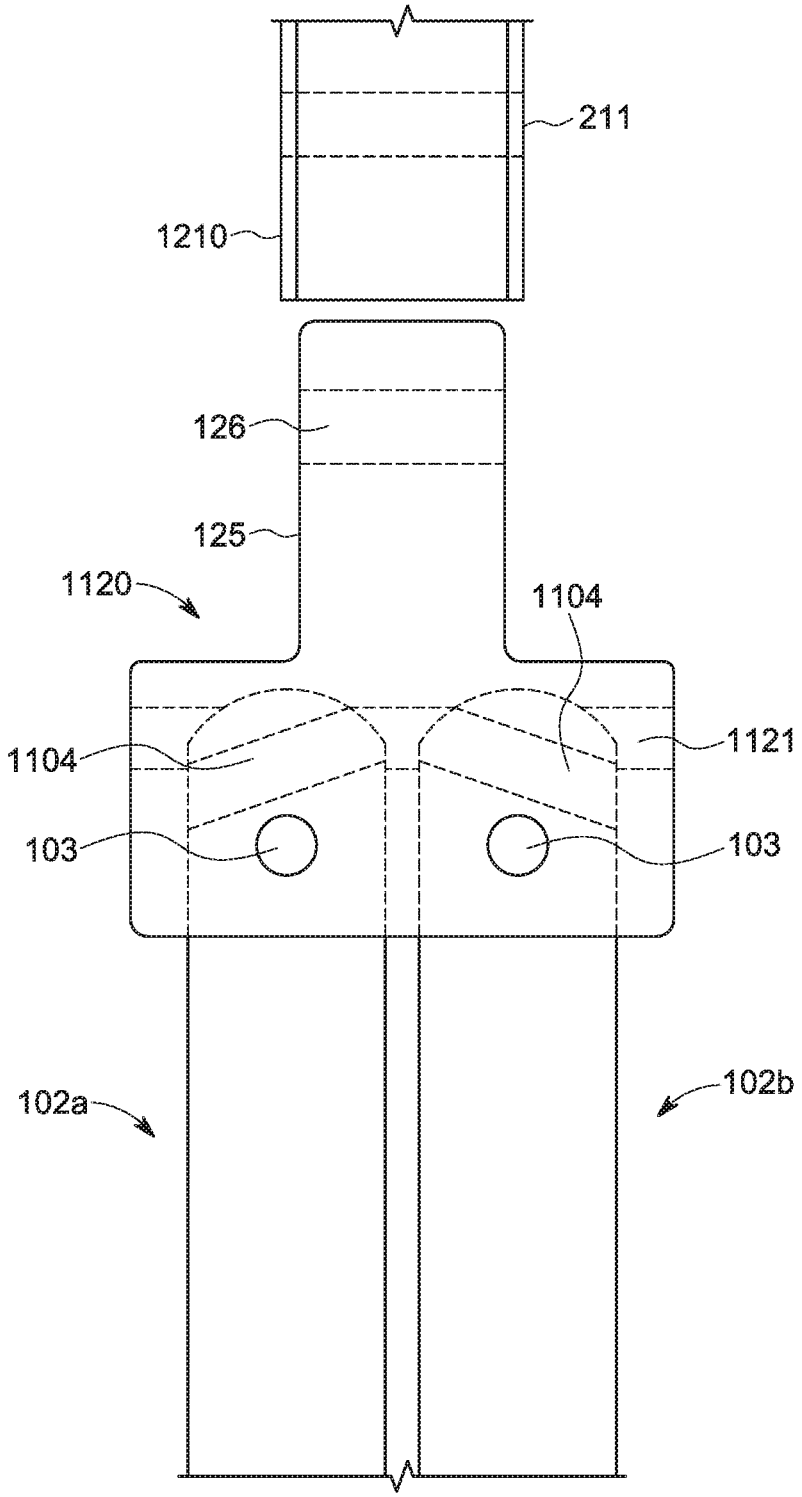
FIG. 19 illustrates a front view of the telescopic strut extension, yoke, and support legs of the Bi-pod Rescue Strut System in the closed position.

A telescopic strut extension such as telescopic strut extension 200 may be used in one or more applications to provide an attachment point on Bi-pod rescue strut system 100 to a load such as a vehicle positioned on its side as depicted in FIG. 18. Telescoping strut extension 200 has a lower outer tube member 1210 in a slidable engagement with an extendable upper inner tube member 1220 to extend the rescue strut for multiple heights to support loads at different distances. As seen in FIG. 19, lower outer tube member 1210 is attached at its lower end to upper component 125 of yoke 1120 with one or more fasteners whereby the fastener may be placed through a receiving hole such as receiving hole 126 of upper component 125 and a receiving hole such as receiving hole 211 through lower outer tube member 1210. Fasteners may be any type of fasteners known in the art, including, but not limited to, any type of screw and/or nut and bolt combination. The fasteners may be removed to detach lower outer tube member 1210 from upper component 125 of yoke 1120, increasing portability of Bi-pod rescue strut system 100. Upper inner tube member 1220 may have an end fitting affixed at its upper end for engaging and supporting the object to be stabilized such a vehicle positioned on its side or a ceiling.

Two-part telescopic strut extension 200 is shown having an upper inner tube member 1220 and lower outer tube member 1210, which generally is preferable due to simplicity and portability. However, a telescopic member may be added to upper extendable inner tube member 1220 whereby upper inner tube member 1220 is in a slidable engagement with a similarly structured additional extendable tube member to increase the length of the telescopic strut extension so that it may be applied to surfaces of a farther distance. In further embodiments, the additional tube member may be in a slidable engagement with similarly structured additional tube members to support loads at even a further distance. In some embodiments, the upper inner tube member may have greater area that the lower tube member and fit over and have a slidable engagement with the lower tube member.

Lower outer tube member 1210 and upper extendable inner tube member 1220 have a substantially rectangular uniform cross section. It is also noted that tube members may be any size or shape as desired. In one or more implementations, the tube members may be cylindrical in shape. Lower outer tube member 1210 and upper extendable inner tube members 1220 may also have grabs or other locking means for preventing unsafe over-extension of the members in relation to one another.

Telescopic strut extension 200 may include a position-locking pin to allow for the extension of upper inner tube member 1220 in relation to lower outer tube member 1210. In some embodiments, holes or are formed through the outer tube member 1210 and inner tube member 1220 and are of a certain distance from one another whereby the holes through lower outer tube member 1210 align with corresponding holes on upper inner tube member 1220 and a position-locking pin may be placed to lock the inner tube at a specific position in relation to lower outer tube member 1210. Removing the position-locking pin allows for extension of upper inner tube member 1220 whereby upper inner tube member 1220 may freely move relative to lower outer tube member 1210 in a linear telescopic motion. Replacing the position-locking pin in a hole in lower outer tube member 1210 and upper inner tube member 1220 locks upper inner tube member 1220 at a specific position relative to lower outer tube member 1210. In some non-limiting embodiments, the position-locking pin may be an instrument comprised of two or more pins whereby the pins may be entered simultaneously into aligned holes through the lower outer tube member and upper inner tube member at different heights further providing stability to the rescue strut.

Accordingly, in one or more embodiments, the components of the Bi-pod rescue strut system are made from a durable metal, such as steel, although alternative materials and/or elements may also be used such as aluminum, copper, titanium, brass, magnesium, fiberglass, gold, silver, graphite, ceramic, plastic, carbon fiber, wood, polymers, and other composites. Further, it is noted that any suitable manufacturing process may be used for forming the Bi-pod rescue strut system.

One or more straps may be used in one or more applications to further stabilize rescue strut and may be attachable to each support leg. Straps may be any type of strap known in the art. Straps may essentially be an elongated ribbon that is made of durable material. Straps include a first end and a second end. Straps may be made of any suitable material and/or fabric, including, but not limited to nylon. Strap may be a ratchet strap type with a self-sufficient recoiling mechanism for providing slack and tension to the strap. In alternative configurations a strong rope, chain, or other type of tying member may be used.

Straps may be used to provide additional stabilization for support legs of the Bi-pod rescue strut system, and help prevent support legs from moving during use. Straps may be hooked to another object or additional straps or tying members if the distance is too great to be reached by the strap. Chains or other tying members may be used to produce multiple connection points with an object such as a vehicle from the single strap.

One or more straps may be used in different locations and for different configurations. A load tension strap may be used to couple supports legs 102*a* 102*b* to the lower portion of a load that the upper inner tube member 1220 of Bi-pod rescue strut system 100 is contact with such as a vehicle on its side. In one or more embodiments, a hook or other fastening apparatus may be affixed to the load tension strap. The load tension strap may be affixed to a chain whereby the chain may be wrapped around, passed through, hooked or otherwise securely affixed to the load. This prevents Bi-pod rescue strut system 100 from "kicking out" and further providing stability to the system.

A foot tension strap fastened near the distal ends of support legs 102*a* 102*b* may be used to couple support legs 102*a* 102*b* and provide tension between support legs 102*a* 102*b* so the support legs do not separate and spread apart from one another and assists in keeping support in the particular positions as desired by the First Responder. An extension tension strap may be used to couple upper inner tube member 1220, whereby the strap is lead down along telescopic strut member 200, below yoke 1120, and coupled to the load tension strap to distribute stresses evenly throughout the rescue strut and taking some of the burden of the stresses and load.

In the preferred method of use Bi-pod rescue strut system 100 in place a position ready for use whereby rescue strut affixed to and supporting a vehicle on its side. Support legs 102*a* 102*b* may be spread apart and locked in place in their deployed positions at a selected angle desired by the First Responder prior to using Bi-pod rescue strut system 100 to provide support to the vehicle. Stabilizing feet 160*a* 160*b* are also positioned so as to provide further grip on a ground surface on which vehicle is located upon.

Telescoping extension strut 200 is secured to yoke 1120 whereby lower outer tube member 1210 is positioned over or inside upper component 125 of yoke 1120 and a position-locking pin is placed through receiving hole 211 through the lower outer tube member 1210 and receiving hole 126 through upper component 125, securing telescoping strut extension 200 to yoke 1125 whereby telescoping extension strut 200 is preferably at a 45-degree angle to the ground. However the angle may vary based on the specific needs of the emergency rescue situation. Upper inner tube member 1220 is extended in relation to the lower outer tube member 1210 whereby telescoping extension strut 200 and the end fitting of the upper inner tube member 1220 is positioned against the vehicle at about two-thirds the height of the vehicle thus creating a secured attachment point. Two-thirds of the height of the load is the preferred height so as to avoid the load tipping over upon Bi-pod rescue strut system 100, but the height the end fitting is positioned against the load may be any distance from one-half or above the height of the load.

Load tension strap is securely tied or otherwise coupled to support legs and is affixed to a chain connected to a vehicle on its side. The chain is wrapped around, passed through, or hooked to part of a lower point on the side of vehicle and then secured and tightened creating tension between the load tension strap, the chain, and the vehicle to prevent Bi-pod rescue strut system 100 from kicking out and further providing stability to Bi-pod rescue strut system 100. A foot tension strap is attached to distal ends of support legs 102*a* 102*b* to prevent support legs 102*a* 102*b* from spreading apart from one another. An extension tension strap is coupled to upper inner tube member 1210, whereby the strap is lead down along telescopic strut member 200, below yoke 1120, and coupled to the load tension strap to distribute stresses evenly throughout Bi-pod rescue strut system 100 and taking some of the burden of the stresses and load.

Figure 20:
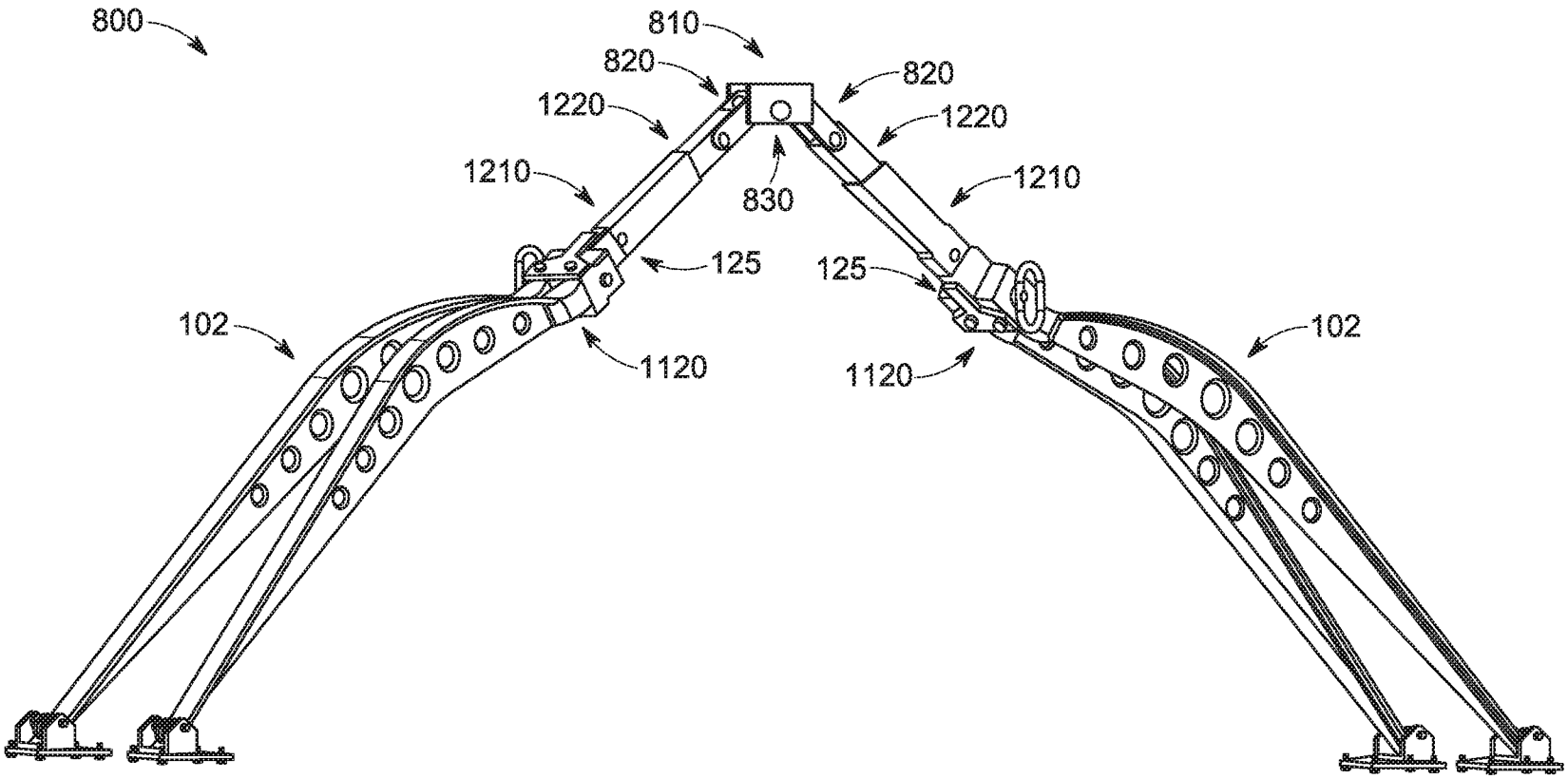
FIG. 20 illustrates a perspective view of an embodiment of a Bi-pod Rescue Strut System operating as a quad-pod for confined rescue.

Bi-pod rescue strut system 100 may have a number of other uses, such as to be used as a quad-pod whereby one or more Bi-pod rescue strut systems may be used to provide a support point for raising or lowering an object such as a rescue basket along a cliff, down a building, or out of a manhole. For example, FIG. 20 depicts another embodiment for the rescue strut. In this embodiment, a first Bi-pod rescue strut system and a second Bi-pod rescue strut system are coupled to a head 800 whereby the assembled quad-pod may be used to facilitate confined space rescue of a person or other object. The quad-pod head includes a base portion such as base portion 810 and one or more anchoring legs such as anchoring legs 820.

Anchoring 820 legs are attached to the base portion 810 whereby the anchoring legs may pivot about a pivot axis relative to the base portion 810. Anchoring legs 820 are adapted to either move jointly or independently of each other, and may be positioned in a variety of ways. For instance, anchoring legs 810 may be moveable towards and away from each other so as to be spread apart. Anchoring legs 810 have holes formed through them whereby when the anchoring legs are inserted into or fitted around upper inner tube member 1220 of the first and second Bi-pod rescue strut system the holes through anchor legs 810 align with the holes through upper inner tube members 1220. Position-locking pins may be placed to secure upper inner tube member 1220 of the first Bi-pod rescue strut system and second Bi-pod rescue strut system to first and second anchoring legs 820. Base portion 810 of the head 800 may include one or more anchoring holes such as anchoring hole 830 to provide an anchoring point for support apparatuses such as a basket and pulley system. The base of the head may also include one or more stabilization holes to provide securing points for other stabilizing apparatuses such as straps, chains, or mechanisms.

In the preferred method of use anchoring legs 820 are coupled to the first and second rescue strut stabilization system and secured with position locking pins. Once upper inner tube members 1220 are telescopically extended relative to the lower outer tube members 1210, the support legs 102*a* 102*b* may be deployed and locked at a desired angle. The basket or other rescue apparatus is supported by the attachment point to the base of the head and may be moved from a position above a manhole through the space created between the first and second Bi-pod rescue strut system to down into the manhole without having to move the Bi-pod rescue strut system support legs. This provides an effective mechanism where the weight of the basket is supported by the rescue strut members as the rescue strut members remain firmly secured to the ground. The quad-pod may also be configured so that Bi-pod rescue strut systems are angled so that the basket can be lowered off of a cliff without moving the Bi-pod rescue strut system support legs.

In further embodiments, straps or other apparatuses such as strong rope, chain, or other type of tying members may be used to provide additional stabilization between support legs in a single Bi-pod rescue strut system as well as between Bi-pod rescue strut systems, to help prevent the support legs from separating from one another and so the quad-pod is stopped from moving during use.

In another non-limiting embodiment, Bi-pod rescue strut system 100 may be used to elevate a vehicle on its side by using two or more Bi-pod rescue strut systems positioned on opposite sides of the vehicle. In this embodiment, an extension tension strap is connected to the telescopic strut extension and carried down between the support legs and connected to a load tension strap, chains, or mechanism, used to couple the supports legs to the lower portion of a load, and tightened. The tightening of the extension tension strap and load tension strap produces a 5:1 vector mechanical advantage and also keeps the First Responder off the ground out of the way while operating a winch, come, or other apparatus with a ratchet strap or other device. The vector mechanical advantage may be multiplied by 10:1 if the connection is made by a pulley system connected to the Bi-pod rescue strut system.

Bi-pod rescue strut system 100 may also be used as a vertical column to provide a support for stabilizing a load directly above the Bi-pod rescue strut system 100. In this embodiment, the Bi-pod rescue strut system 100 is providing support to an overhead load such as a collapsing ceiling. Support legs 102*a* 102*b* may have been spread apart and locked in place in their deployed positions at the selected angle desired by the First Responder with "U" shaped mounting bracket 1162 and base plate 163 of stabilizing feet 160*a* 160*b* rotated at angle with respect to support legs 102*a* 102*b* so that support legs 102*a* 102*b* and upper component 125 of yoke 1120 are pointed at an upward vertical direction. Telescoping extension strut 200 is secured to yoke 1120 whereby lower outer tube member 1210 is positioned over or inside upper component 125 of yoke 1120 and a position-locking pin is placed through receiving hole 211 through lower outer tube member 1210 and receiving hole 126 through upper component 125 of yoke 1120, whereby telescoping extension strut 200 is preferably at a 90-degree angle to the ground. Upper inner tube member 1220 is extended in relation to lower outer tube member 1210 whereby telescoping extension strut 200 and the end fitting of upper inner tube member 1220 is positioned against the ceiling. A position-locking pin is placed through the hole of upper extendable inner tube 1220 and corresponding lower outer tube 1210 whereby Bi-pod rescue strut system 100 is supporting and stabilizing a load directly above the rescue strut.

Figure 21:
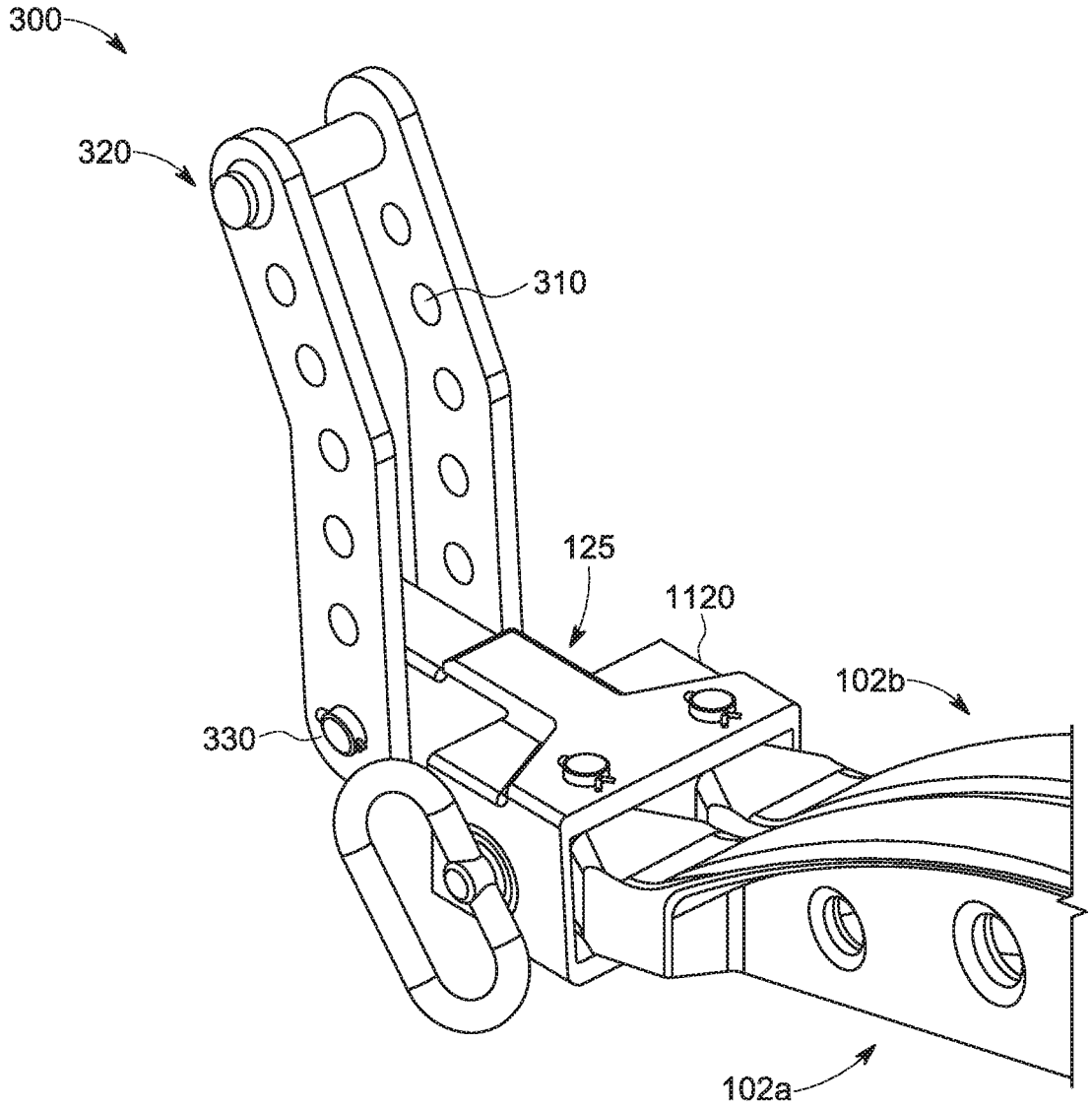
FIG. 21 illustrates a perspective view of the attachment link and yoke of the Bi-pod Rescue Strut System in the up position.

It is an intended objective of the present description to show that Bi-pod rescue strut system 100, in accordance with one or more embodiments, is extremely versatile and may have a variety of applications. Accordingly, a First Responder may couple upper component 125 of yoke 1120 to an attachment link such as attachment link 300 to provide further uses and provide a connection to multiple devices, as depicted in FIG. 21. Attachment link 300 has a first and second member with an opening between the first and second member.

The first and second member, may include a number of slots such as slots 310 configured to receive pins such as pin 320 that extend through the first and second member and through the opening between them. In some embodiments, other members may connect the first and second member. The first and second member are connected to upper component 125 of yoke 1120 by a position-locking pin such as position-locking pin 330 that extends through upper component 125 of yoke 1120. Position-locking pin 330 may be removed to detach the attachment link 300 from upper component 125 of yoke 1120. Attachment link 300 is configured to be removably connected to a jack, lever, fulcrum, or to other devices in order to assist in lifting, stabilizing, or moving the vehicle or the other objects. In further embodiments multiple pins may be used to connect the attachment link to the upper component of the yoke and to connect the attachment link to a jack, lever, fulcrum, or to other devices.

The Bi-pod rescue strut system may be coupled to a jack such as a HI-LIFT jack. For example, a position-locking pin may be used to couple attachment link to the jack. Afterwards, a First Responder may angle the stabilizing feet and slide the jack and the attached Bi-pod rescue strut system beneath an underside of an object. Alternatively, a First Responder may initially invert Bi-pod rescue strut system and angle the stabilizing feet such that support legs are flipped over whereby their top surfaces are touching the ground level and position Bi-pod rescue strut system beneath the object. Then, the First Responder may couple the jack to the inverted Bi-pod rescue strut system with a position-locking pin.

The First Responder may also operably couple a strap from the support legs to a base plate beneath the jack to provide additional sturdiness and stability when using the Bi-pod rescue strut system. This may be useful in scenarios whereby Bi-pod rescue strut system may be used for lifting a load onto an elevated location or lowering down the load from an elevated location, such as a loading dock or stairs. To do so, in one or more embodiments, the stabilizing feet of Bi-pod rescue strut system may be placed on the elevated location and the load may be placed on the support legs in an inverted position. When the jack has lifted or lowered the load, the load may simply be pushed off of support legs to its desired location.

In one non-limiting embodiment, Bi-pod rescue strut system 100 may be coupled to a lever such as lever 400. For example, a position-locking pin may be used to couple attachment link 300 to the lever 400. The lever 400 may be coupled to and balancing on fulcrum such as fulcrum 420. There are times where a First Responder of Bi-pod rescue strut system 100 may not be in possession or have easy access to the various specialized jacks useful in lifting vehicles or other objects so a lever or bar, disposed over a fulcrum may suffice to quickly and safely lift a vehicle or other object.

Figure 22:
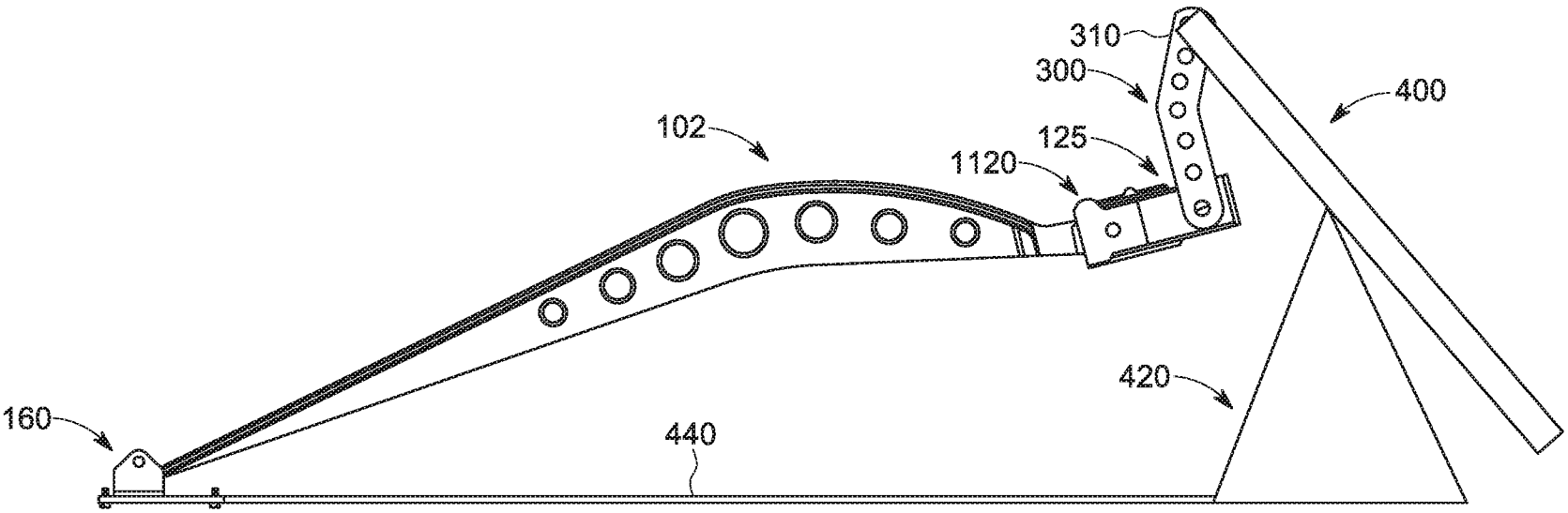
FIG. 22 illustrates a perspective view of an embodiment of a Bi-pod Rescue Strut System operating as a lifting device to lift a vehicle or other object.

In such a situation, Bi-pod rescue strut system 100 coupled to lever 400, disposed over fulcrum 420 may suffice to quickly and safely lift a vehicle or other object, as depicted in FIG. 22. Accordingly, a First Responder may couple Bi-pod rescue strut system 100 to lever 400 by coupling the attachment link 300 to the body of lever 400. Lever 400 may include a designated slot for inserting a position-locking pin, into a slot of lever 400 and also through designated slot 310 located on attachment link 300. A strap such as strap 440 may also be located on stabilizing feet 160 or on support legs 102 and may be configured to allow the First Responder to strap fulcrum 420 to Bi-pod rescue strut system 100 to prevent the base of Bi-pod rescue strut system 100 from kicking out.

Afterwards, the First Responder (with or without the assistance of other individuals) may determine a suitable location beneath a vehicle or other object for sliding Bi-pod rescue strut system 100 beneath the vehicle or other object. Then, the First Responder may apply force to the free end of lever 400 to cause Bi-pod rescue strut system 100 to raise the vehicle or other object such that support legs 102*a* 102*b* on Bi-pod rescue strut system 100 make contact with an underside of the vehicle or other object. If one applies sufficient force to the end of lever 400, the First Responder may be able to at least nominally and minimally raise the vehicle or other object to provide some space for one or more other First Responder to place one or more step chocks or other apparatuses underneath the vehicle to stabilize the vehicle.

Figure 23:
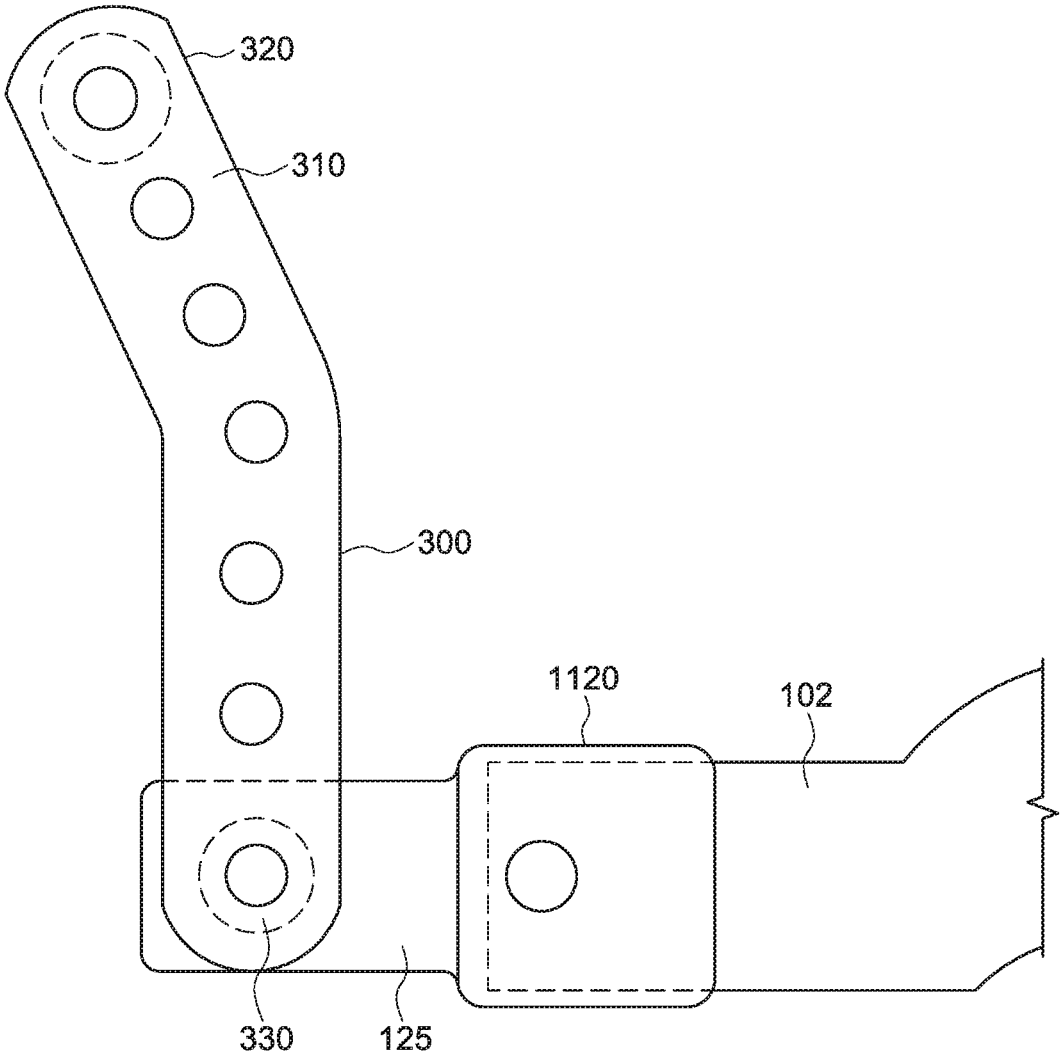
FIG. 23 illustrates a side view of the attachment link and yoke of the Bi-pod Rescue Strut System in the up position.

In some embodiments, attachment link 300 may be connected to Bi-pod rescue strut system 100 in the up-secured position as seen in FIG. 23. Bi-pod rescue strut system 100 is positioned beneath the vehicle or other object. Then, the First Responder may apply force to the free end of lever 400 to cause Bi-pod rescue strut system 100 to raise the vehicle or other object such that support legs 102*a* 102*b* on Bi-pod rescue strut system 100 make contact with an underside of the vehicle or other object. The vehicle then may be lifted to a certain height and one or more step chocks or other apparatuses may be positioned under the vehicle initially to assist the First Responders in lifting the vehicle.

Figure 24:
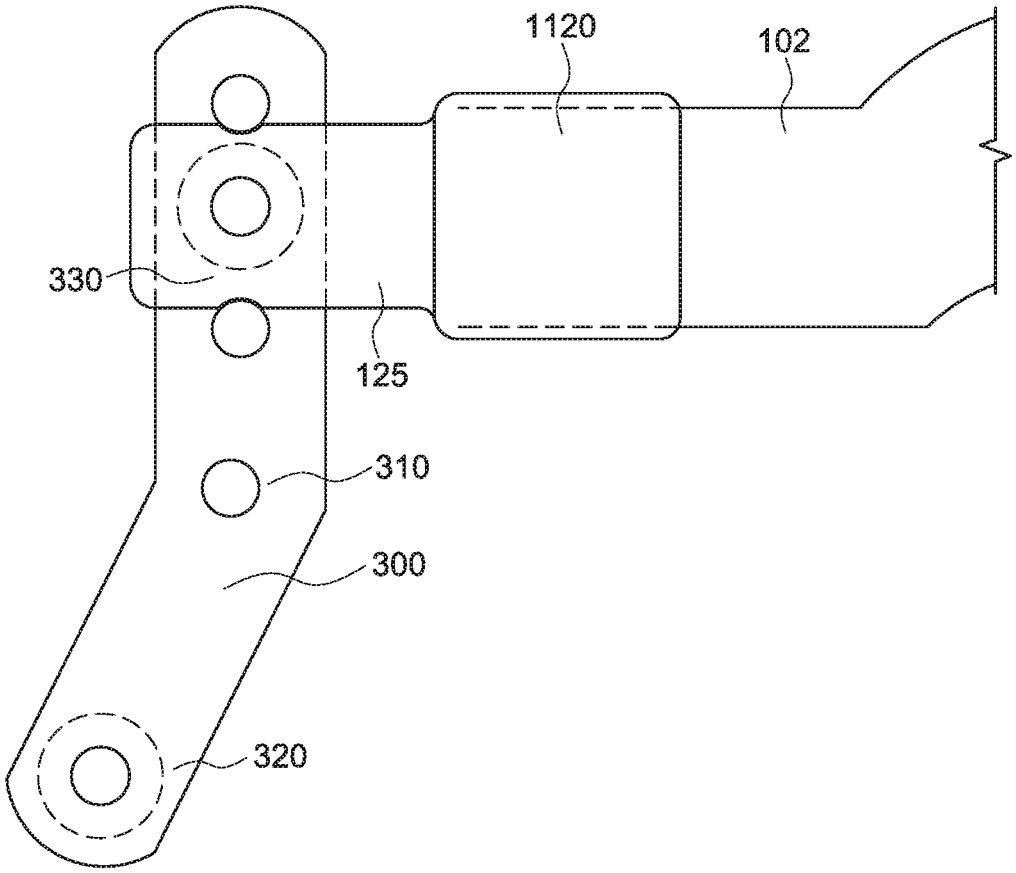
FIG. 24 illustrates a side view of the attachment link and yoke of the Bi-pod Rescue Strut System in the down position.

Once the vehicle is stabilized by the step chocks or other apparatuses, Bi-pod rescue strut system 100 may be temporarily removed and attachment link 300 may be connected to Bi-pod rescue strut system 100 in the down secured position as seen in FIG. 24. Bi-pod rescue strut system 100 is positioned beneath the vehicle or other object. Then, the First Responder may apply force to the free end of lever 400 to cause Bi-pod rescue strut system 100 to raise the vehicle or other object such that support legs 102*a* 102*b* on Bi-pod rescue strut system 100 make contact with an underside of the vehicle or other object. The vehicle or other object then may be lifted to a higher height and one or more step chocks or other apparatuses of higher elevation may be positioned under the vehicle or other object. This embodiment is useful particularly in emergency rescue operations where it is critical to access trapped individuals as quickly and as safely as possible.

Referring to FIGS. 15 and 24, the lever adapter device 101, the bi-pod rescue strut system 100, or both can include a locking mechanism that secures an attachment link, such as the attachment link 300, to the lever adapter device 101 or the Bi-pod rescue strut system 100 such that rotation of the attachment link is prevented.

According to one aspect of the disclosure, the lever adapter device 101, the Bi-pod rescue strut system, or both can define at least one detent 128. As shown in the illustrated embodiment, the upper component 125 defines the at least one detent 128, including a first detent 128*a* in an upper surface of the upper component 125 and a second detent 128*b* in a lower surface of the upper component 125.

An attachment link, such as the attachment link 300, may be rotatably attachable to the upper component 125 by inserting a fastener, such as the position-locking pin 330 through aligned slots in both the attachment link 300 and the upper component 125.

The attachment link 300 can include additional slots that are positioned such that at least one of the additional slots aligns with at least one of the detents 128. A fastener, such as the position-locking pin 330 can be inserted through the additional slot and the aligned detent to lock the attachment link 300 at the current orientation thereby preventing further rotation of the attachment link 300 relative to the upper component 125 until the fastener is removed from the detent 128.

Figure 25:
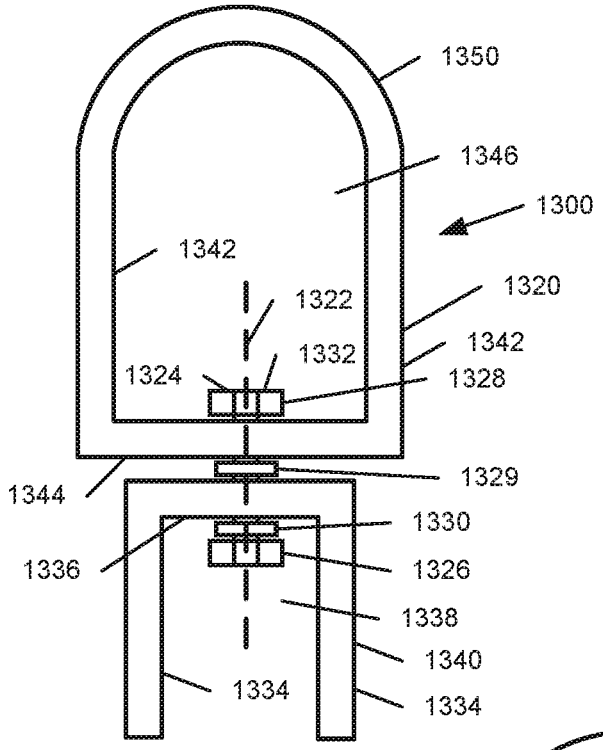
FIG. 25 illustrates a front elevation view of an attachment link according to one aspect of the disclosure, the attachment link in a first configuration.
Figure 26:
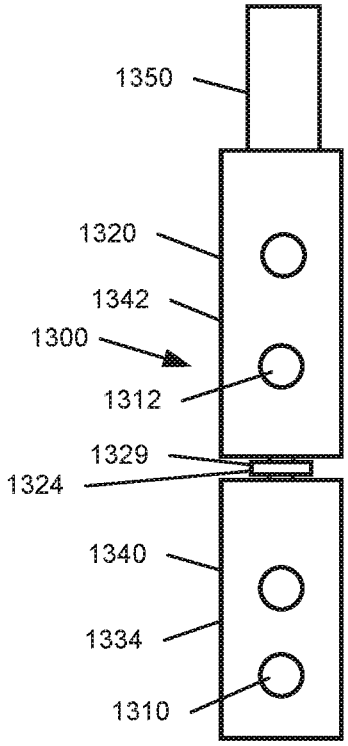
FIG. 26 illustrates a side elevation view of the attachment link of FIG. 25.
Figure 27:
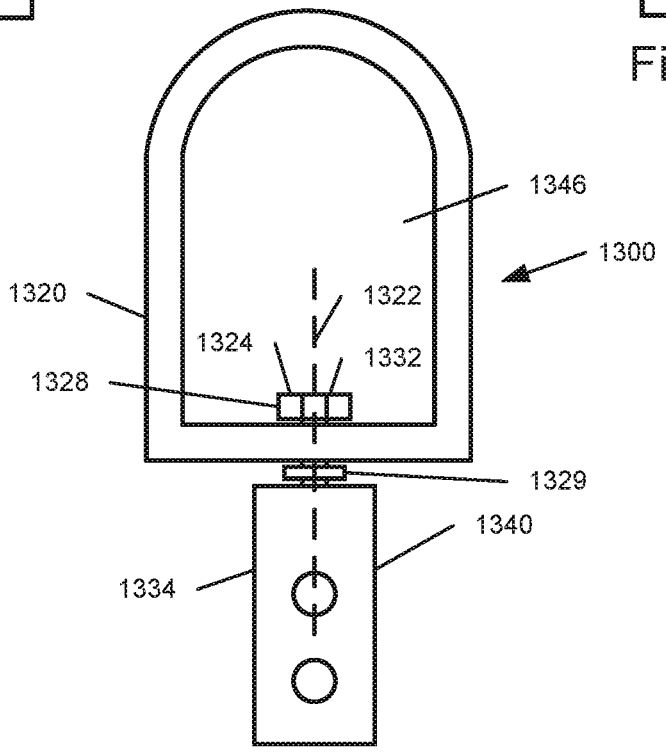
FIG. 27 illustrates a front elevation view of the attachment link of FIG. 25, the attachment link in a second configuration.

Referring to FIGS. 25 to 27, an attachment link 1300 can include a first component 1320 and a second component 1340 coupled together such that at least one of the first component 1320 and the second component 1340 is rotatable relative to the other of the first component 1320 and the second component 1340. According to one aspect of the disclosure, both the first component 1320 and the second component 1340 are rotatable about an axis of rotation 1322 in both a first direction of rotation (for example clockwise) and a second direction of rotation that is opposite the first direction of rotation (for example counterclockwise). The first component 1320 may be coupled to the second component 1340 such that the first component 1320 is rotatable about the axis of rotation 1322 in the first direction of rotation while the second component rotates about the axis of rotation 1322 in the second direction of rotation.

According to one embodiment, the attachment link 1300 is freely rotatable such that the first component 1320 and the second component 1340 rotate relative to one another about the axis of rotation 1322 without interference or limitation. The attachment link 1300 can include a locking mechanism (not shown) that enables the position of the first component 1320 relative to the second component 1340 about the axis of rotation 1322 to be fixed. Thus, if a specific orientation of the first component 1320 relative to the second component 1340 is desired, the locking mechanism can secure the first component 1320 and the second component 1340 in that desired orientation and maintain that desired orientation during use of the attachment link 1300 to lift the vehicle or heavy object.

According to one embodiment, the locking mechanism can lock the first component 1320 relative to the second component 1340 at predefined orientations (for example, every 45 degrees). For example, one or more of the first component 1320 and the second component 1340 can include slots that align at the predefined orientations such that a pin can be inserted through the aligned slots to lock the orientation of the first component 1320 and the second component 1340. According to another embodiment, the locking mechanism can lock the first component 1320 relative to the second component 1340 at any orientation.

As shown in the illustrated embodiment, the attachment link 1300 may include a fastener 1324, which rotatably couples the first component 1320 and the second component 1340. The fastener 1324 may include a nut 1326, a bolt 1328, and one or more washers 1329. One of the one or more washers 1329 can be positioned between the first component 1320 and the second component 1340, between a head 1332 of the bolt 1328 and one of the first component 1320 and the second component 1340, between the nut 1326 and one of the first component 1320 and the second component 1340, or any combination thereof.

The second component 1340, according to one embodiment, may be fork shaped and include two prongs 1334 extending outwardly from a base 1336 such that an interior area 1338 is defined between the prongs 1334. The prongs 1334 can be substantially parallel to each other and arranged such that the prongs 1334 are parallel to the axis of rotation 1322. The base 1336 can be arranged substantially perpendicular to the prongs 1334. The prongs 1334 may include a number of slots 1310 configured to receive locking members, such as pins, that extend through the slots 1310 of the prongs 1334 and at least partially through the interior area 1338.

As shown in the illustrated embodiment, the first component 1320 may define an enclosed shape, for example including an arc or semicircle portion 1350 wherein ends of the arc 1350 are joined to prongs 1342 extending outwardly from a base 1344 such that an interior area 1346 is defined. The interior area 1346 can be partially enclosed, or entirely enclosed. The prongs 1342 may include a number of slots 1312 configured to receive locking members, such as pins, that extend through the slots 1312 of the prongs 1342 and at least partially through the interior area 1346.

The attachment link 1300 defines a first configuration (as shown in FIGS. 25 and 26) in which the first component 1320 and the second component 1340 are aligned. For example, in the first, aligned, configuration, the interior area 1338 of the second component 1340 and the interior area 1346 of the first component 1320 face in the same direction. The attachment link 1300 defines a second configuration (as shown in FIG. 27) in which the first component 1320 and the second component 1340 are angularly offset (or not aligned). For example, in the second, angularly offset, configuration, the interior area 1338 of the second component 1340 and the interior area 1346 of the first component 1320 face in different directions. As shown in FIG. 27, the different directions of the second configuration can include perpendicular directions. According to one embodiment, the different directions of the second configuration can include directions offset by any angle greater than 0 degrees and less than 180 degrees.

Figure 28:
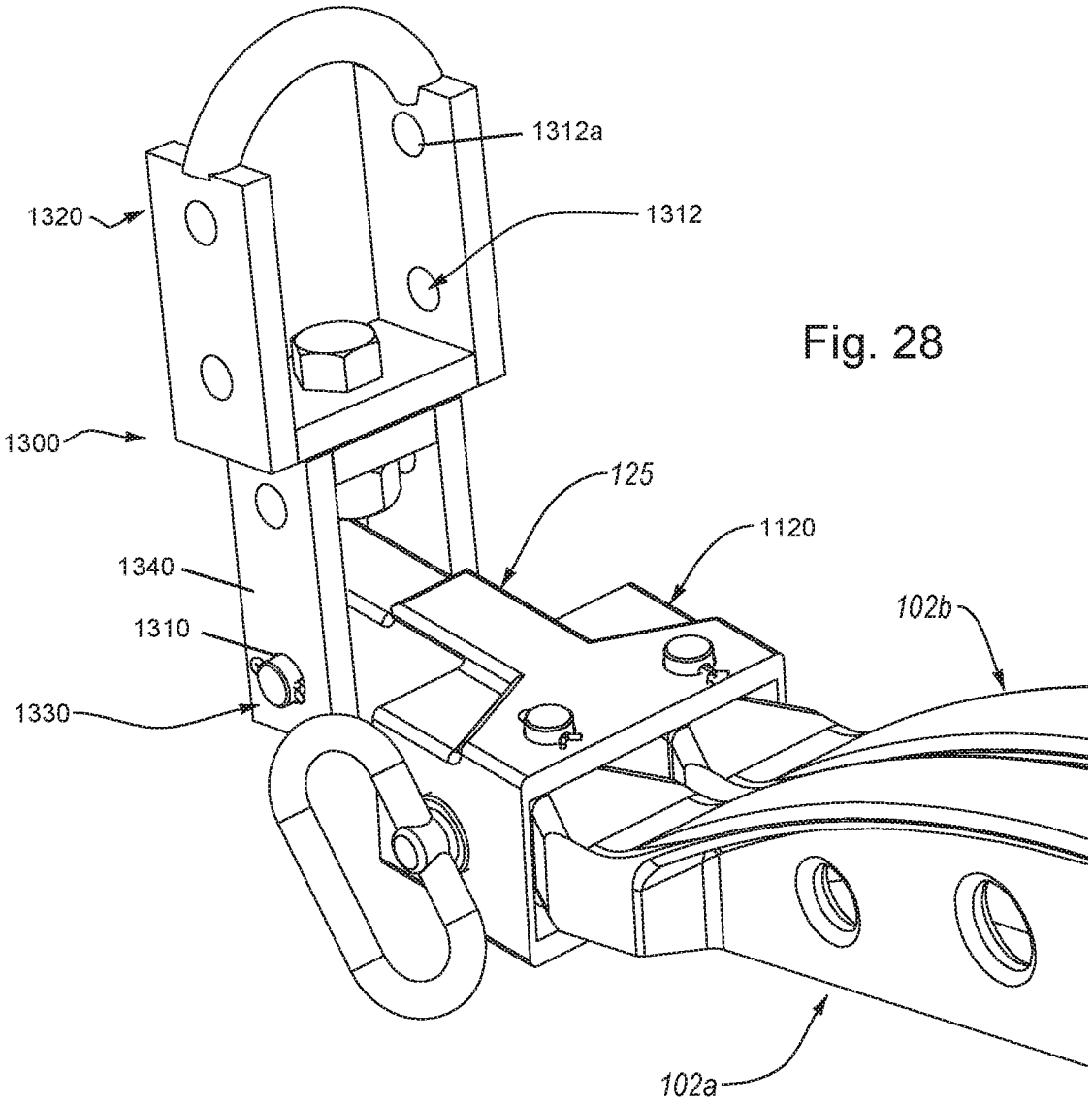
FIG. 28 illustrates an isometric view of the attachment link of FIG. 25 coupled to an adapter lever device.

Referring to FIG. 28, the lever adapter device 101 can include the attachment link 1300. As shown in the illustrated embodiment, a First Responder may couple the upper component 125 of yoke 120 to the attachment link 1300 to provide further uses and provide a connection to multiple devices, as described in further detail below.

The attachment link 1300 can be removably connected to a device such as a jack, fulcrum, or to another device to assist in lifting, stabilizing, or moving a vehicle or other object. As shown in the illustrated embodiment, one or more position-locking pins 1350 can be inserted in one or more of the slots 1310 of the attachment link 1300 to connect the attachment link 1300 to the upper component 125 of the yoke 1120. The position-locking pin 1330 may be removed from the slot 1310 to detach the attachment link 1300 from upper component 125 of yoke 1120.

The attachment link 1300 may be connected to the yoke 1120 such that the attachment link 1300 is rotatable about two different axes of rotation. The attachment link 1300 may be rotatable with respect to the yoke 1120 about an axis of rotation that extends through the position-locking pin 1330. For example, the attachment link 1300 may be rotated to a first position where the second component 1340 is positioned above the yoke 1120, as shown in the illustrated embodiment. The attachment link 1300 may be further rotated to a second position, for example about 180 degrees from the first position with respect to the axis of rotation defined by the position-locking pin 1330, to a second position where second component 1340 is positioned below the yoke 1120.

Figure 29:
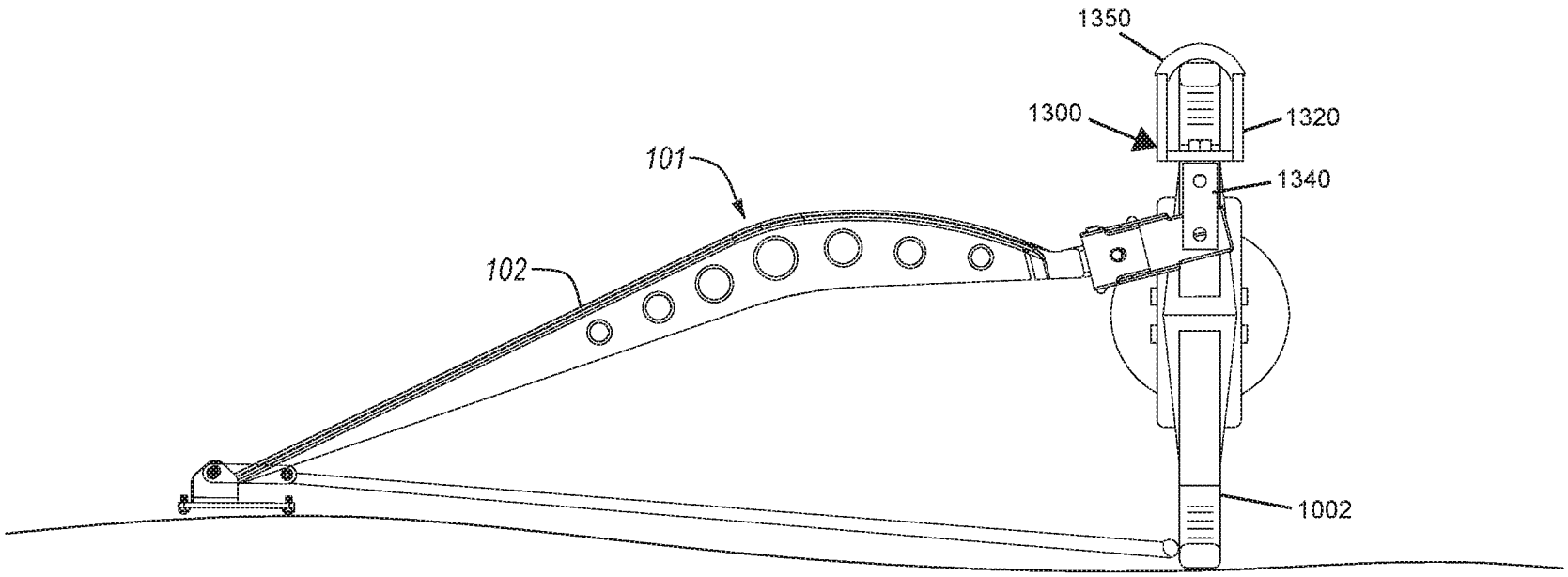
FIG. 29 illustrates a side elevation view of the attachment link of FIG. 25 coupled to an adapter lever device and a Jaws of Life tool.

Referring to FIG. 29, the lever adapter device 101 may be coupled to the Jaws of Life tool 1002. The lever adapter device 101 may be coupled to Jaws of Life tool 1002 by coupling the attachment link 1300 to the Jaws of Life tool 1002 such that the arc 1350 of first component 1320 of attachment link 1300 abuts a surface of the Jaws of Life tool 1002. According to one embodiment, a pivot cup or stirrup (not shown) may be used positively lock the Jaws of Life tool 1002 to the attachment link 1300. According to one embodiment, a fastener, for example a pin, can be inserted through one of the slots 1312, for example an upper-most slot 1312*a* to define an aperture that is sized to receive the Jaws of Life tool 1002 and prevent sliding of the attachment link 1300 relative to the Jaws of Life tool 1002, which may include a tapered surface that abuts the attachment link 1300.

Use of the attachment link 1300 to couple the lever adapter device 101 to the Jaws of Life tool 1002 provides flexibility in the placement and orientation of the Jaws of Life tool 1002. The orientation of the second component 1340 may be dictated by the position of the lever adapter device 101, which in turn may be limited by the position of the vehicle or heavy object to be lifted. The rotatable coupling of the first component 1320 to the second component 1340 enables flexibility in the orientation for the first component 1320, even when the orientation of the second component 1340 is fixed.

As shown in the illustrated embodiment, the attachment link 1300 can be in the second configuration allowing the Jaws of Life tool 1002 to be positioned at an angle, for example substantially perpendicular, to the lever adapter device 101. As shown in FIG. 10, the Jaws of Life tool 1002 is positioned substantially collinearly with the lever adapter device 101. However, conditions at the location of the vehicle or heavy object may prevent the Jaws of Life tool 1002 from being positioned substantially collinearly with the lever adapter device 101. Use of the attachment link 1300 can provide options for placement of the Jaws of Life tool 1002 thus providing a solution in a situation with limited space.

Figure 30:
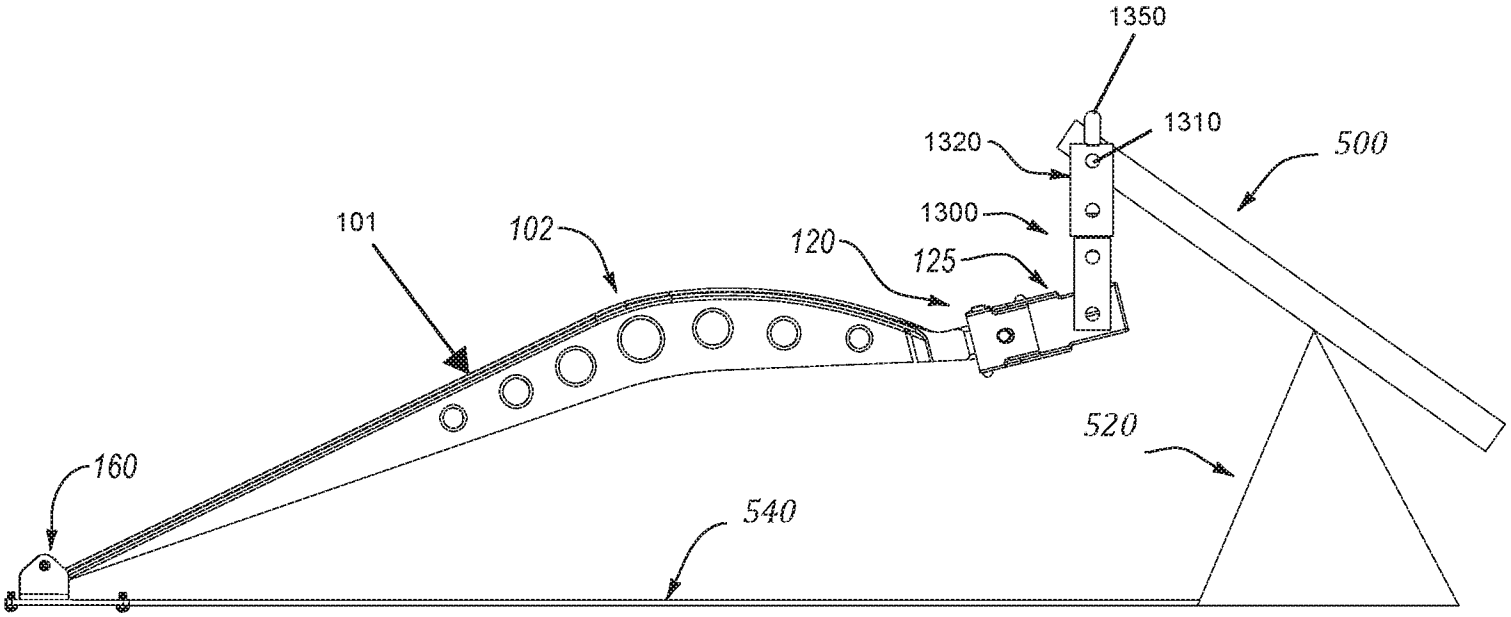
FIG. 30 illustrates a side elevation view of the attachment link of FIG. 25 coupled to an adapter lever device and a lever.

Referring to FIG. 30, the lever adapter device 101 may be coupled to a lever 500. The lever 500 may be coupled to, for example balancing on, a fulcrum 520. There are times where an operator of the lever adapter device 101 may not be in possession of or have easy access to one of the various specialized jacks useful in lifting vehicles or other heavy objects, such as a HI-LIFT jack and a scissor jack. In such a situation, the lever adapter device 101 can be coupled to the lever 500, which is disposed over the fulcrum 520 to quickly and safely lift a vehicle or other object.

Accordingly, a First Responder may couple the lever adapter device 101 to the lever 500 by coupling the attachment link 1300 to the body of the lever 500 whereby the first component 1320 of attachment link 1300, for example the arc 1350, may fit securely over an end of the lever 500. The lever 500 may include a designated slot for inserting a position-locking pin, into a slot of the lever 500 and also through one of the slots 1310 of the first component 1320 of the attachment link 1300. A strap such as strap 540 may also be located on stabilizing feet 160 or on the support legs 102 and may be configured to allow the First Responder to strap the fulcrum 520 to lever adapter device 101 to prevent movement of the stabilizing feet 160 of the lever adapter device 101 relative to the fulcrum 520.

The First Responder (with or without the assistance of other individuals) may determine a suitable location beneath a vehicle or other object to position the lever adapter device 101. Then, after the lever adapter device 101 is coupled to the lever 500 the First Responder may apply force to the free end of the lever 500 to cause the lever adapter device 101 to raise the vehicle or other object such that support legs 102*a* 102*b* on the lever adapter device 101 make contact with an underside of the vehicle or other object. After applying sufficient force to the end of the lever 500 to at least nominally and minimally raise the vehicle or other object, space may be provided for one or more other First Responders to place one or more step chocks or other apparatuses underneath the vehicle to stabilize the vehicle.

Figure 31:
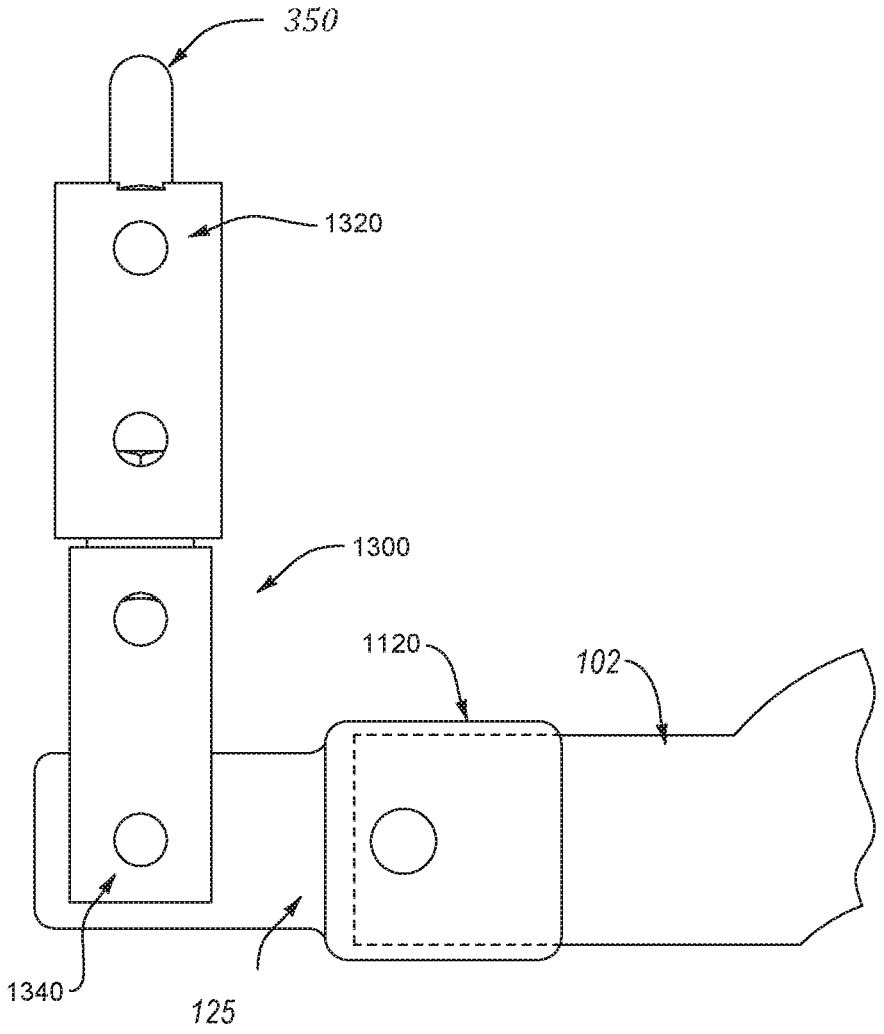
FIG. 31 illustrates a side elevation view of the attachment link of FIG. 25 coupled to an adapter lever device in a first position.

Referring to FIG. 31, the attachment link 1300 may be connected to the lever adapter device 101 in the first position where the second component 1340 is positioned above the yoke 1120. The attachment link 1300 may then be coupled to a lifting tool, such as a jack or a lever, such that force applied to the lifting tool raises the vehicle or heavy object. The vehicle or heavy object may then be stabilized by placing one or more step chocks or other apparatuses.

Figure 32:
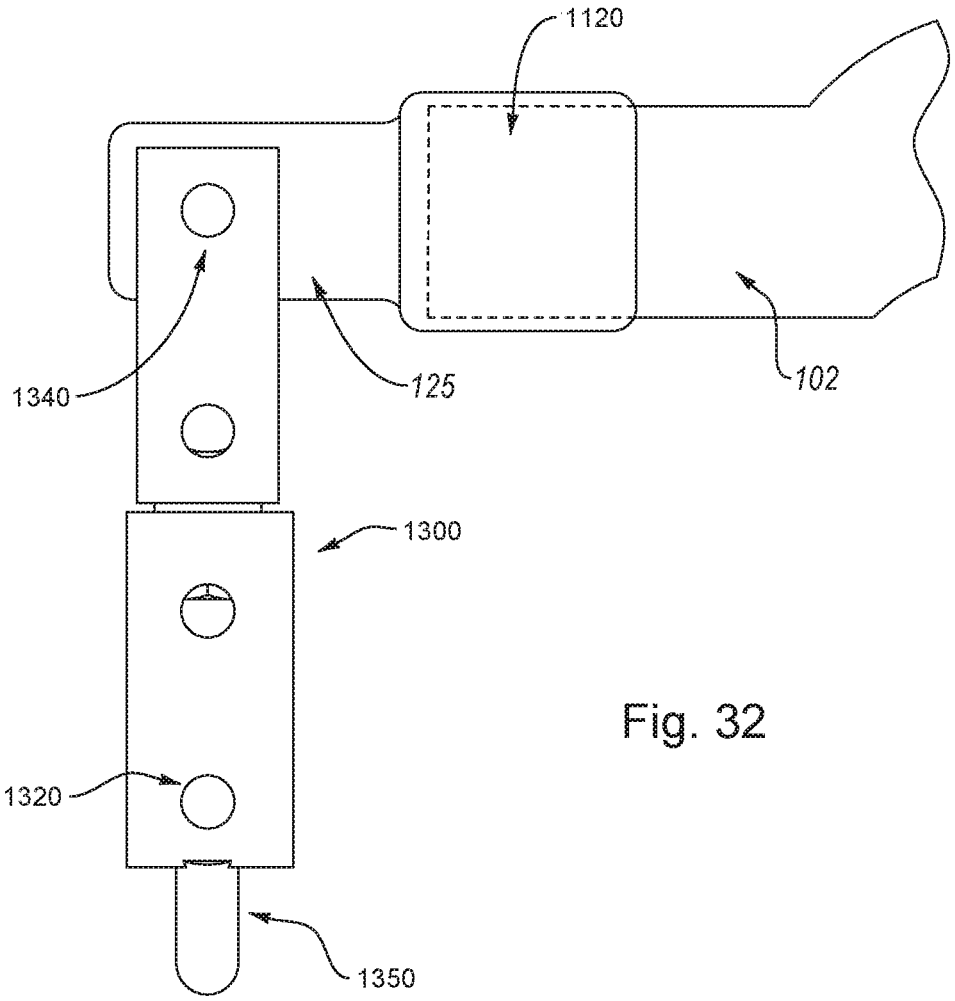
FIG. 32 illustrates a side elevation view of the attachment link of FIG. 25 coupled to an adapter lever device in a second position.

Referring to FIG. 32, the attachment link 1300 may be connected to the lever adapter device 101 in the second position where the second component 1340 is positioned above the yoke 1120. According to one embodiment, once the vehicle or heavy object is stabilized, for example by step chocks or other apparatuses, the lever adapter device 101 may be temporarily removed and the attachment link 1300 may be connected to Lever Adapter Device 100 in the second position. With the attachment link 1300 in the second position, the lever adapter device 101 can be positioned once again beneath the vehicle or other object. With the attachment link 1300 coupled to the lifting tool, the First Responder may apply force to the free end of the lifting tool to cause the lever adapter device 101 to raise the vehicle or other object such that the support legs 102*a* 102*b* on the lever adapter device 101 make contact with an underside of the vehicle or other object, thus lifting the vehicle or other object to a higher height than when the attachment link 1300 was in the first position. One or more step chocks or other apparatuses of higher elevation may then be positioned under the vehicle or other object. This method of use is useful particularly in emergency rescue operations where it is critical to access trapped individuals as quickly and as safely as possible.

The above-described Figures illustrate the architecture, functionality, and operation of possible implementations of the invention described in the present description according to various embodiments. The detailed description of the illustrative embodiments above is described in sufficient detail to enable those skilled in the art to practice the invention. To avoid unnecessary detail, the description may have omitted certain information known to those skilled in the art.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

The invention claimed is:

1. A lever adapter device comprising:

one or more support legs; and an attachment link supported by the one or more support legs such that the attachment link is rotatable relative to the one or more support legs about a first axis of rotation, the attachment link including a first component and a second component, the first component coupled to the second component such that the first component is rotatable relative to the second component about a second axis of rotation, wherein the first axis of rotation intersects the second axis of rotation.

2. The lever adapter device of claim 1 wherein the first axis of rotation is perpendicular to the second axis of rotation.

3. The lever adapter device of claim 1 wherein the second component defines a slot sized to a-receive a fastener that secures the attachment link to the one or more support legs, and the fastener defines the first axis of rotation.

4. The lever adapter device of claim 1 wherein the second component defines a base and a prong that extends away from the base along a direction that is parallel to the second axis of rotation.

5. The lever adapter device of claim 4 wherein the prong defines a slot sized to receive a fastener that secures the attachment link to the one or more support legs, and the fastener defines the first axis of rotation.

6. The lever adapter device of claim 4 wherein the prong is a first prong, and the second component defines a second prong that extends away from the base along the direction parallel to the second axis of rotation such that the second axis of rotation passes between the first prong and the second prong.

7. The lever adapter device of claim 6 wherein the second component defines a slot that extends through both the first prong and the second prong, the slot sized to receive a fastener that secures the attachment link to the one or more support legs, and the fastener defines the first axis of rotation.

8. The lever adapter device of claim 1, wherein the attachment link is supported by the one or more support legs such that both the first component and the second component are rotatable relative to the one or more support legs about the first axis of rotation.

9. A method of lifting an object, the method comprising:

positioning a first end of one or more support legs beneath the object;

securing an attachment link relative to the one or more support legs such that the attachment link is rotatable relative to the one or more support legs about a first axis of rotation;

after attaching the attachment link to the one or more support legs, rotating a first component of the attachment link relative to a second component of the attachment link about a second axis of rotation, which intersects the first axis of rotation;

coupling the attachment link to a lifting device; and after coupling the attachment link to the lifting device, supplying an input to the lifting device thereby raising the attachment link, a portion of the one or more support legs, and the object.

10. The method of claim 9 wherein securing the attachment link includes inserting a fastener through a slot defined by the second component such that the fastener defines the first axis of rotation.

11. The method of claim 10 wherein the slot is a first slot and the fastener is a first fastener, the method further comprising:

inserting a second fastener through a second slot defined by both the first component and the second component such that the second fastener defines the second axis of rotation.

12. The method of claim 9 wherein the first axis of rotation is perpendicular to the second axis of rotation.

13. The method of claim 9 wherein coupling the attachment link to a lifting device includes coupling the attachment link to a lever, a jack, or a Jaws of Life tool.

14. The method of claim 13 wherein supplying the input to the lifting device includes applying a force to the attachment link via the lifting device.

15. The method of claim 9 wherein at least a portion of both the first component and the second component are positioned above the first axis of rotation while supplying the input to the lifting device.

16. The method of claim 9 wherein at least a portion of both the first component and the second component are positioned below the first axis of rotation while supplying the input to the lifting device.

17. The method of claim 16, further comprising:

stabilizing the object such that removal of the one or more support legs from underneath the object will not result in a change in elevation of the object;

rotating the attachment link about the first axis of rotation such that at least a portion of both the first component and the second component are positioned above the first axis of rotation; and supplying an additional input to the lifting device thereby further raising the attachment link, the portion of the one or more support legs, and the object.

18. The method of claim 17 wherein stabilizing the object includes placing a chock block beneath the object, the chock block defining a height sufficient to maintain the elevation of the object upon removal of the one or more support legs from beneath the object.

19. A lever adapter device comprising:

one or more support legs; and an attachment link supported by the one or more support legs such that the attachment link is rotatable relative to the one or more support legs about a first axis of rotation, the attachment link including a first component and a second component, the first component coupled to the second component such that the first component is rotatable relative to the second component about a second axis of rotation, wherein the second component defines a base, a first prong that extends away from the base along a direction that is parallel to the second axis of rotation, and a second prong that extends away from the base along the direction parallel to the second axis of rotation such that the second axis of rotation is positioned between the first prong and the second prong without intersecting either of the first prong and the second prong.

20. The lever adapter device of claim 19 wherein the second component defines a slot that extends through both the first prong and the second prong, the slot sized to receive a fastener that secures the attachment link to the one or more support legs, and the fastener defines the first axis of rotation.

* * * * *